US008208348B2

(12) United States Patent
Kojima et al.

(10) Patent No.: US 8,208,348 B2
(45) Date of Patent: Jun. 26, 2012

(54) HAND POSITION DETECTING DEVICE

(75) Inventors: Tadashi Kojima, Musashino (JP); Nobuhiro Aoki, Kokubunji (JP)

(73) Assignee: Casio Computer Co., Ltd., Tokyo (JP)

( * ) Notice: Subject to any disclaimer, the term of this patent is extended or adjusted under 35 U.S.C. 154(b) by 461 days.

(21) Appl. No.: 12/473,750

(22) Filed: May 28, 2009

(65) Prior Publication Data

US 2009/0296534 A1 Dec. 3, 2009

(30) Foreign Application Priority Data

May 30, 2008 (JP) ..... 2008-142364

(51) Int. Cl.
*G04B 19/04* (2006.01)
*G04B 27/00* (2006.01)

(52) U.S. Cl. ..... 368/80; 47/185; 47/220

(58) Field of Classification Search ..... 368/47, 368/73–74, 76, 80, 185, 187, 220, 223, 228
See application file for complete search history.

(56) References Cited

U.S. PATENT DOCUMENTS 4,358,753 A * 11/1982 Cascini ..... 341/2
4,645,357 A 2/1987 Allgaier
5,270,993 A * 12/1993 Besson et al. ..... 368/80
5,457,664 A 10/1995 Izukawa et al.
5,640,007 A 6/1997 Talbott et al.
5,734,474 A 3/1998 Haecker et al.
5,999,495 A 12/1999 Hashizume et al.
6,288,977 B1 9/2001 Yoshida
6,367,967 B1 4/2002 Kojima et al.
6,424,600 B1 7/2002 Okeya et al.
6,473,366 B2 * 10/2002 Peng ..... 368/47
6,473,367 B2 * 10/2002 Peng ..... 368/47
6,731,571 B2 5/2004 Yiu
6,804,173 B2 10/2004 Yiu
6,807,128 B2 10/2004 Yiu
7,154,818 B2 12/2006 Liu
RE40,370 E * 6/2008 Sato et al. ..... 368/157
2002/0095226 A1 * 7/2002 Suzuki et al. ..... 700/56
2002/0167869 A1 11/2002 Masuda et al.
2004/0120220 A1 6/2004 Ogasawara
2004/0120221 A1 * 6/2004 Ogasawara et al. ..... 368/80
2004/0120223 A1 * 6/2004 Luk ..... 368/220

(Continued)

FOREIGN PATENT DOCUMENTS

EP 2042947 A1 4/2009

(Continued)

OTHER PUBLICATIONS

Machine translation of JP2003-194971.*

(Continued)

*Primary Examiner* — Vit Miska
(74) *Attorney, Agent, or Firm* — Holtz, Holtz, Goodman & Chick, PC

(57) ABSTRACT

When detecting a rotational position of a seconds hand, it is determined whether data stored in a register in correspondence with a supply state of a drive current previously supplied to a coil of a stepping motor is "0". When the data is "0", the rotational position of the seconds hand is optically detected. When the data is "1", the seconds hand is rotated one step, and then, the rotational position of the seconds hand is optically detected. Even though the seconds hand is shifted one second, the position detection is executed every two steps.

7 Claims, 30 Drawing Sheets

U.S. PATENT DOCUMENTS

| | | | | |
|---|---|---|---|---|
| 2004/0125702 | A1* | 7/2004 | Kitajima et al. | 368/80 |
| 2006/0114750 | A1* | 6/2006 | Iida et al. | 368/67 |
| 2009/0016172 | A1 | 1/2009 | Fujii et al. | |
| 2009/0086580 | A1 | 4/2009 | Aoki et al. | |
| 2009/0086581 | A1 | 4/2009 | Suizu et al. | |
| 2009/0161120 | A1 | 6/2009 | Kojima | |
| 2009/0296533 | A1 | 12/2009 | Kojima | |

FOREIGN PATENT DOCUMENTS

| | | | |
|---|---|---|---|
| GB | 2 270 398 | A | 3/1994 |
| JP | 6-222164 | A | 8/1994 |
| JP | 2000-162336 | A | 6/2000 |
| JP | 2002-71847 | A | 3/2002 |
| JP | 2002-107465 | A | 4/2002 |
| JP | 2002-116270 | A | 4/2002 |
| JP | 2002-357678 | A | 12/2002 |
| JP | 2003-194971 | A | 7/2003 |
| JP | 2004-184088 | A | 7/2004 |
| JP | 2004-257816 | A | 9/2004 |
| JP | 2006-046924 | A | 2/2006 |
| JP | 2006-153652 | A | 6/2006 |
| JP | 2006-275803 | A | 10/2006 |
| JP | 3872688 | B2 | 10/2006 |
| WO | WO 2007/102412 | A1 | 9/2007 |

OTHER PUBLICATIONS

Machine translation of JP2004-184088.*

Extended European Search Report dated Jul. 7, 2010 (in English) issued in counterpart European Application No. 09161225.9.

Japanese Office Action dated Mar. 16, 2010 and English translation thereof issued in Japanese Application No. 2007-331355, which is a counterpart of related U.S. Appl. No. 12/341,470.

Japanese Office Action dated Jun. 1, 2010 (and English translation thereof) issued in Japanese Application No. 2008-139127, which is a Japanese counterpart of related U.S. Appl. No. 12/472,515.

Related U.S. Applications: U.S. Appl. No. 12/235,916, filed Sep. 23, 2008 (U.S. Publ. No. 2009/0086580); U.S. Appl. No. 12/238,090, filed Sep. 25, 2008 (U.S. Publ. No. 2009/0086581); U.S. Appl. No. 12/341,470, filed Dec. 22, 2008; U.S. Appl. No. 12/472,515, filed May 27, 2009.

Japanese Application Office Action dated Oct. 26, 2010 (and English translation thereof) in counterpart Japanese No. 2008-142364.

Japanese Office Action dated Nov. 10, 2009 and English translation thereof issued in a counterpart Japanese Application No. 2007-253830 of related U.S. Appl. No. 12/238,090.

* cited by examiner

FIG.6

| FIRST DRIVING SYSTEM: SECONDS HAND TRAIN WHEEL | | | | | |
|---|---|---|---|---|---|
| WHEEL TYPE | WHEEL: PINION | NUMBER OF TEETH (Z) | ROTATIONAL ANGLE | PULSES PER ONE ROTATION | DETECTION APERTURE |
| ROTOR | PINION | 10 | 180 | 2 | |
| FIFTH WHEEL | WHEEL | 50 | 36 | 10 | |
| | PINION | 10 | | | |
| SECONDS WHEEL | WHEEL | 60 | 6 | 60 | ● |

| SECOND DRIVING SYSTEM: CENTER AND HOUR HANDS TRAIN WHEEL | | | | | |
|---|---|---|---|---|---|
| WHEEL TYPE | WHEEL: PINION | NUMBER OF TEETH (Z) | ROTATIONAL ANGLE | PULSES PER ONE ROTATION | DETECTION APERTURE |
| ROTOR | PINION | 10 | 180 | 2 | |
| INTERMEDIATE WHEEL | WHEEL | 60 | 30 | 12 | ● |
| | PINION | 8 | | | |
| THIRD WHEEL | WHEEL | 60 | 4 | 90 | |
| | PINION | 16 | | | |
| CENTER WHEEL | WHEEL | 64 | 1 | 360 | ● |
| | PINION | 20 | | | |
| MINUTE WHEEL | WHEEL | 60 | 1/3 | 1080 | |
| | PINION | 16 | | | |
| HOUR WHEEL | WHEEL | 64 | 1/12 | 4320 | ● |

DETECTION PATTERN FOR SECONDS WHEEL

| REGISTER | TERMINAL A | TERMINAL B | SECOND |
|---|---|---|---|
| 0 | + | - | EVEN |

| REGISTER | TERMINAL A | TERMINAL B | SECOND |
|---|---|---|---|
| 1 | - | + | ODD |

FIG.27

| POSITION | APERTURE | EXAMPLE 1 | DETECTION TIMING |
|---|---|---|---|
| 0 | ○ | 0-SECOND POSITION DETECTED | ◎ |
| 1 | × | | |
| 2 | × | | |
| 3 | × | | |
| 4 | × | | |
| 5 | × | | |
| 6 | × | | |
| 7 | × | | |
| 8 | ○ | | |
| 9 | ○ | | |
| 10 | ○ | | |
| 11 | ○ | | |
| 12 | ○ | | |
| 13 | ○ | | |
| 14 | ○ | | |
| 15 | ○ | | |
| 16 | ○ | | |
| 17 | × | | |
| 18 | × | | |
| 19 | × | | |
| 20 | ○ | | |
| 21 | ○ | | |
| 22 | ○ | | |
| 23 | ○ | | |
| 24 | ○ | | |
| 25 | ○ | | |
| 26 | ○ | | |
| 27 | ○ | | |
| 28 | ○ | | |
| 29 | × | | |
| 30 | × | | |
| 31 | × | | |
| 32 | ○ | | |
| 33 | ○ | | |
| 34 | ○ | | |
| 35 | ○ | | |
| 36 | ○ | | |
| 37 | ○ | | |
| 38 | ○ | | |
| 39 | ○ | | |
| 40 | ○ | | |
| 41 | × | | |
| 42 | × | START | ◎ |
| 43 | × | 2 STEPS | |
| 44 | ○ | | ◎ |
| 45 | ○ | | |
| 46 | ○ | | |
| 47 | ○ | 8 STEPS | |
| 48 | ○ | | |
| 49 | ○ | | |
| 50 | ○ | | |
| 51 | × | | |
| 52 | × | | ◎ |
| 53 | × | | |
| 54 | × | | |
| 55 | × | 8 STEPS | |
| 56 | × | | |
| 57 | × | | |
| 58 | × | | |
| 59 | × | | |

FIG.29

| POSITION | APERTURE | EXAMPLE 2 | DETECTION TIMING |
|---|---|---|---|
| 0 | ○ | 0-SECOND POSITION DETECTED | ◎ |
| 1 | × | | |
| 2 | × | | |
| 3 | × | | |
| 4 | × | START | ◎ |
| 5 | × | 2 STEPS | |
| 6 | × | 2 STEPS | ◎ |
| 7 | × | | |
| 8 | ○ | | ◎ |
| 9 | ○ | | |
| 10 | ○ | | |
| 11 | ○ | | |
| 12 | ○ | 8 STEPS | |
| 13 | ○ | | |
| 14 | ○ | | |
| 15 | ○ | | |
| 16 | ○ | 2 STEPS | ◎ |
| 17 | × | | |
| 18 | × | 2 STEPS | ◎ |
| 19 | × | | |
| 20 | ○ | | ◎ |
| 21 | ○ | | |
| 22 | ○ | | |
| 23 | ○ | | |
| 24 | ○ | 8 STEPS | |
| 25 | ○ | | |
| 26 | ○ | | |
| 27 | ○ | | |
| 28 | ○ | 2 STEPS | ◎ |
| 29 | × | | |
| 30 | × | 2 STEPS | ◎ |
| 31 | × | | |
| 32 | ○ | | ◎ |
| 33 | ○ | | |
| 34 | ○ | | |
| 35 | ○ | | |
| 36 | ○ | 8 STEPS | |
| 37 | ○ | | |
| 38 | ○ | | |
| 39 | ○ | | |
| 40 | ○ | 2 STEPS | ◎ |
| 41 | × | | |
| 42 | × | 2 STEPS | ◎ |
| 43 | × | | |
| 44 | ○ | | ◎ |
| 45 | ○ | | |
| 46 | ○ | | |
| 47 | ○ | | |
| 48 | ○ | 8 STEPS | |
| 49 | ○ | | |
| 50 | ○ | | |
| 51 | × | | |
| 52 | × | | ◎ |
| 53 | × | | |
| 54 | × | | |
| 55 | × | 8 STEPS | |
| 56 | × | | |
| 57 | × | | |
| 58 | × | | |
| 59 | × | | |

HAND POSITION DETECTING DEVICE

CROSS-REFERENCE TO RELATED APPLICATIONS

This application is based upon and claims the benefit of priority from prior Japanese Patent Application No. 2008-142364, filed May 30, 2008, the entire contents of which are incorporated herein by reference.

BACKGROUND OF THE INVENTION

1. Field of the Invention

The present invention relates to a hand position detecting device which detects rotational positions of seconds, center and hour hands.

2. Description of the Related Art

A conventional hand position detecting device used for a hand type timepiece is disclosed in Japanese Patent No. 3872688.

The hand position detecting device comprises a first drive system in which a first drive motor transmits its rotation to a seconds wheel which in turn causes a seconds hand to sweep around a dial, a second drive system in which a second drive motor transmits its rotations to the center and hour wheels to cause the center and hour hands, respectively, to sweep around the dial. The hand position detecting device also comprises a photosensor including a light emission element and a photo detection element. The photosensor optically detects a first, a second and a third light-passing apertures provided respectively in the seconds, center and hour wheels with the aid of the light emission element and the photo detection element when the seconds, center and hour wheels of the first and second drive systems are rotated after pointing to the same direction on the same axis. The hand position detecting device detects respective rotational positions of the seconds, center and hour wheels based on detected signals from the photosensor and hence rotational positions of the seconds, center and hour hands are determined.

According to the conventional hand position detecting device, the rotational positions of the hands are detected in response to a signal which is output to the photosensor in synchronization with timing to output a pulse to one of winding start and winding end of each coil in the first and second drive motors. The photosensor detects the rotational positions at every two steps of the first and second drive motors. Therefore, the rotational positions may not be detected correctly in the case where the first and second drive motors do not operate normally due to an external magnetic field.

BRIEF SUMMARY OF THE INVENTION

According to an embodiment of the present invention, a hand position detecting device comprises:

a hand wheel including at least a first light transmitting portion provided at a reference point and second and third light transmitting portions spaced from the first light transmitting portion by non-transmitting portions;

a stepping motor including a coil, a stator and a rotor and configured to alternately switch a direction of a magnetic field generated in the stator when a drive current of which direction is alternately changed per pulse is supplied to the coil and rotate the rotor 180 degrees in one step to drive the hand wheel;

a photo detector configured to emit light at every even-numbered second during rotation of the stepping motor and detect light passing through the first, second and third light transmitting portions;

a data memory configured to store identification data indicative of a supply state of the drive current previously supplied to a winding start terminal and a winding end terminal of the coil; and a hand position detection controlling section configured to read the identification data from the data memory and control the photo detector to detect a position of the hand wheel based on the identification data.

According to another embodiment of the present invention, a hand position detecting device comprises:

a hand wheel including at least a first light transmitting portion provided at a reference point and second and third light transmitting portions spaced from the first light transmitting portion by at least two non-transmitting portions;

a stepping motor including a coil, a stator and a rotor and configured to alternately switch a direction of a magnetic field generated in the stator when a drive current of which direction is alternately changed per pulse is supplied to the coil and rotate the rotor 180 degrees in one step to drive the hand wheel;

a photo detector configured to emit light at every even-numbered second during rotation of the stepping motor and detect light passing through the first, second and third light transmitting portions;

a data memory configured to store identification data indicative of a supply state of the drive current previously supplied to a winding start terminal and a winding end terminal of the coil; and a hand position detection controlling section configured to read the identification data from the data memory, and, based on the identification data, control the photo detector to detect a position of the hand wheel, or control the photo detector not to detect the position of the hand wheel and drive the stepping motor to rotate one step to rotate the hand one step via the hand wheel.

According to another embodiment of the present invention, a hand position detecting device comprises:

a hand wheel including at least a first light transmitting portion provided at a reference point and second and third light transmitting portions spaced from the first light transmitting portion by non-transmitting portions;

a stepping motor including a coil, a stator and a rotor and configured to alternately switch a direction of a magnetic field generated in the stator when a drive current of which direction is alternately changed per pulse is supplied to the coil and rotate the rotor 180 degrees in one step to drive the hand wheel;

a photo detector configured to emit light at every even-numbered second during rotation of the stepping motor and detect light passing through the first, second and third light transmitting portions;

a drive current recognition section configured to recognize a supply state of the drive current supplied to the coil; and a hand position detection controlling section configured to control the photo detector to detect a position of the hand wheel based on a recognition result made by the drive current recognition section.

According to another embodiment of the present invention, a hand position detecting device comprises:

a hand wheel including at least a first light transmitting portion provided at a reference point and second and third light transmitting portions spaced from the first light transmitting portion by at least two non-transmitting portions;

a stepping motor including a coil, a stator and a rotor and configured to alternately switch a direction of a magnetic field generated in the stator when a drive current of which direction is alternately changed per pulse is supplied to the coil and rotate the rotor 180 degrees in one step to drive the hand wheel;

a photo detector configured to emit light at every even-numbered second during rotation of the stepping motor and detect light passing through the first, second and third light transmitting portions;

a drive current recognition section configured to recognize a supply state of the drive current supplied to the coil; and a hand position detection controlling section configured to, based on a recognition result made by the drive current recognition section, control the photo detector to detect a position of the hand wheel, or control the photo detector not to detect the position of the hand wheel and drive the stepping motor to rotate one step to rotate the hand one step via the hand wheel.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the present invention and, together with the general description given above and the detailed description of the embodiments given below, serve to explain the principles of the present invention in which:

FIG. 6 shows details of components of each of first and second driving systems of FIG. 2, including the operational conditions of the components;

FIGS. 11A, 11B, 11C, 11D, 11E, 11F, 11G, 11H, 11I, 11J, 11K, 11L, 11M, 11N, 11O and 11P show a basic position detecting operation of the seconds, hour and intermediate wheels of FIG. 5, wherein FIGS. 11A-11M illustrate respective states of the wheels obtained when the center wheel rotates sequentially one step (12 degrees) at a time, FIG. 11N shows a state of the wheels when the center wheel rotates 360 steps (one hour) from the state of FIG. 11M, FIG. 11O shows a state of the wheels obtained when the center wheel rotates 9 hours from the state of FIG. 11N, and FIG. 11P shows a state of the wheels at an "11-o'clock 00-minute position" obtained when the center wheel rotates one hour from the state of FIG. 11O;

FIGS. 17A and 17B schematically show first or second step motor, wherein FIG. 17A is an enlarged plan view showing polarity of a stator in a case where the hands are attached to the hands wheel at the reference position, and FIG. 17B is an enlarged plan view showing reversed polarity;

FIG. 27 shows a table representing operational states of the seconds hand position detecting process of FIG. 26;

FIG. 29 shows a table representing operational states of the seconds hand position detecting process of FIG. 28.

DETAILED DESCRIPTION OF THE INVENTION

First Embodiment

Referring to FIGS. 1-24, description will be made on a hand type wristwatch according to a first embodiment of the present invention.

Figure 1:
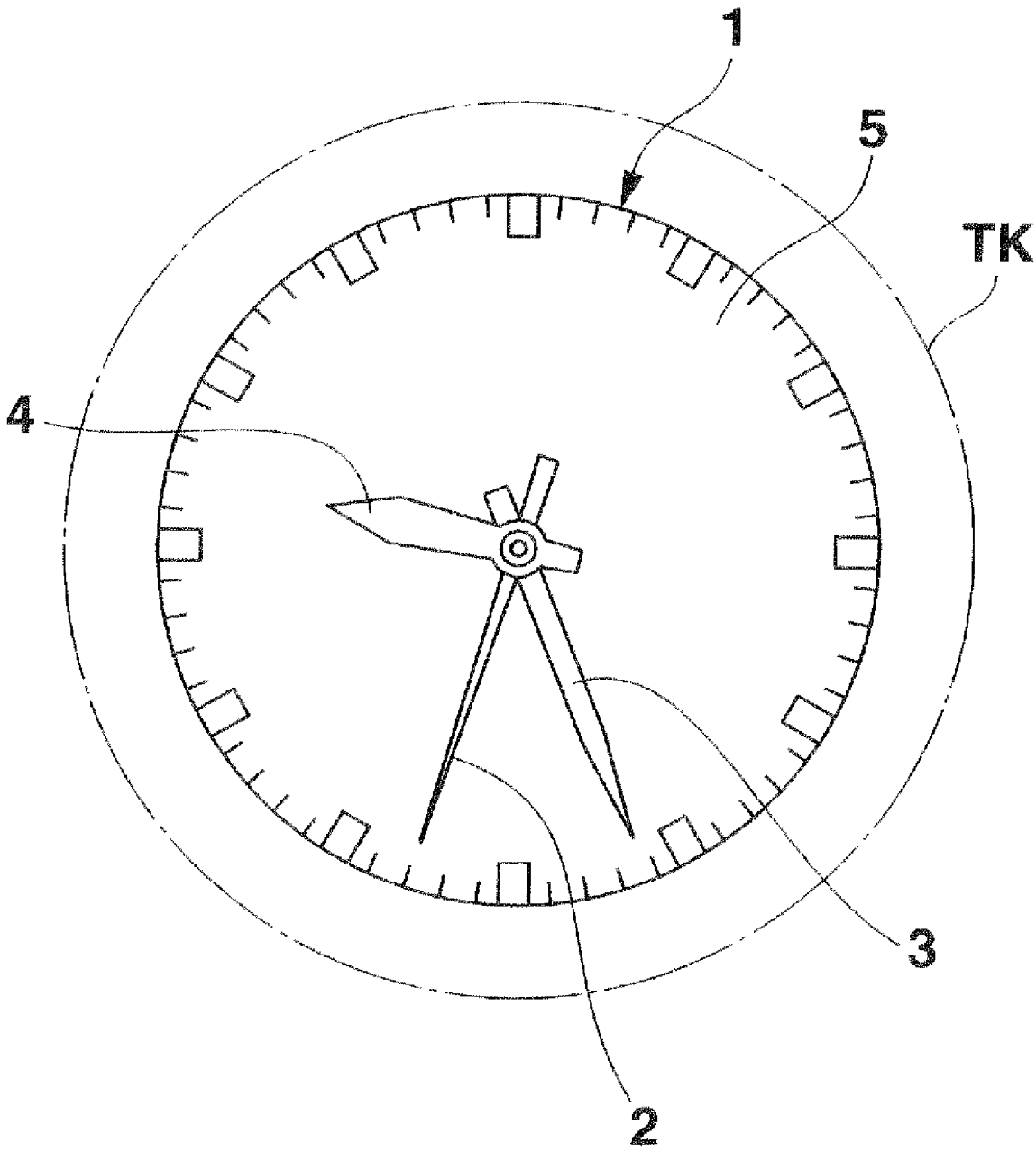
FIG. 1 is a plan view of a hand type wristwatch according to one embodiment of the present invention.
Figure 2:
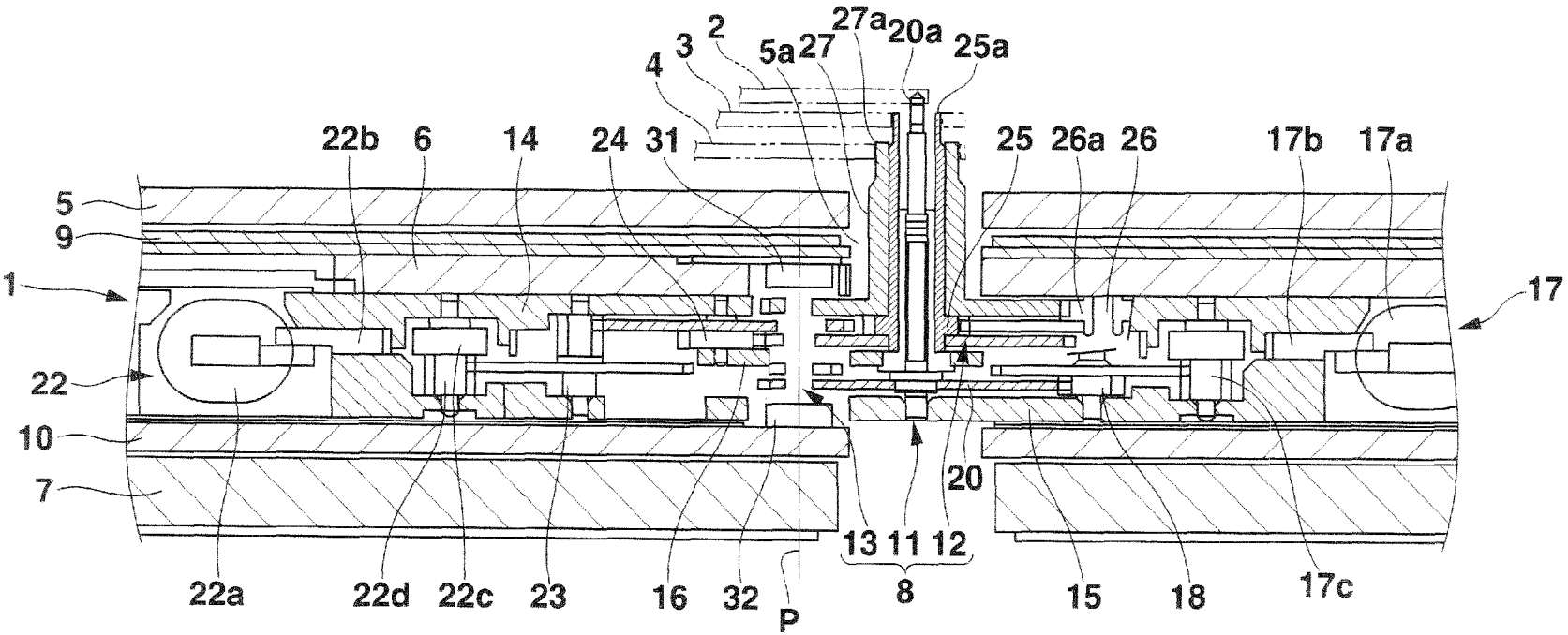
FIG. 2 is an enlarged cross-sectional view of an essential portion of the wristwatch of FIG. 1.

As shown in FIGS. 1 and 2, a hand type wristwatch 1 comprises a seconds hand 2, a center hand 3 and an hour hand 4 which rotate over a dial 5 to indicate time. A glass cover (not shown) covers a case TK of the wristwatch 1, and a back cover (not shown) covers the bottom of the case TK.

As shown in FIG. 2, a watch module within the case TK includes an upper housing 6 and a lower housing 7 between which a watch movement 8 is provided. The dial 5 is provided above the upper housing 6, and a solar panel 9 is provided between the dial 5 and the upper housing 6. A circuit board 10 is provided within the lower housing 7 (on an upper surface of the lower housing 7 in FIG. 2).

Figure 3:
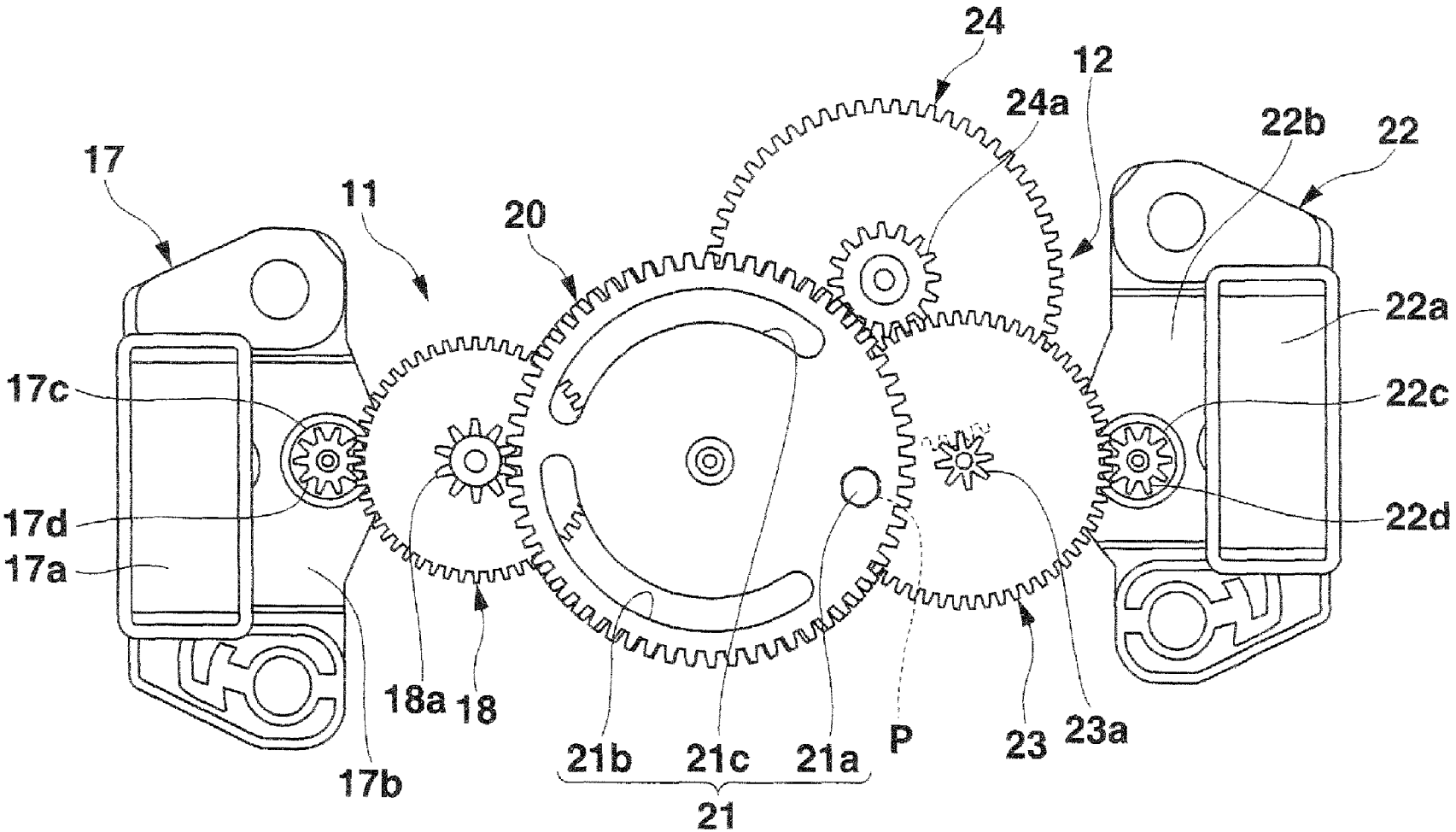
FIG. 3 is an enlarged plan view of an essential portion of a watch movement of FIG. 2.
Figure 4:
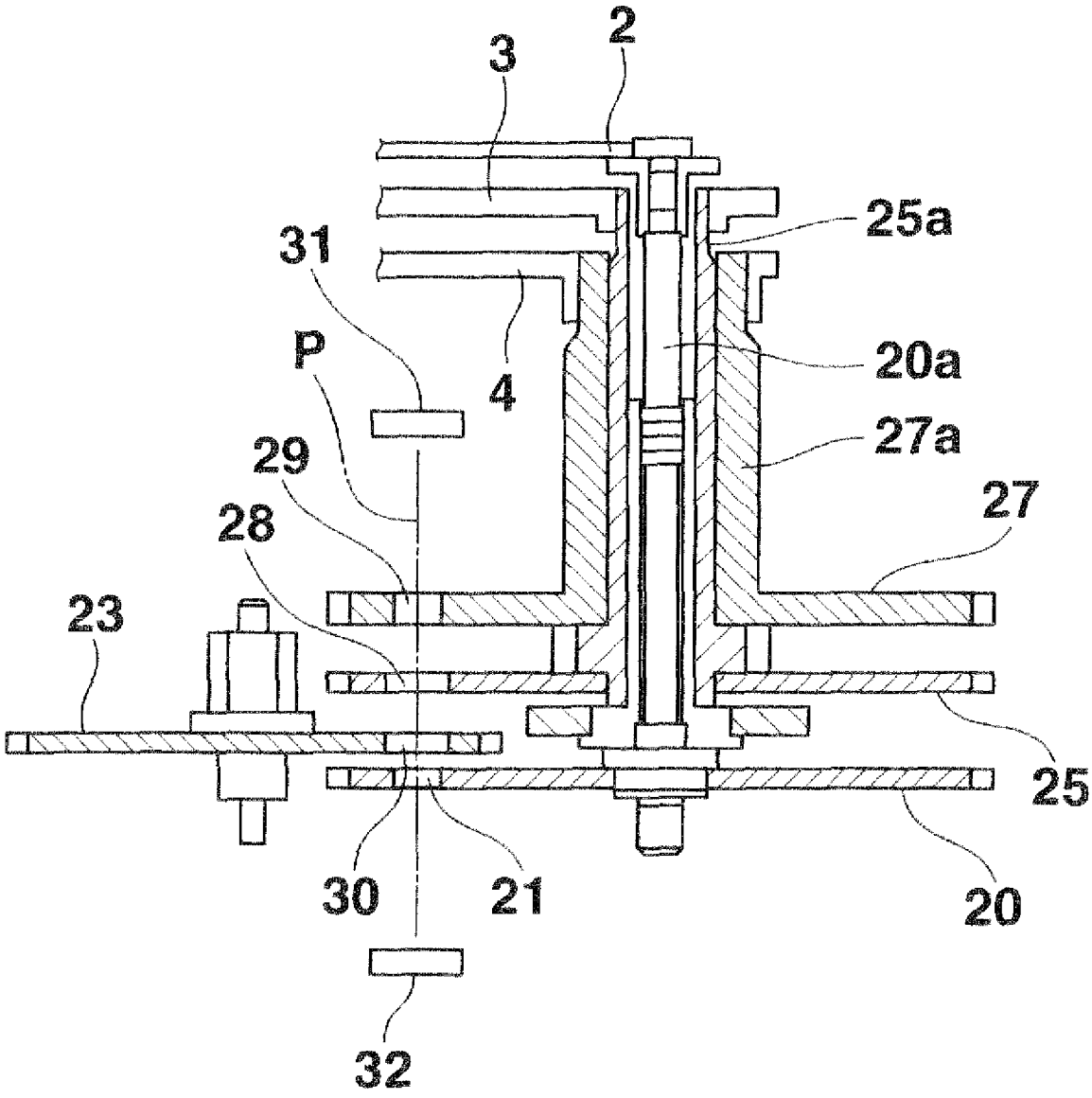
FIG. 4 is an enlarged cross-section view of an essential portion of FIG. 2.

As shown in FIGS. 2 to 4, the watch movement 8 comprises a first driving system 11 which drives the seconds hand 2, a second driving system 12 which drives the center and hour hands 3 and 4, and a detection unit 13 that detects rotational positions of the seconds, center and hour hands 2, 3 and 4. The first and second driving systems 11 and 12 are attached to a main plate 14, a train wheel bridge 15 and a center wheel bridge 16 between the upper and lower housings 6 and 7.

As shown in FIGS. 2 to 4, the first driving system 11 comprises a first stepping motor 17, a fifth wheel 18 rotated by the first stepping motor 17, a fourth wheel or seconds hand wheel (seconds wheel) 20 which is rotated by the fifth wheel 18. The seconds hand 2 is attached to a seconds hand shaft 20*a* of the seconds wheel 20 (see FIG. 4). The first stepping motor 17 comprises a coil block 17*a*, a stator 17*b* and a rotor 17*c*. When a required current flows through the coil block 17*a*, a magnetic field will be produced, thereby rotating the rotor 17*c* 180 degrees by one step.

Figure 5:
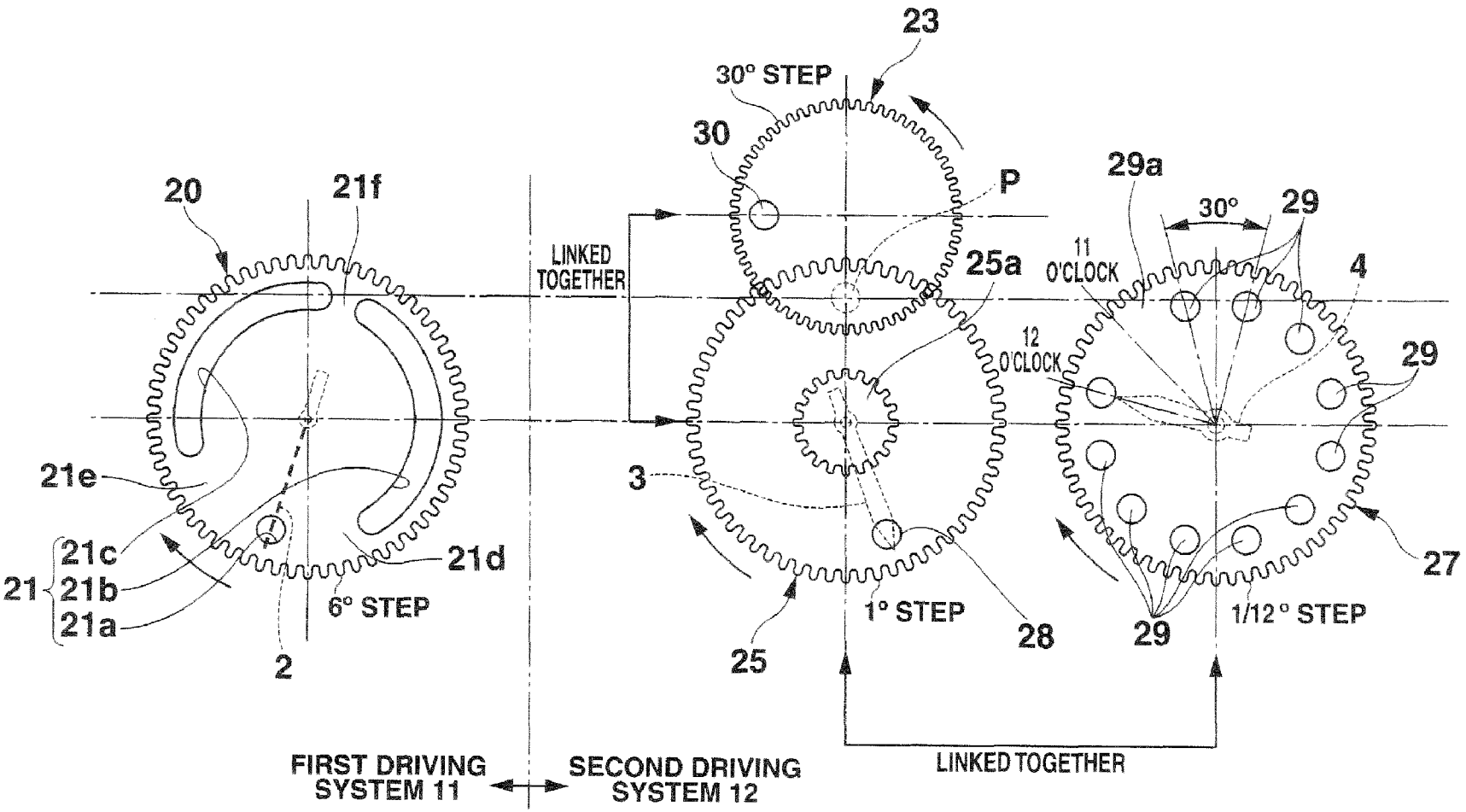
FIG. 5 is an enlarged exploded plan view of an assembly of a seconds wheel, a center wheel and an hour wheel of FIG. 3.
Figure 7:
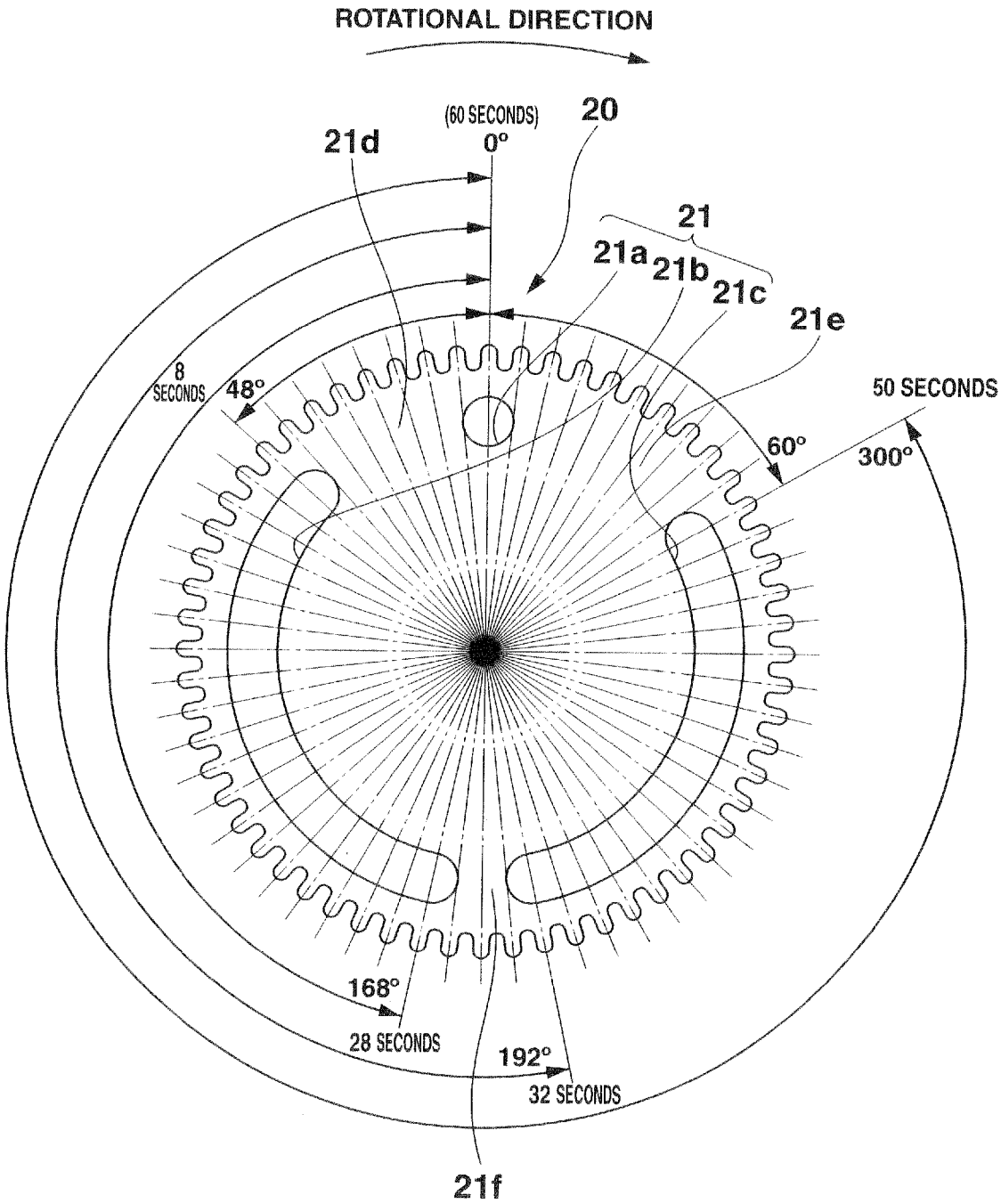
FIG. 7 is an enlarged plan view of the seconds wheel of FIG. 5.
Figure 8:
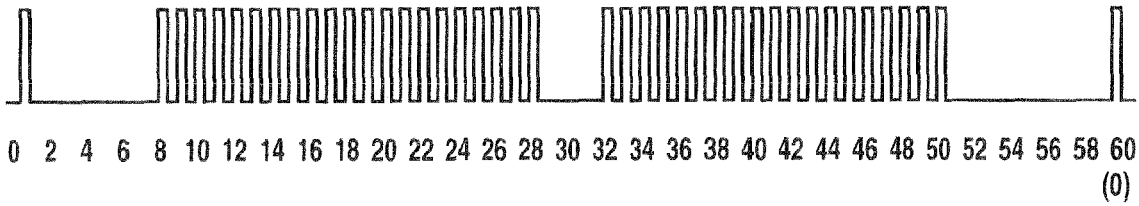
FIG. 8 is a detected pattern of the seconds wheel of FIG. 7 detected by a detection unit.

As shown in FIGS. 2 and 3, the fifth wheel 18 rotates meshing with a pinion 17*d* of the rotor 17*c* of the first stepping motor 17. The seconds wheel 20 rotates meshing with a pinion 18*a* of the fifth wheel 18. The seconds hand shaft 20*a* is attached to a center of the seconds wheel 20. As shown in FIG. 2, the seconds hand shaft 20*a* extends upward through aligned apertures 5*a* which are in the upper housing 6, solar panel 9 and dial 5. As shown in FIG. 4, the seconds hand 2 is attached to a top of the seconds hand shaft 20*a*. As shown in FIGS. 5 and 7, the seconds wheel 20 includes a first light-passing apertures 21 to be described later.

As shown in FIGS. 2 to 5, the second driving system 12 comprises a second stepping motor 22, an intermediate wheel 23 which is rotated by the second stepping motor 22, a third wheel 24 which is rotated by the intermediated wheel 23, a second wheel or center hand wheel (center wheel) 25 rotated by the third wheel 24, a minute wheel 26 which is rotated by the center wheel 25, and an hour hand wheel (hour wheel) 27 which is rotated by the minute wheel 26. The center hand 3 is attached to a center hand shaft 25*a* of the center wheel 25 and the hour hand 4 is attached to an hour hand shaft 27*a* of the hour wheel 27.

As shown in FIG. 2, the second stepping motor 22 comprises a coil block 22*a*, a stator 22*b* and a rotor 22*c*. When a required current flows through the coil block 22*a*, a magnetic field will be produced, thereby rotating the rotor 22*c* by 180 degrees by one step. As shown in FIGS. 2 and 3, the intermediate wheel 23 rotates meshing with a pinion 22*d* of the rotor 22*c* of the second stepping motor 22. As shown in FIG. 5, the intermediate wheel 23 includes a fourth light-passing aperture 30. The third wheel 24 rotates meshing with a pinion 23*a* of the intermediate wheel 23. The center wheel 25 rotates meshing with a pinion 24*a* of the third wheel 24.

As shown in FIGS. 2 and 4, the upwardly protruding center hand shaft 25*a* that is a cylindrical hollow through which the seconds hand shaft 20*a* protrudes rotatably is provided at a center of the center wheel 25. As shown in FIG. 2, the center hand shaft 25*a* extends upward through the apertures 5*a* provided in the upper housing 6, solar panel 9 and dial 5. As shown in FIG. 4, the center hand 3 is attached to a top of the center hand shaft 25*a*. Thus, the center wheel 25 is disposed above the seconds wheel 20 on the same axis as the seconds wheel 20. As shown in FIG. 5, the center wheel 25 includes a second light-passing aperture 28.

As shown in FIG. 2, the minute wheel 26 rotates meshing with a pinion (not shown) of the center wheel 25. The hour wheel 27 rotates meshing with a pinion 26*a* of the minute wheel 26. The upwardly protruding hour hand shaft 27*a* that is a cylindrical hollow through which the center hand shaft 25*a* protrudes rotatably is provided at a center of the hour wheel 27. As shown in FIG. 2, the hour hand shaft 27*a* protrudes upward through the apertures 5*a* provided in the upper housing 6, solar panel 9 and dial 5. As shown in FIG. 4, the hour hand 4 is attached to a top of the hour hand shaft 27*a*. Thus, the hour wheel 27 is disposed above the center wheel 25 on the same axis as the seconds wheel 20 and center wheel 25. As shown in FIG. 5, the hour wheel 27 includes third light-passing apertures 29.

FIG. 6 shows details of components of the first and second driving systems 11 and 12, the details comprising a number of teeth, a rotational angles, pulses per one rotation, a detection aperture, etc. The rotor pinion 17*d* of the rotor 17*c* in the first driving system 11 rotates 180 degrees or one step per pulse. The fifth wheel 18 rotates 36 degrees per pulse (per step of the rotor 17*c* rotation). The seconds wheel 20, i.e., the fourth wheel rotates six degrees per pulse (per step of the rotor 17*c* rotation) thereby rotating 360 degrees by 60 pulses (60 steps of the rotor 17*c* rotation).

The pinion 22*d* of the rotor 22*c* in the second driving system 12 rotates 180 degrees or one step per pulse. The intermediate wheel 23 rotates 30 degrees per pulse (per step of the rotor 22*c* rotation), thereby rotating 360 degrees by 12 pulses (12 steps of the rotor 22*c* rotation). The third wheel 24 rotates four degrees per pulse (per step of the rotor 22*c* rotation). The center wheel 25, i.e., the second wheel rotates one degree per pulse (per step of the rotor 22*c* rotation), thereby rotating 360 degrees by 360 pulses (360 steps of the rotor 22*c* rotation). The minute wheel 26 rotates ⅓ degrees per pulse (per step of the rotor 22*c* rotation). The hour wheel 27 rotates 1/12 degrees per pulse (per step of the rotor 22*c* rotation) and hence rotates 360 degrees by 4320 pulses (4320 steps of the rotor 22*c* rotation).

A hand position detecting device of the wristwatch 1 optically detects positions of the first to fourth light-passing apertures 21, 28, 29 and 30 provided in the seconds wheel 20, center wheel 25, hour wheel 27 and intermediate wheel 23 by a detection unit 13 to determine rotational positions of the seconds wheel 20, center wheel 25, hour wheel 27, and intermediate wheel 23. The detection unit 13, as shown in FIG. 2, includes a light emission element 31 and a photo detection element 32. The light emission element 31 includes a light emitting diode (LED) and is attached to the upper housing 6 at a position where the seconds hand 2, center hand 3 and hour hand 4 overlap together on the same axis and a part of the intermediate wheel 23 also overlaps thereon. The photo detection element 32 includes a phototransistor facing to the light emission element 31 and is provided on the upper surface of the circuit board 10 which is provided in the lower side of the wristwatch 1.

Therefore, when one of the first to fourth light-passing apertures 21, 28, 29 and 30 of the seconds wheel 20 center wheel 25, hour wheel 27 and intermediate wheel 23 overlap together, the photo detection element 32 detects light from the light emission element 31. Thus, the rotational positions of the seconds wheel 20, center wheel 25, and hour wheel 27 are detected. As shown in FIG. 7, the first light-passing apertures 21 include a circular aperture 21*a*, first and second arcuate apertures 21*b* and 21*c* and a third light blocking area 21*f*. The circular aperture 21*a* is provided at a reference point of the seconds wheel 20 (00-second position) between the first and second arcuate apertures 21*b* and 21*c*. The first arcuate aperture 21*b* is spaced from the circular aperture 21*a* by a first light blocking area 21*d* in the opposite direction to which the seconds hand 2 rotates. The second arcuate aperture 21*c* is spaced from the first circular aperture 21 by a second light blocking area 21*e* in the direction to which the seconds hand 2 rotates. The first and second light blocking areas 21*d* and 21*e* have different lengths. A third light blocking area 21*f* is formed between the first and second arcuate apertures 21*b* and 21*c* and opposed to the circular aperture 21*a* on the same diameter.

Figure 16:
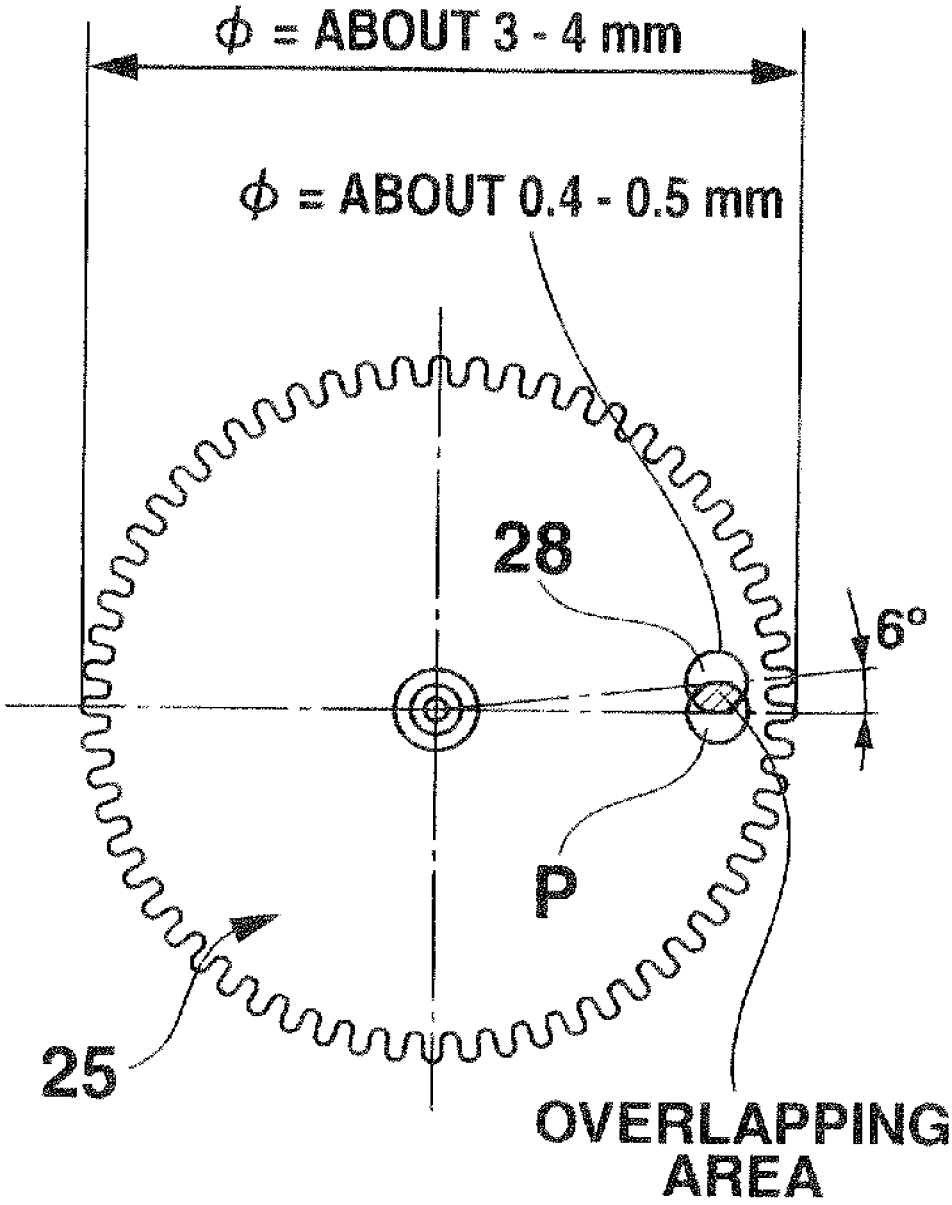
FIG. 16 is an enlarged plan view of a movement quantity of a second light-passing aperture provided in the center wheel relative to a detection position of the detection unit when the center wheel of FIG. 5 rotates by one step (one degree) at a time.

As shown in FIGS. 7 and 16, the seconds wheel 20 has a diameter of approximately 3 to 4 mm, and the circular aperture 21*a* has a diameter of approximately 0.4 to 0.5 mm (about a length of an arc of the seconds wheel 20 with a central angle having 12 degrees). As shown in FIG. 7, the first arcuate aperture 21*b* is formed in an arcuate shape approximately between 48-degree position (8-second position) and 168-degree position (28-second position) from the center of the circular aperture 21*a* (0-degree position) in a counterclockwise direction, to render the same movement locus as the circular aperture 21*a* if rotated. The second arcuate aperture 21*c* is formed in an arcuate shape approximately between 192-degree position (32-second position) and 300-degree position (50-second position) from the center of the circular aperture 21*a* in the counterclockwise direction, to render the same movement locus as the circular aperture 21*a* if rotated.

As shown in FIG. 7, the first light blocking area 21*d* is formed between 0-degree position and 48-degree position from the center of the circular aperture 21*a* in the counterclockwise direction (0-degree position or reference position). Substantially, the first light blocking area 21*d* has a width corresponding to 36 degrees that is three times longer than the diameter of the circular aperture 21*a* (corresponding to 12 degrees).

The second light blocking area 21*e* is formed between 0-degree position and 60-degree position (50-second position) from the center of the circular aperture 21*a* (0-degree position) in the clockwise direction. Substantially, the second light blocking area 21*e* has a width corresponding to 48 degrees that is four times longer than the diameter of the circular aperture 21*a* (corresponding to 12 degrees), namely, longer than the first light blocking area 21*d* by the diameter of the circular aperture 21*a*. The third light blocking area 21*f* is formed in the almost same size as the circular aperture 21*a* between the first and second arcuate apertures 21*b* and 21*c* and opposed to the circular aperture 21*a* on the same diameter.

The first light blocking area 21*d* is diametrically opposed to a part of the second arcuate aperture 21*c*. The second light blocking area 21*e* is diametrically opposed to a part of the first arcuate aperture 21*b*. The third blocking area 21*f* is diametrically opposed to the circular aperture 21*a*. Thus, whenever the seconds wheel 20 rotates 180 degrees (half rotation) from the state in which any one of the first to third light blocking areas 21*d* to 21*f* blocks a detection position P of the detection unit 13 where the light emission element 31 faces the photo detection element 32, any of the circular and the first and second arcuate apertures 21*a*, 21*b* and 21*c* comes to the detection position P.

The seconds wheel 20 rotates by six degrees (one step) at a time (one second). When the detection unit 13 makes light detection at intervals of two seconds until the seconds wheel 20 rotates 60 steps (360 degrees) in 60 seconds, the pattern shown in FIG. 8 will be detected. More particularly, when the seconds wheel 20 is at the position of zero seconds (0 degree), the detection unit 13 detects the circular aperture 21*a*. From two seconds (12 degrees) to six seconds (36 degrees), the first light blocking area 21*d* blocks the detection position P that is a light path in the detection unit 13, and hence the detection unit 13 fails in light detection successively three times.

When the rotation of the seconds wheel 20 is between eight seconds (48 degrees) and 28 seconds (168 degrees), the detection unit 13 continuously detects light through the first arcuate aperture 21*b*. When the seconds wheel 20 rotates 30 seconds (180 degrees), the third light blocking area 21*f* blocks the detection position P, and the detection unit 13 cannot detect light. From 32 seconds (192 degrees) to 50 seconds (300 degrees), the detection unit 13 continuously detects light through the second arcuate aperture 21*c*. From 52 seconds (312 degrees) to 58 seconds (348 degrees), the second light blocking area 21*e* blocks the detection position P, and the detection unit 13 fails in light detection successively four times.

Figure 9:
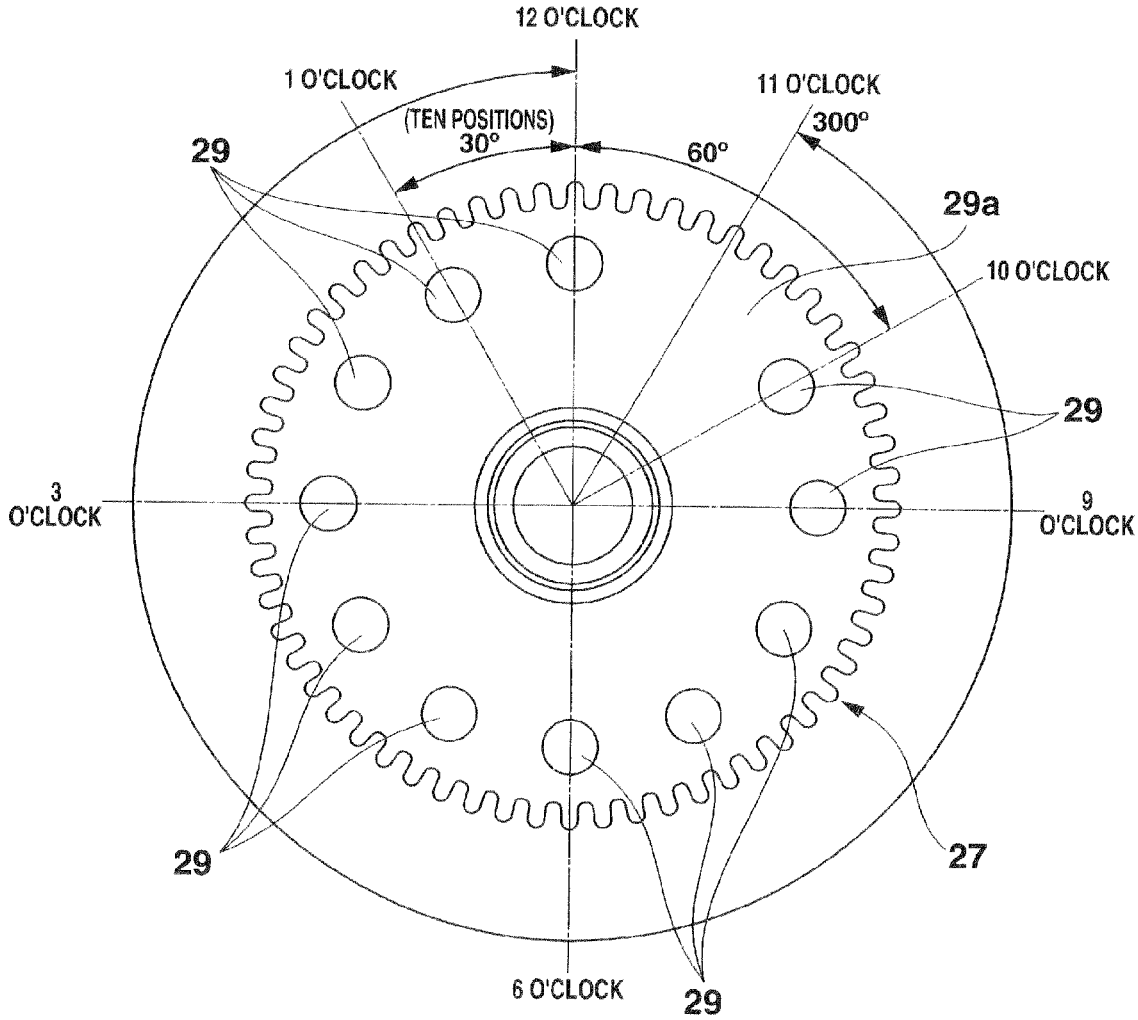
FIG. 9 is an enlarged plan view of the hour wheel of FIG. 5.

As shown by a solid line in FIG. 5, the second light-passing aperture 28 in the center wheel 25 is a circular aperture provided at a reference point (0-degree position) of the center wheel 25. The second light-passing aperture 28 has substantially the same size as the circular aperture 21*a* in the seconds wheel 20 and is provided at a position corresponding to the circular aperture 21*a*. As shown in FIGS. 5 and 9, the third light-passing apertures 29 in the hour wheel 27 includes eleven circular apertures arranged at intervals of 30 degrees from a reference point (0-degree position) of the hour wheel 27 along the periphery. A fourth light blocking area 29*a* is provided at a position of eleven o'clock between the aperture at the reference point and the eleventh aperture (the Fourth light blocking area 29*a* is shown at a position of one o'clock in FIG. 9).

As shown in FIG. 9, the third light-passing apertures 29 in the hour wheel 27 are positioned, from the reference point (0-degree position) to the left, at angles of 0 degrees, 30 degrees, 60 degrees, 90 degrees, 120 degrees, 150 degrees, 180 degrees, 210 degrees, 240 degrees, 270 degrees and 300 degrees. That is, the apertures 29 are located at positions of twelve o'clock, one o'clock, two o'clock, three o'clock, four o'clock, five o'clock, six o'clock, seven o'clock, eight o'clock, nine o'clock and ten o'clock in the direction to which the hour hand 4 rotates (in the counterclockwise direction in FIG. 9). The fourth light blocking area 29*a* is provided at the position of eleven o'clock (one o'clock position in FIG. 9). Each of the third light-passing apertures 29 in the hour wheel 27 has substantially the same size as the circular aperture 21*a* in the seconds wheel 20.

As shown in FIG. 5, the fourth light-passing aperture 30 in the intermediate wheel 23 is a circular aperture which can be aligned with the second light-passing aperture 28 in the center wheel 25. The fourth light-passing aperture 30 has substantially the same size as the circular aperture 21*a* of the seconds wheel 20 and the second light-passing aperture 28 of the center wheel 25. The fourth light-passing aperture 30 is provided at a position in the intermediate wheel 23 where the fourth light-passing aperture 30 is aligned with the second light-passing aperture 28 when the aperture 28 comes to the detection position P.

In the second driving system 12, the intermediate wheel 23, center wheel 25 and hour wheel 27 respectively rotate 30 degrees, one degree, and 1/12 degrees per step (half rotation of the rotor 22*c*). Thus, as shown in FIG. 5, one of the third light-passing apertures 29 is aligned with the second light-passing aperture 28 and the fourth light-passing aperture 30 at the detection position P every hour on the hour except eleven o'clock, i.e., at the positions of twelve o'clock, one o'clock, two o'clock, three o'clock, four o'clock, five o'clock, six o'clock, seven o'clock, eight o'clock, nine o'clock and ten o'clock.

The seconds wheel 20 of the first driving system 11 rotates six degrees per step (half rotation of the rotor 17*c*). Every time the seconds wheel 20 rotates 60 steps (60 seconds), the circular aperture 21*a* of the first light-passing aperture 21 comes to the detection position P. Therefore, as shown in FIG. 5, the circular aperture 21*a* is aligned with the second light-passing aperture 28, fourth light-passing aperture 30 and one of the third light-passing apertures 29 every hour on the hour except 11-o'clock.

Hereinafter, description will be made on preconditions for detecting the rotational positions of the seconds, center and hour hands 2, 3 and 4 by the detection unit 13. When the circular aperture 21*a*, the second light-passing aperture 28 and one of the third light-passing apertures 29 are aligned together at twelve o'clock position (in the uppermost position of the wheels 20, 25 and 27 in FIG. 5) and the fourth light-passing aperture 30 is also aligned with the apertures at six o'clock position (in the lowermost position of the wheel 23 in FIG. 5), a light beam from the light emission element 31 is received by the photo detection element 32 through the apertures.

When the light-passing apertures 21*a* and 28 to 30 are aligned together at the detection position P, the photo detection element 32 receives light from the light emission element 31. When any of the light-passing apertures 21*a* and 28 to 30 is offset or away from the detection position P, the light from the light emission element 31 is blocked. Therefore, the photo detection element 32 cannot detect the light.

Figure 17A:
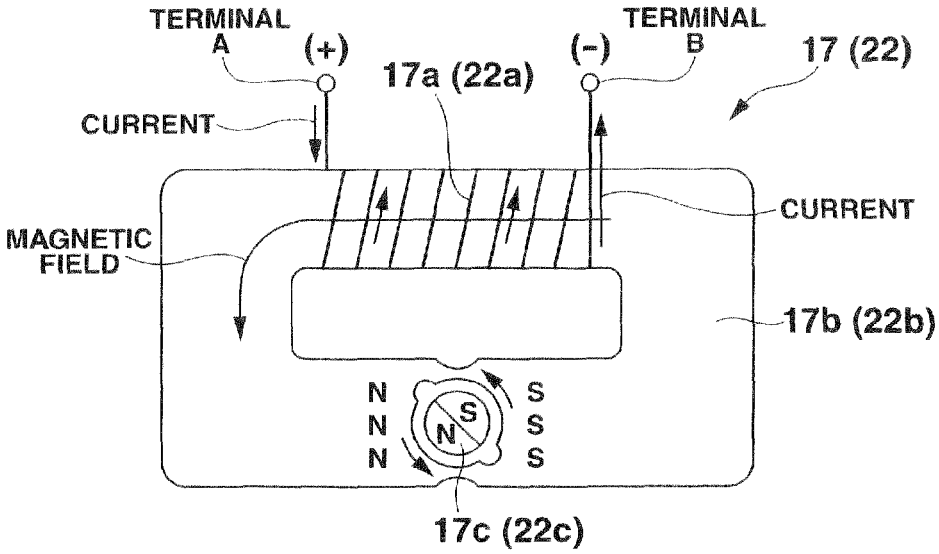

As shown in FIGS. 3 and 17A, when the rotors 17*c* and 22*c* of the first and second stepping motors 17 and 22 are rotated 180 degrees, the hands are rotated one step. A direction of a drive current supplied to terminals A and B of each of the stepping motors 17 and 22 is alternately changed per pulse, and a direction of a magnetic field generated in each of the stators 17*b* and 22*b* is also alternately changed. Therefore, polarity of each of the stators 17*b* and 22*b* is alternately changed per pulse (see FIGS. 17A and 17B) to rotate each of the rotors 17*c* and 22*c* 180 degrees.

That is, current passing through each of the coils 17*a* and 22*a* in alternating directions also alternates the direction of the magnetic field (or polarity) generated in each of the stators 17*b* and 22*b*. Thus, the rotors 17*c* and 22*c* which are magnetized in constant states are rotated 180 degrees. The rotors 17*c* and 22*c* are previously magnetized in the constant states and polarized into N and S poles.

The coils 17*a* and 22*a* are wound up in a constant direction, and drive pulses are supplied to the winding start terminals A and winding end terminals B of the coils 17*a* and 22*a*. When a drive pulse is applied to terminals A or B, a direction of a magnetic field generated in each of the stators 17*b* and 22*b* is determined corresponding to a direction of the drive pulse.

As shown in FIG. 17A, when a drive current passes through the coil 17*a* or 22*a* from the terminal A to the terminal B, a counterclockwise magnetic field is generated in the stator 17*b* or 22*b* so that the stator 17*b* or 22*b* has an N-S polarity, namely, a part of the stator 17*b* or 22*b* which is on the left of the rotor 17*c* or 22*c* is N-polarized and a right part of the stator 17*b* or 22*b* is S-polarized.

Figure 17B:
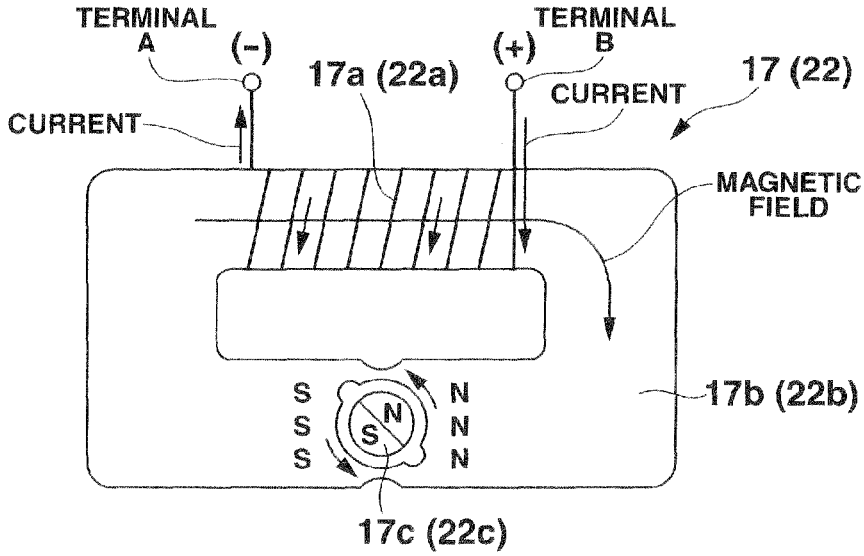

On the other hand, as shown in FIG. 17B, when a drive current passes through the coil 17*a* or 22*a* from the terminal B to the terminal A, a clockwise magnetic field is generated in the stator 17*b* or 22*b* so that the stator 17*b* or 22*b* has an S-N polarity, namely, the left part of the stator 17*b* or 22*b* is S-polarized and the right part of the stator 17*b* or 22*b* is N-polarized.

Therefore, as shown in FIGS. 17A and 17B, when the direction of the current passing through the coil 17*a* or 22*a* is alternately changed, the polarity of the magnetic field generated in the stator 17*b* or 22*b* alternates between the N-S polarity and the S-N polarity. Each of the rotors 17*c* and 22*c* can rotate keeping a predetermined positional relation with respect to each of the stators 17*b* or 22*b*. Therefore, the rotor 17*c* and the stator 17*b* repel each other, thereby rotating the rotor 17*c* by 180 degrees. Also, the rotor 22*c* and the stator 22*b* repel each other, thereby rotating the rotor 22*c* by 180 degrees.

In the first stepping motor 17 of the first driving system 11, a polarity of a magnetic field to be generated in the stator 17*b* in accordance with a direction of a drive current supplied to the coil 17*a* may be determined when attaching the seconds hand 2 to the seconds hand shaft 20*a*. For example, the polarity may be determined to be the N-S polarity, as shown in FIGS. 3 and 17A. A pulse firstly supplied generates a magnetic field having opposite polarity (S-N polarity) to the determined polarity (N-S polarity), and a pulse secondly supplied generates a magnetic field having the same polarity (N-S polarity) as the determined polarity (N-S polarity). Thus, the rotor 17*c* rotates 180 degrees to rotate the seconds hand 2.

For example, in the case where the seconds hand 2 is shifted by one step due to an external factor such as a shock or a magnetic field, even when a pulse to rotate the seconds hand 2 is output, the seconds hand 2 does not rotate at that time point, and then, the subsequent pulse rotates the seconds hand 2. The first stepping motor 17 of the first driving system 11 requires execution of position detection for the seconds wheel 20 at every two steps. Unless the seconds wheel 20 rotates two steps, the circular aperture 21*a* is not completely away from the detection position P due to a relationship between the size of the circular aperture 21*a* and a moving quantity per step of the seconds wheel 20. Thus, execution of the position detection at every two steps (every two seconds) is effective. With the second driving system 12, it is effective that the detection is executed at every step.

Then, referring to FIGS. 10A to 10M, description will be made on a basic operation to detect the reference position (00-second position) of the seconds wheel 20.

Hereinafter, description on the center, hour and intermediate wheels 25, 27 and 23 of the second driving system 12 will be omitted for the sake of simplicity. FIGS. 10A to 10M show a relationship between the detection position P of the detection unit 13 and a rotational position of the seconds wheel 20 when the seconds wheel 20 rotates by two steps (rotational angle of 12 degrees) at a time.

Figure 10A:
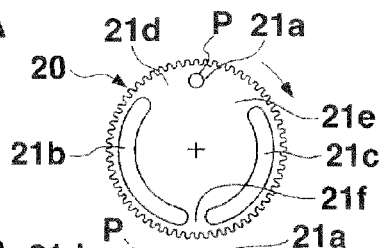
FIGS. 10A, 10B, 10C, 10D, 10E, 10F, 10G, 10H, 10I, 10J, 10K, 10L and 10M show a basic position detecting operation of the seconds wheel of FIG. 7, respectively illustrate states of the seconds wheel which rotates sequentially two steps (12 degrees) at a time.

The reference position of the seconds wheel 20 can be obtained by detecting the reference position (00-second position) of the seconds wheel 20 shown in FIG. 10A, where the circular aperture 21*a* in the seconds wheel 20 comes to the detection position P. At the reference position shown in FIG. 10A, the detection unit 13 can detect light passing through the circular aperture 21*a* located at the detection position P.

Figure 10B:
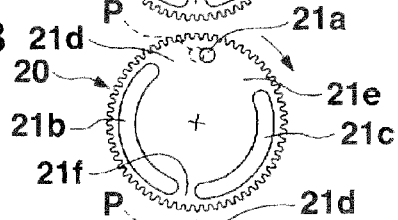
Figure 10C:
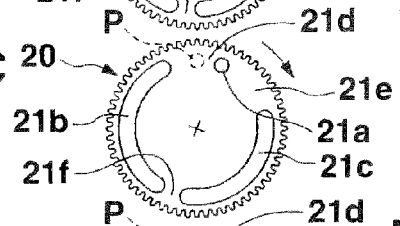
Figure 10D:
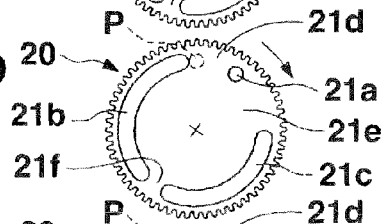

The seconds wheel 20 rotates by two steps in the clockwise direction from the state of FIG. 10A. When the rotational angle of the seconds wheel 20 becomes 12 degrees, the circular aperture 21*a* is shifted away from the detection position P in the clockwise direction and the first light blocking area 21*d* covers the detection position P, as shown in FIG. 10B. Thus, the detection unit 13 fails in detecting light, as shown at a point of two seconds in FIG. 8. Likewise, as shown in FIGS. 10C to 10D, until the seconds wheel 20 rotates 36 degrees, the first light blocking area 21*d* continues blocking the detection position P. Thus, the detection unit 13 fails in detecting light successively three times, as shown at points of 3 to 6 seconds in FIG. 8.

Figure 10E:
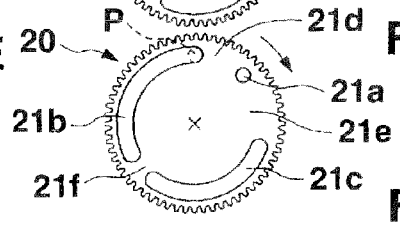
Figure 10F:
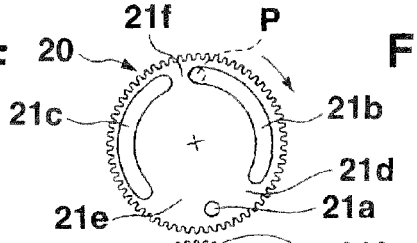

Then, as shown in FIG. 10E, when the seconds wheel 20 further rotates two steps and the rotational angle thereof comes to 48 degrees, a part of the first arcuate aperture 21*b* crosses the detection position P. Thus, as shown at a point of eight seconds in FIG. 8, the detection unit 13 can detect light passing through the second arcuate aperture 12*b*. Until the seconds wheel 20 rotates 168 degrees as shown in FIG. 10F, a part of the first arcuate aperture 21*b* covers the detection position P. Thus, the detection unit 13 continuously detects light passing through the first arcuate aperture 21*b* as shown at points of 10 to 28 seconds in FIG. 8.

Figure 10G:
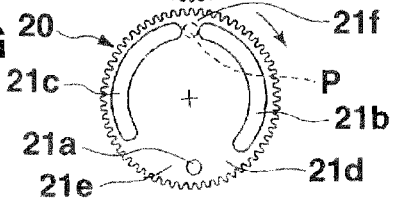
Figure 10H:
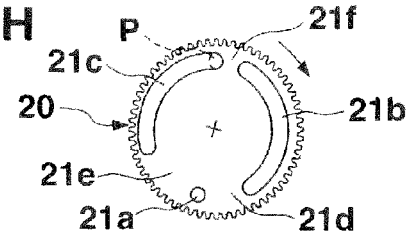

When the seconds wheel 20 rotates further two steps and the rotational angle thereof comes to 180 degree as shown FIG. 10G, the first arcuate aperture 21*b* is moved clockwise away from the detection position P and the third light blocking area 21*f* covers the detection position P. Thus, the detection unit 13 fails in detecting light as shown at a point of 30 seconds in FIG. 8. Then, when the seconds wheel 20 rotates further two steps and the rotational angle thereof comes to 192 degrees as shown in FIG. 10H, a part of the second arcuate aperture 21*c* crosses the detection position P. Thus, as shown at a point of 32 seconds in FIG. 8, the detection unit 13 can detect light passing through the second arcuate aperture 21*c*.

Figure 10I:
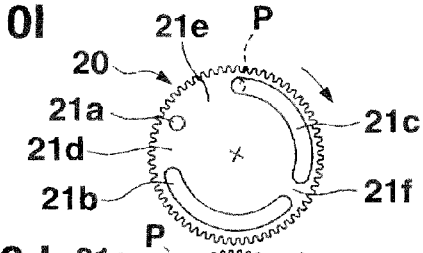
Figure 10J:
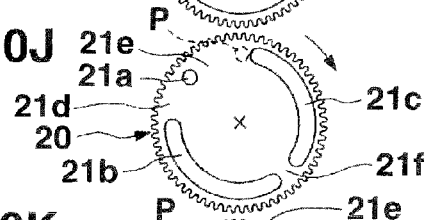

Until the rotational angle of the seconds wheel 20 becomes 300 degrees as shown in FIG. 10I, a part of the second arcuate aperture 21*c* covers the detection position P. Thus, as shown at points of 34 to 50 seconds in FIG. 8, the detection unit 13 continuously detects light passing through the second arcuate aperture 21*c*. When the second arcuate aperture 21*c* is moved clockwise from the detection position P and a part of the second light blocking area 21*e* blocks the detection position P as shown in FIG. 10J, the detection unit 13 cannot detect light, as shown at a point of 52 seconds in FIG. 8.

Figure 10K:
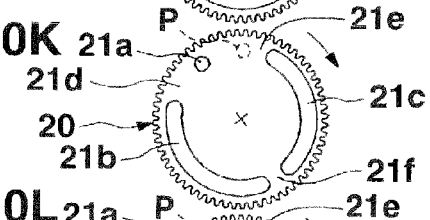
Figure 10L:
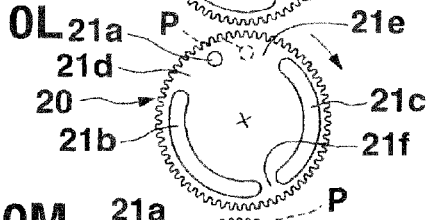
Figure 10M:
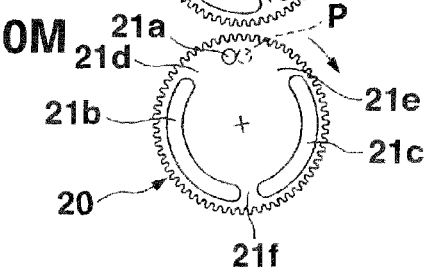

Until the rotational angle of the seconds wheel 20 becomes 348 degrees, a part of the second light blocking area 21*e* covers the detection position P as shown in FIGS. 10K to 10M and the detection unit 13 fails in detecting light. Thus, as shown at points of 5458 seconds in FIG. 8, the detection unit 13 fails in light detection successively four times. When the seconds wheel 20 rotates further two steps from this state and the rotational angle of the seconds wheel comes to 360 degrees, the circular aperture 21*a* is aligned with the detection position P, as shown in FIG. 10A. Thus, as shown at a point of 0 seconds in FIG. 8, the detection unit 13 can detect light passing through the circular aperture 21*a*.

As described above, in the state of FIG. 10A, the detection unit 13 succeeds in light detection. In the states of FIGS. 10B-10D, the detection unit 13 can not detect light successively three times. In the states of FIGS. 10E to 10F, the detection unit 13 can detect light successively. In the state of FIG. 10G, the detection unit 13 fails in light detection. In the states of FIGS. 10H to 10I, the detection unit 13 can detect light successively. In the states of FIGS. 10J to 10M, the detection unit 13 cannot detect light successively four times.

The detection unit 13 fails in light detection in the states of FIGS. 10B to 10D and FIGS. 10J to 10M. When the detection unit 13 performs light detection at intervals of two steps of the seconds wheel rotation, failure of light detection occurs successively three times in the states of FIGS. 10B to 10D, whereas failure of light detection occur successively four times in the states of FIGS. 10J to 10M. It will be seen that the former and latter cases are different in the number of successive light detection failures. By counting the number of times of successive light detection failure, the reference position of the seconds wheel 20 can be specified as follows.

That is, the detection unit 13 makes the position detection each time the seconds wheel 20 rotates two steps (two seconds). A position, where the detection unit 13 succeeds in light detection after four times of successive detection failure, is determined to be the reference position (00-second position). If detection failure starting from the state of FIG. 10B is observed, three times of detection failure is detected until the state of FIG. 10D, and then the detection unit 13 succeeds in light detection in the state of FIG. 10E. Accordingly, the condition to determine the reference position, i.e., continuous four times of detection failure, is not met, and it will be understood that the current position is not the reference position. This process is the basic operation to detect the reference position of the seconds wheel 20.

Next, referring to FIGS. 11A to 11P, description will be given on a basic operation to detect the reference position of center and hour wheels 25 and 27.

Hereinafter, description of the seconds wheel 20 in the first driving system 11 will be omitted for the sake of simplicity. FIGS. 11A to 11M illustrate one rotation of the intermediate wheel 23 caused by rotation of the center wheel 25, which rotates one step (one degree) at a time. FIGS. 11M to 11N illustrate rotation of 30-degree of the hour wheel 27 caused by 360 steps (360 degrees) of rotation of the center wheel 25. FIGS. 11N to 11O show rotation of the hour wheel 27 for nine hours (ten hours in total). FIGS. 11O to 11P show further one hour of rotation of the hour wheel 27 (eleven hours in total).

Figure 11A:
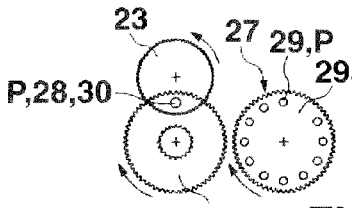

The reference position (0-o'clock 00-minute position) of the center and hour wheels 25 and 27 can be obtained by detecting the reference position P shown in FIG. 11A. That is, a position where the second light-passing aperture 28 in the center wheel 25, one of the light-passing apertures 29 which is at the reference point (0-degree position) (hereinafter, referred to as "reference aperture") in the minute wheel 27, and the fourth light-passing aperture 30 in the intermediate wheel 23 are aligned together at the detection position P is detected as the reference position. FIG. 11A shows the reference position of the wheels.

Figure 11B:
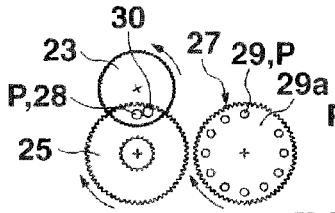
Figure 11C:
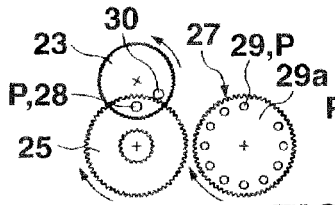
Figure 11D:
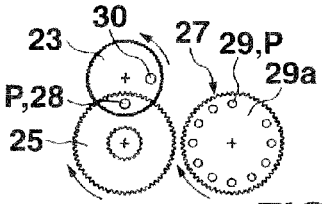
Figure 11E:
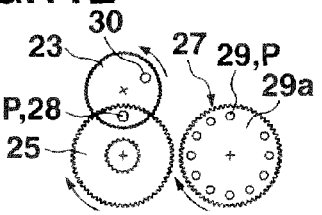
Figure 11F:
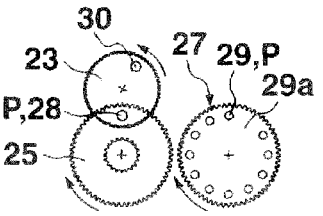

When the center wheel 25 rotates one step (one degree) from the state shown in FIG. 11A, the intermediate wheel 23 rotates 30 degrees and the fourth light-passing aperture 30 of the intermediate wheel 23 is moved away from the detection position P, and the intermediate wheel 23 covers the detection position P of the detection unit 13, as shown in FIG. 11B. The center wheel 25 rotates only one degree in the clockwise direction; therefore, the second light-passing aperture 28 is moved slightly, but not completely away from the detection position P of the detection unit 13. The second light-passing aperture 28 remains in a detectable range of the detection unit 13.

Figure 11G:
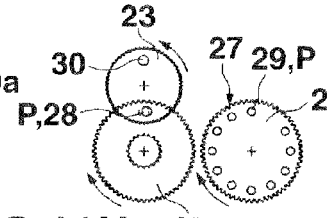
Figure 11H:
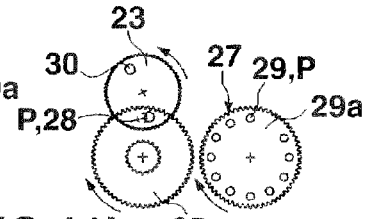
Figure 11I:
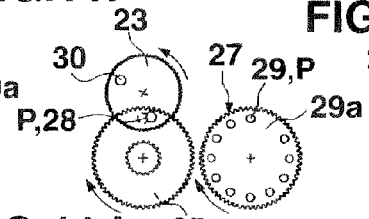
Figure 11J:
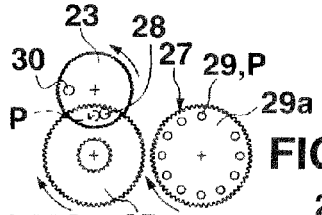
Figure 11K:
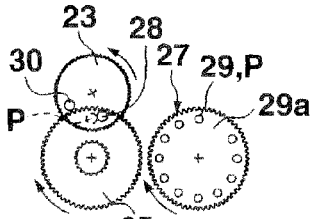
Figure 11L:
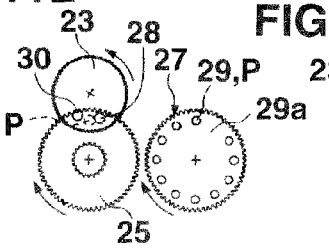
Figure 11M:
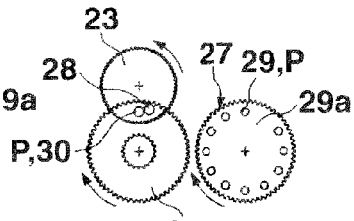
Figure 11N:
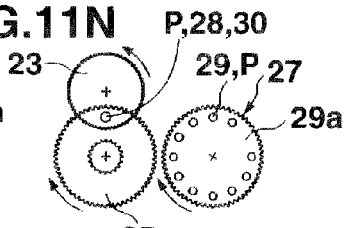
Figure 11O:
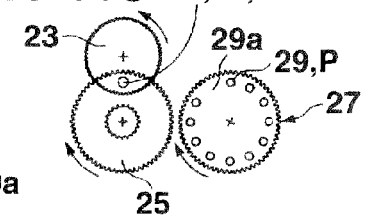

Then, when the center wheel 25 rotates six steps (six degrees) in total, the rotation angle of the intermediate wheel 23 becomes 180 degrees and the fourth light-passing aperture 30 is moved 180 degrees away from the detection position P as shown in FIG. 11G. The intermediate wheel 23 continues covering the detection position P. The center wheel 25 rotates six degrees in the clockwise direction to move the second light-passing aperture 28 from the detection position P by the half of the size of the second light-passing aperture 28. However, the second light-passing aperture 28 remains in the detectable range (see FIG. 16).

Then, when the center wheel 25 rotates 12 steps (12 degrees) in total, the rotation angle of the intermediate wheel 23 becomes 360 degrees and the fourth light-passing aperture 30 comes to the detection position P, as shown in FIG. 11M. The second light-passing aperture 28 in the center wheel 25 is almost completely away from the detection position P. The second light-passing aperture 28 hardly overlaps with the detection position P and the center wheel 25 covers the detection position P; therefore, the detection unit 13 fails in detecting light. The hour wheel 27 rotates only one decree, and the reference circular aperture which one of the third light-passing apertures 29 is only slightly moved from the detection position P and remains in the detectable range of the detection unit 13.

When the center wheel 25 is rotates 360 steps (one rotation) in total, the second and fourth light-passing apertures 28 and 30 in the center and intermediate wheel 25 and 23 are aligned together at the detection position P, as shown in FIG. 11N. The rotational angle of the hour wheel 27 becomes 30 degrees, and the reference aperture is moved away from the detection position P. Therefore, a second circular aperture on the left of the reference circular aperture comes to the detection position P, and the detection unit 13 can detect light passing through the apertures. When the center wheel 25 rotates further 9 hours from the state of FIG. 11N (10 hours in total), the second and fourth light-passing apertures 28 and 30 are aligned together at the detection position P as shown in FIG. 11O, and the rotational angle of the hour wheel 27 becomes 300 degrees. Thus, an eleventh circular aperture from the reference circular aperture comes to the detection position P and the detection unit 13 can detect light passing through the apertures.

Figure 11P:
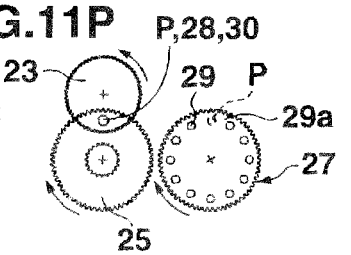

Then, when the center wheel 25 rotates further one hour (11 hours in total), the second and forth light-passing apertures 28 and 30 are aligned together at the detection position P, as shown in FIG. 11P. The hour wheel 27 rotates until 330 degrees and the eleventh circular aperture from the reference circular aperture is moved away from the detection position P. Accordingly, the forth light blocking area 29*a* in the hour wheel 27 covers the detection position P. Thus, the detection unit 13 fails in detecting light. This position of detection failure can be determined as a "11-o'clock 00-minute" position.

When the center wheel 25 rotates further one hour (12 hours in total), the second and fourth apertures 28 and 30 are aligned at the detection position P, as shown in FIG. 11A. The rotation angle of the hour wheel 27 becomes 360 degrees and the fourth light blocking area 29*a* of the hour wheel 27 is moved away from the detection position P. Therefore, a reference circular aperture at the reference position (0-o'clock position), i.e., the third light-passing aperture 29 comes to the detection position P. The center and hour wheels 25 and 27 are returned to the reference position (0-o'clock 00-minute position).

As described above, since the rotational angle of the center wheel 25 per step is quite small, i.e., one degree, one step of the rotation of the center wheel 25 is not enough to move the second light-passing aperture 28 completely away from the detection position P. Therefore, the reference position of the center wheel 25 may not be detected accurately. However, the intermediate wheel 23 rotates 30 degrees per step and this rotational angle per step is large enough to cover the detection position P even if the rotational angle of the center wheel 25 per step is small.

As shown in FIG. 11M, when the intermediate wheel 23 rotates 360 degrees (one rotation) in 12 steps, the center wheel 25 rotates 12 degrees. Thus, the second light-passing aperture 28 in the center wheel 25 is moved completely away from the detection position P and the center wheel 25 covers the detection position P. Even when the fourth light-passing aperture 30 in the intermediate wheel 23 comes to the detection position P, the detection unit 13 fails in detecting light.

Each time the center wheel rotates 360 degrees (one rotation) in 360 steps, the second and fourth light-passing apertures 28 and 30 and any of the third light-passing apertures 29 (aside from the fourth light blocking area 29*a* at 11-o'clock position) come to the detection point P, and the detection unit 13 can detect light passing through the apertures. That is, the detection unit 13 can detect light at a "00-minute position" or the reference position (0-degree position), to which the center wheel 25 returns every time the center wheel 25 rotates 360 degrees (360 steps) regardless of the rotational position of the hour wheel 27 (except 11-o'clock position).

After the reference position (0-degree position) of the center wheel 25 is detected, the center wheel 25 rotates 360 steps (one rotation) at a time, and the hour wheel 27 rotates 30 degrees at a time. Thus, light detection by the detection unit 13 is not required to be executed at each step of the rotation of the center wheel 25. The detection unit 13 may perform light detection only when the center wheel 25 rotates 360 degrees to detect the rotational position of the hour wheel 27. In the case where the center wheel 25 rotates 360 steps at a time from the state of FIG. 11N, when the detection unit 13 fails in light detection at the position where the fourth light blocking area 29*a* covers the detection position P as shown in FIG. 11P, this position is determined as a "11-o'clock 00-minute" position.

When the center wheel 25 rotates further 360 degrees from the "11-o'clock 00-minute" position, the reference circular aperture which is one of the third light-passing apertures 29 in the hour wheel 27 comes to the detection position P and the detection unit 13 can detect light passing through the reference aperture. This position of the center and hour wheels 25 and 27 is determined as the reference position, i.e., "0-o'clock 00-minute" position. Thus, the detection unit 13 performs light detection each time the center wheel 25 rotates 360 degrees (one rotation) after the state in which light detection by the detection unit 13 is possible. After the detection unit 13 fails in detecting light (state in FIG. 11P), when the center wheel 25 rotates 360 degrees (one rotation) and the detection unit 13 succeeds in light detection (state in FIG. 11A), this position of the hour wheel 27 is determined as the reference position, that is, a position of "0-o'clock 00 minute".

Referring to FIGS. 12A to 14F, description will be given on a basic three-hand position detection operation for detecting the positions of the seconds, center and hour hands 2, 3 and 4.

The three-hand position detection operation comprises a combination of the operation to detect the position of the seconds wheel 20 and the operation to detect the position of the center and hour wheels 25 and 27. The three-hand position detection operation can be applied to the following three cases wherein the detecting condition is not satisfied. In the first case, the first light passing apertures 21 in the seconds wheel 20 are out of the detection position P. In the second case, the second light-passing aperture 28 in the center wheel 25 and/or any of the third light-passing apertures 29 in the hour wheel 27 are out of the detection position P. In the third case, the first light-passing apertures 21 are out of the detection position P and the second light-passing aperture 28 and/or the third light-passing apertures 29 are out of the detection position P.

First, referring to FIGS. 12A to 12F, description will be given on the three-hand position detecting process to be applied to the first case, that is, when the first light-passing apertures 21 in the seconds wheel 20 are out of the detection position P.

It is assumed that the state of the seconds wheel 20 is unknown and that the center wheel 25 and the hour wheel 27 are set at the reference position (0-o'clock 00-minute position). The basic operation to detect the reference position of the seconds hand 20 is performed firstly. That is, as described above, the second wheel 20 rotates two steps, and the detection unit 13 performs light detection at every two steps of the rotation.

Figure 12A:
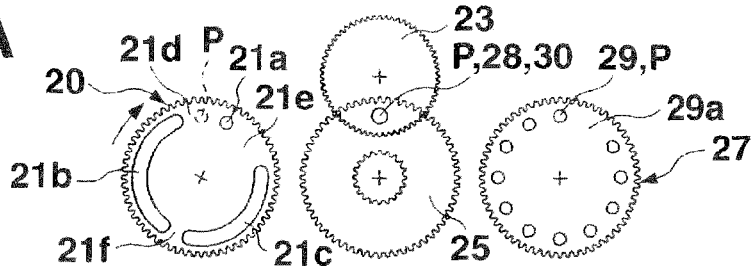
FIGS. 12A, 12B, 12C, 12D, 12E and 12F show a position detecting operation for the seconds wheel of FIG. 5, and illustrate states of the seconds wheel obtained when the seconds wheel which is offset from a reference position is moved to the reference position.

When the seconds wheel 20 rotates two steps and the state shown in FIG. 12A is obtained, the detection unit 13 fails in detecting light. Thus, counting the number of times of detection failure is started. When the detection failure is occurred successively, the number of times of detection failure is sequentially counted up. When the detection unit 13 continuously fails in light detection, the number of times of detection failure is counted up. When the detection unit 13 succeeds in light detection, the counted number is cleared.

Figure 12B:
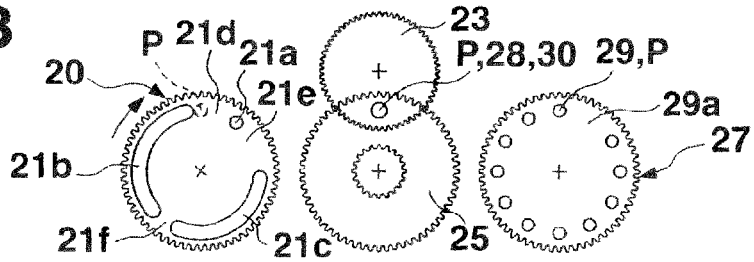
Figure 12C:
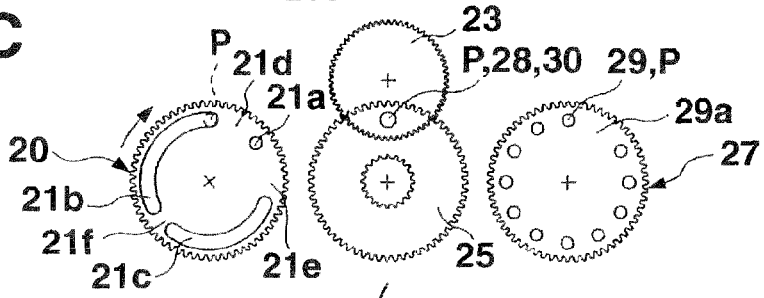
Figure 12D:
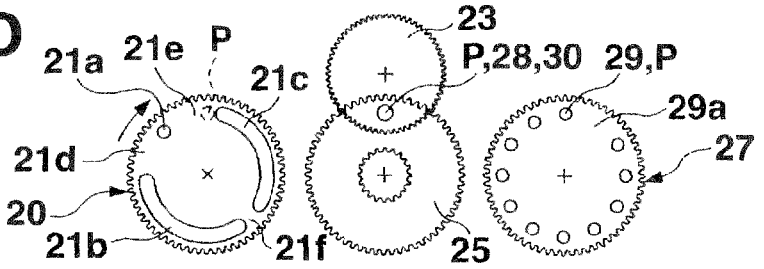

When the seconds wheel 20 rotates further two steps as shown in FIG. 12B, the detection unit 13 fails in detecting light and it is determined that another detection failure is occurred successively. Therefore, the number of times of detection failure is incremented. Then, the seconds wheel 20 rotates further two steps from this state and the detection unit 13 performs light detection. When the detection unit 13 succeeds in detecting light as shown in FIG. 12C, the number of times of detection failure counted so far is cleared.

Figure 12E:
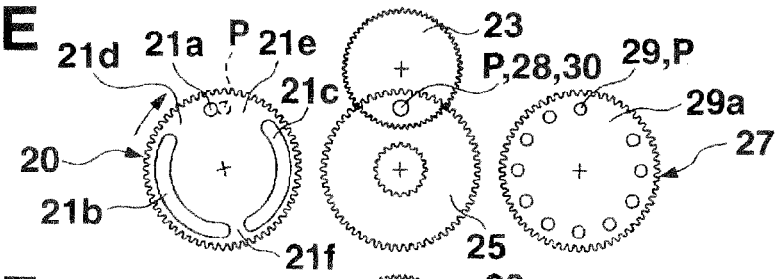

Subsequently, the detection unit 13 tries to detect light every time the seconds wheel 20 rotates two steps. As shown FIG. 12D, when the detection result is changed from the continuous success to detection failure, counting the number of times of detection failure is started again. Thereafter, the detection unit 13 performs light detection each time the seconds wheel 20 rotates two steps to detect four times of successive detection failure as shown in FIG. 12E.

Figure 12F:
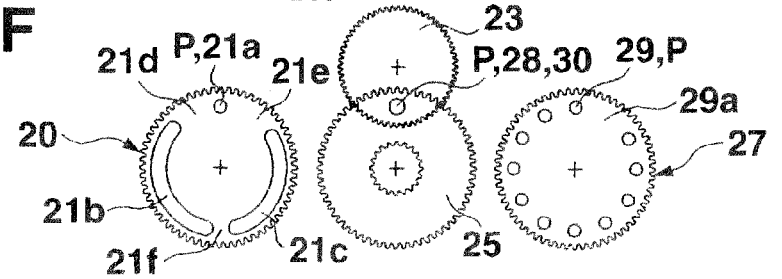

Two steps later, the detection unit 13 detects light and it is determined that the seconds wheel 20 is located at the reference position (00-second position). As shown in FIG. 12F, when the detection unit 13 succeeds in light detection, the circular aperture 21*a* of the first light-passing apertures 21 in the seconds wheel 20 is aligned with the detection position P. As described, the reference position of the seconds wheel 20, i.e., "00-second position" is thus detected.

Then, referring to FIGS. 13A to 13F, description will be given on the three-hand position detecting process to be applied to the second case, that is, when the second light-passing aperture 28 and/or the third light-passing apertures 29 are out of the detection position P.

Even in the case where one of the first light-passing apertures 21 in the seconds wheel 20 is located at the detection position P, when the light-passing apertures in the center and hour wheels 25 and 27 are out of the detection position P, the detection unit 13 fails in detecting light. Therefore, firstly, the basic operation to detect the reference position of the seconds wheel 20 is performed.

The detection unit 13 performs light detection every time the seconds wheel 20 rotates two steps. When the detection result changes from the state shown in FIG. 13A to the state shown in FIG. 13B, the arcuate aperture 21*a* in the seconds wheel 20 comes to the detection position P, and the second light-passing aperture 28 in the center wheel 25 and third light-passing apertures 29 in the hour wheel 30 are off the detection position P. Therefore, the detection unit 13 fails in detecting light. Between the states of FIGS. 13A and 13B, detection failure is occurred sequentially four times.

Figure 13A:
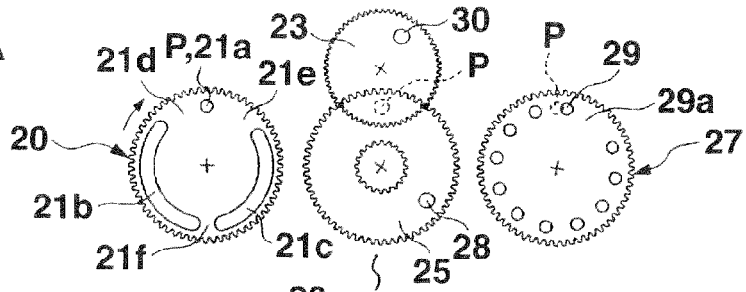
FIGS. 13A, 13B, 13C, 13D, 13E and 13F show a position detecting operation for the center and hour wheels of FIG. 5, and illustrate states of the center and hour wheels obtained when the center and hour wheels which are offset from the reference position are moved to the reference position.
Figure 13B:
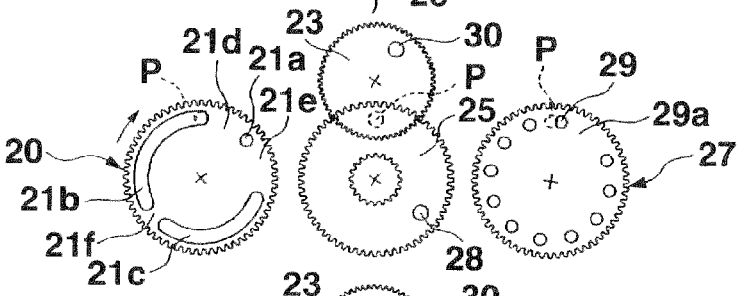
Figure 13C:
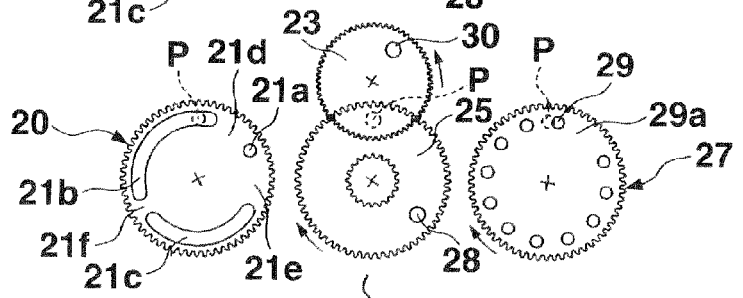
Figure 13D:
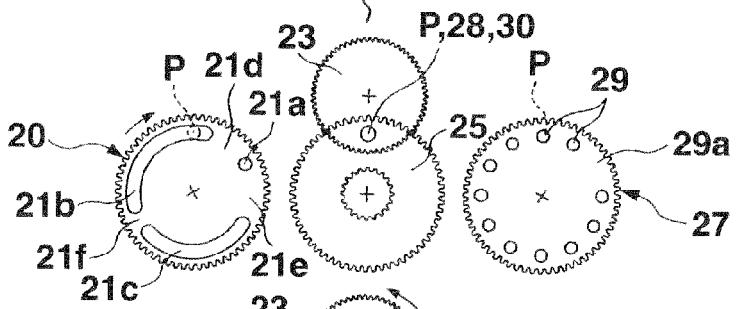

Basically, the reference position of the seconds wheel 20 is detected when the light detection is successful two steps after four times of continuous detection failure, as described above. However, as shown in FIG. 13C, the second light-passing aperture 28 and the third light-passing apertures 29 are out of the detection position P after the seconds wheel 20 rotates two steps; therefore, the detection unit 13 cannot detect light.

As a result, the detection unit 13 fails in light detection successively five times. The five times of continuous detection failure is not assumed in the operation to detect the reference position of the seconds wheel 20. Accordingly, it can be recognized that the second light-passing aperture 28 in the center wheel 25 is away from the detection position P and/or the third light-passing apertures 29 in the hour wheel 27 are away from the detection position P. In this state, it is uncertain whether or not one of the first light-passing apertures 21 is aligned with the detection position P.

However, it can be recognized that the second light-passing aperture 28 is away from the detection position P and/or the third light-passing apertures 29 are away from the detection position P; accordingly the basic operation to detect the reference position of the center and hour wheels 25 and 27 is performed. The detection unit 13 performs light detection every time the center wheel 25 rotates one step. When the state of the center and hour wheels 25 and 27 changes from that of FIG. 13C to that of FIG. 13D, the second light-passing aperture 28 in the center wheel 25 and the fourth light-passing aperture 30 in the intermediate wheel 23 are aligned together at the detection position P and one of the third light-passing apertures 29 in the hour wheel 27 is also aligned with the detection position P. Thus, the detection unit 13 can detect light passing through the apertures.

Figure 13E:
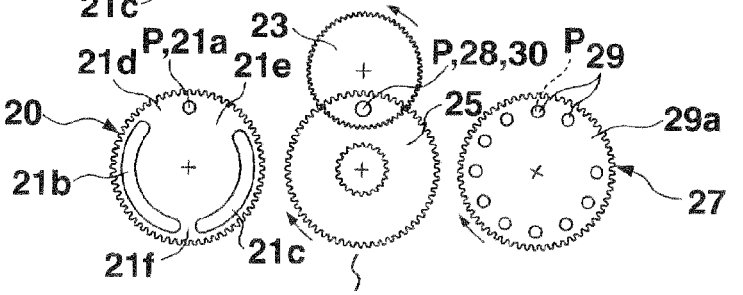
Figure 13F:
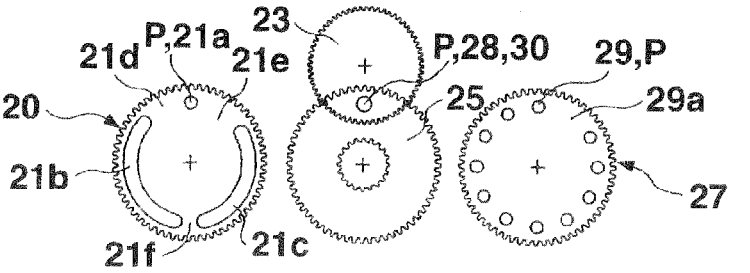

As a result, it can be understood that the center wheel 25 is set at the reference position (00-minute position). However, positions at which the seconds and hour wheels 20 and 27 are set are unknown. As the detection unit 13 can detect light passing through the apertures, the basic operation to detect the reference position of the seconds wheel 20 is performed. The seconds wheel 20 is moved to the reference position (00-minute position) as shown in FIG. 13E. Thus, it is seen that the seconds and center wheels 20 and 25 are set at the reference position (00-minute 00-second position).

Then, the center wheel 25 rotates 360 degrees (one rotation) at a time. Every time the center wheel 25 rotates 360 degrees, the third light-passing apertures 29 in the hour wheel 27 come to the detection position P in turn, and the detection unit 13 detects light passing through the apertures 29. When the center wheel 25 is further rotated 360 degrees from the state (or 11-o'clock position) where the detection unit 13 cannot detect light, the hour wheel 27 is set at the reference position (0-o'clock position). All of the seconds, center and hour wheels 20, 25 and 27 are disposed at the reference position (0-o'clock 00-minute 00-second position).

Next, referring to FIGS. 14A to 14F, description will be given on the three-hand position detecting process to be applied to the third case, that is, when the first light-passing apertures 21 are out of the detection position P and the second light-passing aperture 28 and/or the third light-passing apertures 29 are out of the detection position P.

Figure 14A:
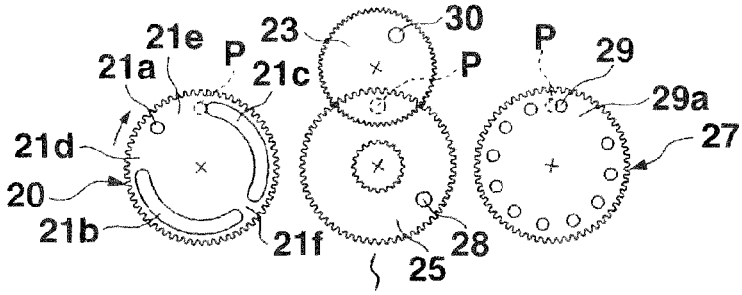
FIGS. 14A, 14B, 14C, 14D, 14E and 14F show a basic position detecting operation for the seconds, center and hour wheels of FIG. 5, and illustrate states of the wheels obtained when the wheels offset from the reference position are moved to the reference position.
Figure 14B:
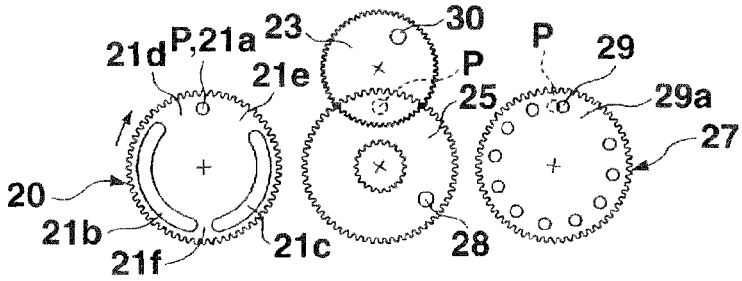

In this case, rotational positions of the seconds, center and hour wheels 20, 25 and 27 are unknown. Thus, the basic operation to detect the reference position of the seconds wheel 20 is firstly performed. That is, starting from the state shown in FIG. 14A, the seconds wheel 20 rotates two steps and the detection unit 13 performs light detection. Even in the case where any of the first light-passing apertures 21 comes to the detection position P, when the second light-passing aperture 28 and/or the third light-passing apertures 29 are out of the detection position P as shown in FIG. 14B, the detection unit 13 fails in detecting light.

Figure 14C:
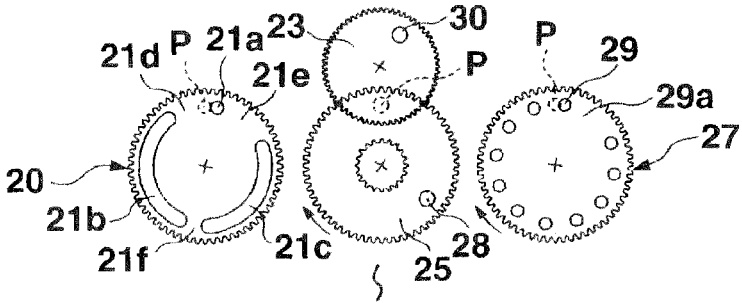

Therefore, the basic operation to detect the reference position of the seconds wheel 20 is further performed. Basically, to detect the reference position of the seconds wheel 20, the seconds wheel 20 rotates two steps and the detection unit 13 performs light detection at every two steps, and when the light detection is successful two steps after four times of continuous detection failure, the reference position of the seconds wheel 20 is detected, as described above. As shown in FIG. 14C, when the detection unit 13 fails in detecting light two steps after four times of continuous detection failure, it is considered that the second light-passing aperture 28 is out of the detection position P and/or the third light-passing apertures 29 are offset from the detection position P. In addition, it is also unknown whether or not one of the first light-passing apertures 21 in the seconds wheel 20 covers the detection position P.

Figure 14D:
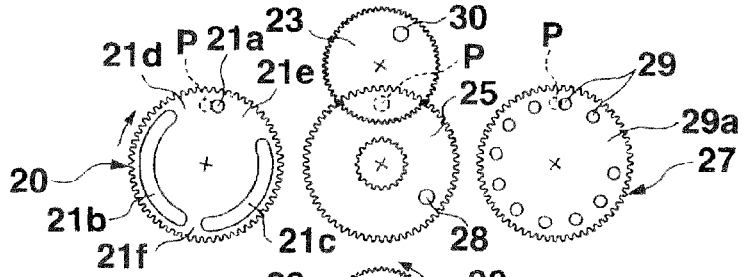

Here, the second light-passing aperture 28 in the seconds wheel 25 is considered being away from the detection position P. The basic operation to detect the reference position of the center and hour wheels 25 and 27 is performed. The center wheel 25 rotates one step at a time and the detection unit 13 performs light detection at every step. When the detection unit 13 fails in detecting light in the case where the center wheel 25 rotates 360 degrees from the state shown in FIG. 14C, the first light-passing apertures 21 in the seconds wheel 20 are considered being out of the detection position P as shown in FIG. 14D. The seconds wheel 20 rotates further 30 steps (180 degrees).

Figure 14E:
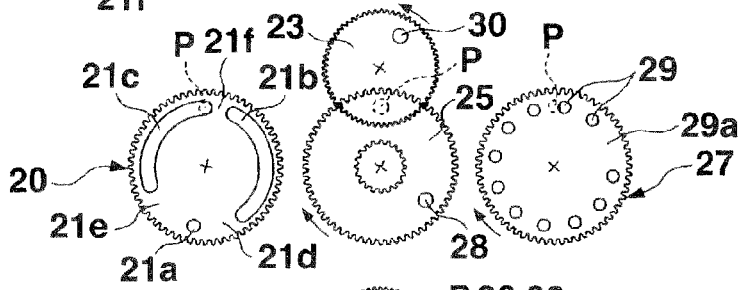
Figure 14F:
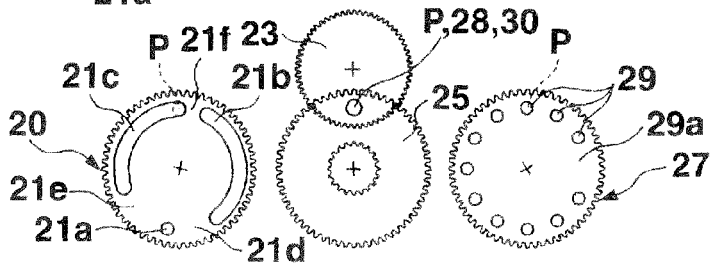

In the case where the first light-passing apertures 21 in the seconds wheel 20 are away from the detection position P, when the seconds wheel 20 rotates 180 degrees (half rotation), one of the first light-passing apertures 21 surely comes to the detection position P as shown in FIG. 14E. Then, the center wheel 25 rotates again one step at a time and the detection unit 13 performs light detection at every step. When the detection unit 13 succeeds in detecting light, the second light-passing aperture 28 in the center wheel 25 is set at the detection position P and the center wheel 25 is positioned at the reference position (00-minute position) as shown in FIG. 14F. The state shown in FIG. 14F is equivalent to the state shown in FIG. 13D; consequently, the above described three-hand position detecting process for the second case described with reference to FIG. 13D and thereafter can be applied to the state of FIG. 14F. The seconds, center and hour wheels 20, 25 and 27 are thus disposed at the reference position.

Referring to FIGS. 15A to 15F, description will be made on a basic hand-position confirming operation to confirm whether or not the seconds, center and hour hands 2, 3 and 4 are set correctly at every hour on the hour in the normal hand rotating operation.

The basic hand-position confirming operation includes confirming whether the seconds hand 2 is correctly located every hour on the hour excluding 11 o'clock and 23 o'clock and it is required to confirm deviation of the seconds hand 2 within 10 seconds. This is because, when ten seconds has elapsed from the hour, the center wheel 25 rotates one step (one degree) by the second stepping motor 22 of the second driving system 12, and as a result, the intermediate wheel 23 rotates 30 degrees to block the detection position P of the detection unit 13.

Figure 15A:
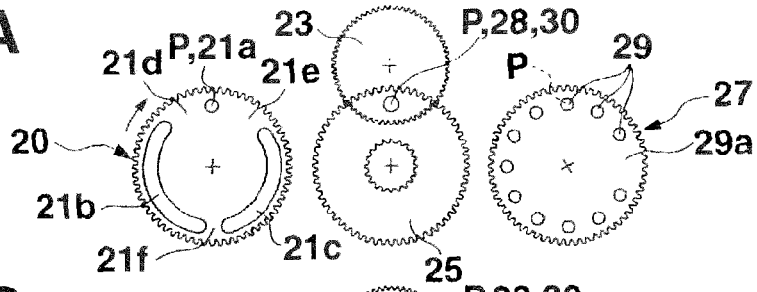
FIGS. 15A, 15B, 15C, 15D, 15E and 15F show a hand position confirming process for confirming every hour on the hour whether the seconds, center and hour hands are positioned correctly or not in normal hand rotating operation, and illustrate operational positions of the seconds, center and hour wheels at every two seconds.

In FIG. 15A, the circular aperture 21*a* of the first light-passing apertures 21 in the seconds wheel 20, the second light-passing aperture 28 in the center wheel 25, one of the third light-passing apertures 29 in the hour wheel 27 (third circular aperture, for example) and the fourth light-passing aperture 30 in the intermediate wheel 23 are aligned together at the detection position P, on the particular hour (2-o'clock, for example) in the normal hand rotating operation. In the normal hand rotating operation, the seconds wheel 20 rotates one step (six degrees) at a time from the state of FIG. 15A. When the seconds wheel 20 rotates one step from the state of FIG. 15A, the circular aperture 21*a* in the seconds wheel 20 is not completely moved away from the detection position P and remains in the detectable range of the detection unit 13.

Figure 15B:
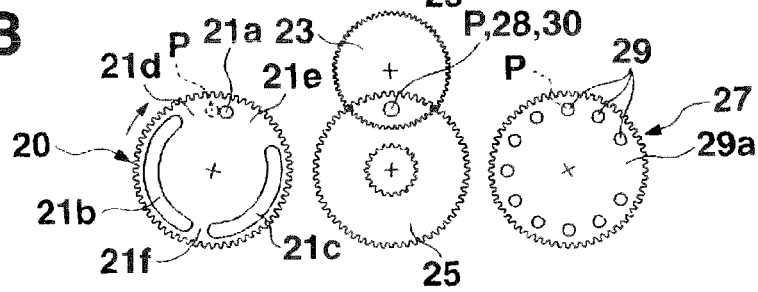

When the seconds wheel 20 rotates further one step (two steps or 12 degrees in total) and comes to a position of 2 seconds (2-second position) shown in FIG. 15B, the circular aperture 21*a* is shifted completely away from the detection position P and the first light blocking area 21*d* covers the detection position P. The detection unit 13 fails to detect light, and counting the number of times of detection failure is started.

Figure 15C:
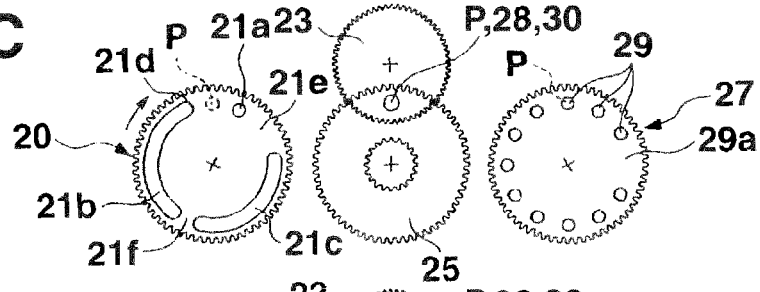
Figure 15D:
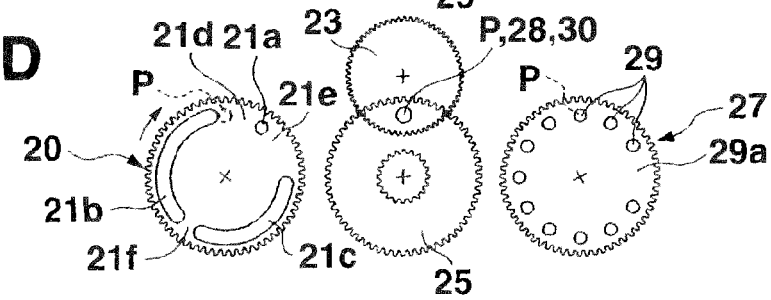

The seconds wheel 20 is further rotated by one step at a time and the detection unit 13 tries to detect light at every two steps. The first light blocking area 21*d* of the seconds wheel 20 continuously covers the detection position P of the detection unit 13 at a 4-second position shown in FIG. 15C and at a 6-second position shown in FIG. 15D. Thus, as shown in FIGS. 15B to 15D, the detection unit 13 fails in detecting light successively three times.

Figure 15E:
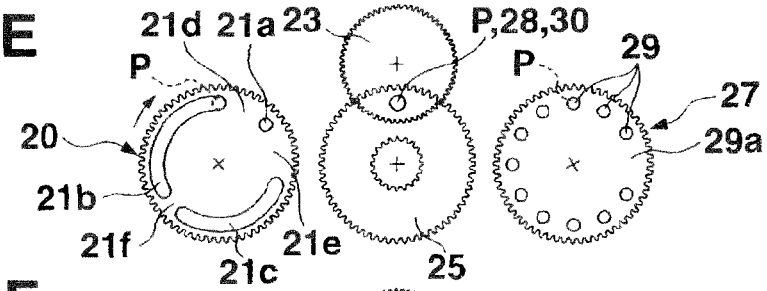

When the seconds wheel 20 rotates further two steps, a part of the first arcuate aperture 21*b* in the seconds wheel 20 covers the detection position P at an 8-second position shown in FIG. 15E. The detection unit 13 succeeds in detecting light and it is determined that the circular aperture 21*a* is positioned at the 8-second position; therefore, it is understood that the seconds wheel 20 rotates correctly and the rotational position of seconds hand 2 is accurate. That is, the detection unit 13 performs light detection at every two steps of the rotation of the seconds wheel 20; when the detection unit 13 succeeds in detecting light after three times of continuous detection failure, it is determined that the seconds hand 2 is located at the 8-second position and the seconds hand 2 rotates correctly.

Figure 15F:
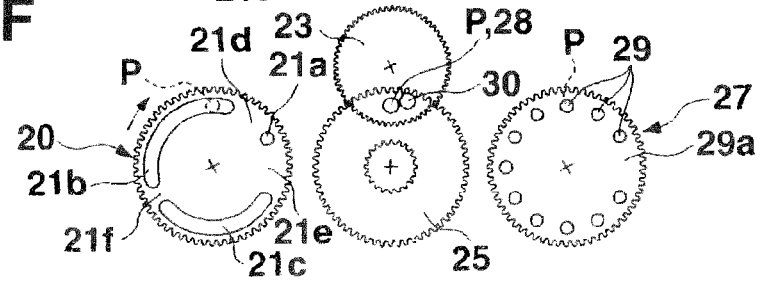

Thereafter, when the seconds wheel 20 rotates further two steps and ten seconds has elapsed, a part of the first arcuate aperture 21*b* in the seconds wheel 20 covers the detection position P through which the light from the light emission element 31 can pass as shown in FIG. 15F. However, since the center wheel 25 rotates one step (one degree) and the intermediate wheel 23 rotates one step (30 degrees), the fourth light-passing aperture 30 in the intermediate wheel 23 is completely away from the detection position P and the intermediate wheel 23 blocks the detection position P even though the second light-passing aperture 28 in the center wheel 25 is not completely away from the detection position P. Accordingly, hand-position adjusting operation is required to be performed within 10 seconds from the hour in the normal hand rotating operation.

Figure 18:
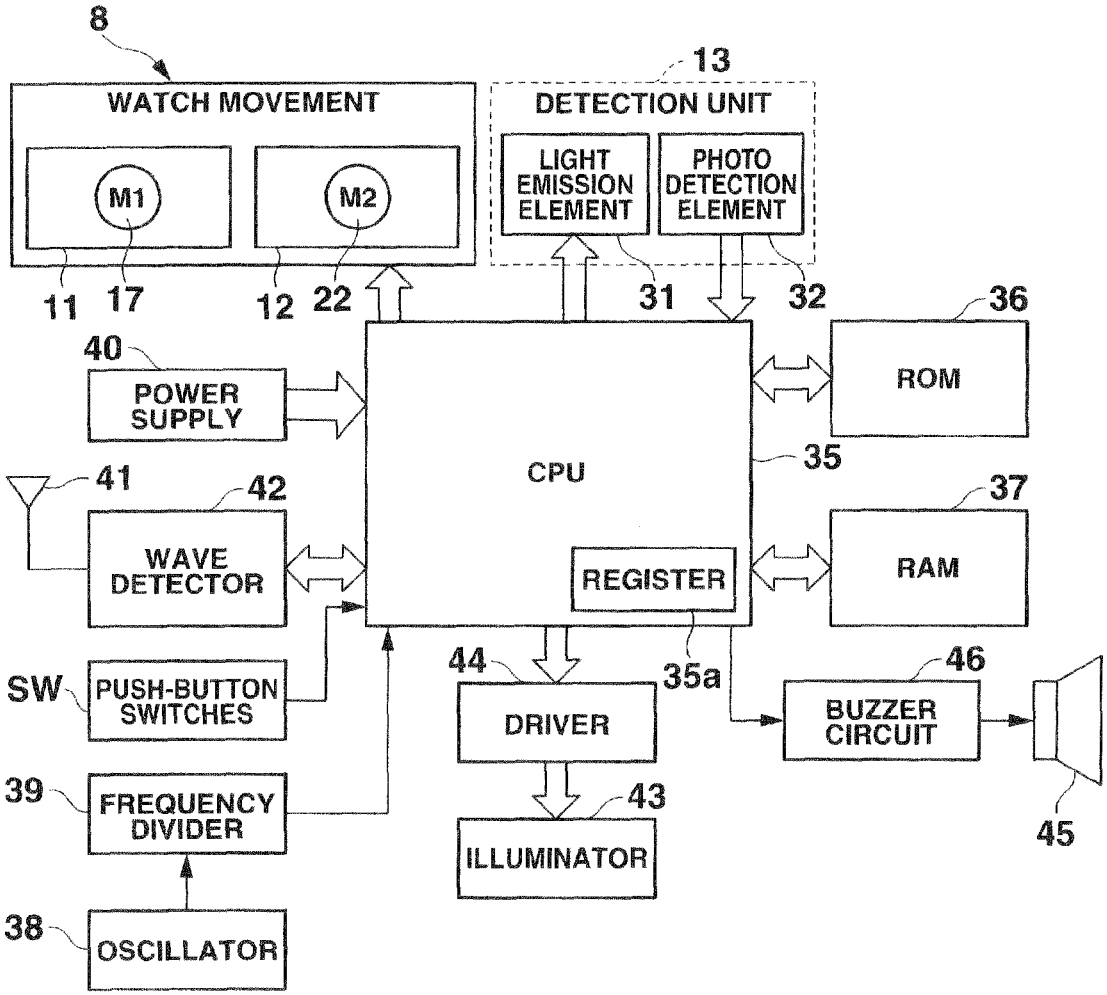
FIG. 18 is a block diagram of a circuit configuration of the wristwatch according to a first embodiment.

Next, referring to FIG. 18, the circuit configuration of the hand type wristwatch 1 will be described.

The circuit configuration comprises a CPU 35 which controls the whole circuit, a read only memory (ROM) 36 which stores predetermined programs, a random access memory (RAM) 37 which stores data to be processed, an oscillator 38 which generates a pulse signal to operate the CPU 35, a frequency divider 39 which converts a frequency of the pulse generated by the oscillator 38 to an appropriate frequency to operate the CPU 35, the watch movement 8 including the first driving system 11 which rotates the seconds hand 2 and the second driving system 12 which rotates the center and hour hands 3 and 4. The first driving system 11 includes the first stepping motor 17 and the second driving system 12 includes the second stepping motor 22.

The circuit configuration further comprises the detection unit 13 which comprises the light emission element 31 and the photo detection element 32 which receives light from the light emission element 31, a power supply 40 which includes the solar panel 9 or a battery to supply power, an antenna 41 which receives the standard radio waves, a wave detector 42 which detects the received standard radio waves, an illuminator 43 which illuminates time indications, a driver 44 which drives the illuminator 43, a speaker 45 which emanates sound, a buzzer circuit 46 which drives the speaker 45, and push-button switches SW for mode selection and mode change. The CPU 35 includes a register 35*a* which stores "0" or "1" indicative of a drive current supply state to the coil 17*a* in correspondence with the polarity of the magnetic field generated in the stator 17*b* of the first stepping motor 17.

Figure 19:
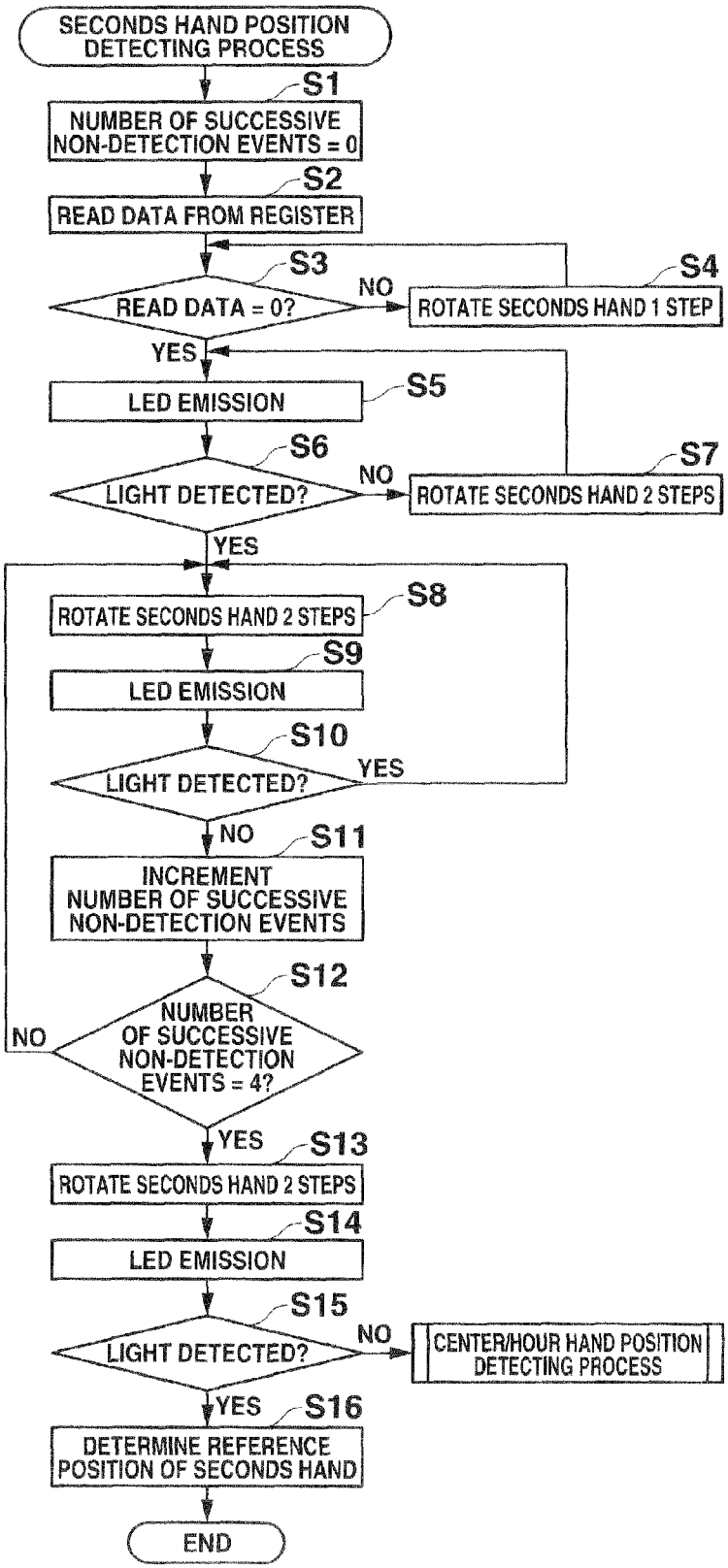
FIG. 19 is a flowchart of a basic seconds hand position detecting process to move the seconds hand to the reference position.

Next, referring to FIG. 19, description will be given on a basic seconds hand position detecting process for detecting the reference position of the seconds hand 2 of the hand type wristwatch 1.

The basic seconds hand position detecting process detects the reference position (00-second position) of the seconds wheel 20 where the circular aperture 21*a* is aligned with the detection position P, as shown in FIG. 10A. It is assumed that the second light-passing aperture 28 in the center wheel 25, the forth light-passing aperture 30 in the intermediate wheel 23 and one of the third apertures 29 in the hour wheel 27 are aligned together and stopped at the detection position P.

When the seconds hand position detecting process is started, the number of times of detection failure that is previously counted is cleared and a non-detection flag is set to "0" (step S1). The CPU 35 reads data stored previously in the register 35*a* ("0" shown in FIG. 17A or "1" shown in FIG. 17B) (step S2). The data ("0" or "1") stored in the register 35*a* indicates previous state of current supply to the coil 17*a*.

The register 35*a* stores "0" when a positive (+) current is supplied to the terminal A of the coil 17*a* and a negative (−) current is supplied to the terminal B of the coil 17*a* as shown in FIG. 17A. This data "0" indicates that the seconds hand 2 is located at a position of an even-numbered second. The register 35*a* stores "1" when a negative (−) current is supplied to the terminal A of the coil 17*a* and a positive (+) current is supplied to the terminal B of the coil 17*a* as shown in FIG. 17B. This data "1" indicates that the seconds hand 2 is located at a position of an odd-numbered second.

The CPU 35 determines whether the data read from the register 35*a* in step S2 is "0" or "1" (step S3). The data "0" indicates that the previous drive current supply state to the coil 17*a* corresponds to the polarity of the stator 17*b* that is stored in the ROM 36, and the data "1" indicates that the previous drive current supply state corresponds to the opposite polarity.

When the read data is "0", that is, when the positive current has been supplied to the terminal A of the coil 17*a* and the negative current has been supplied to the terminal B as shown in FIG. 17A, the polarity of the stator 17*b* has become the previously determined polarity. Thus, the left part of the stator 17*b* is N-polarized and the right part of the stator 17*b* is S-polarized as shown in FIG. 17A.

The above previously determined polarity (e.g., N-S polarity) is determined at the time of attaching the seconds hand 2 to the seconds hand shaft 20*a* at the reference position (00-second position). This polarity is determined so that the magnetic field generated in the stator 17*b* by the drive current supplied to the coil 17*a* repels the polarity of the rotor 17*c* which is previously magnetized in the constant state. The previously determined polarity is preliminary stored in the ROM 36. The operational polarity of the stator 17*b* is alternately changed per pulse (per second). The operational polarity is matched with the previously determined polarity on every even-numbered pulse (at every even-numbered second).

When it is determined in step S3 that the data read from the register 35*a* is "0", the CPU 35 causes the light emission element 31 of the detection unit 13 to emit light (step S5) and then, the CPU 35 determines whether or not the light from the light emission element 31 is received by the photo detection element 32, namely, whether the detection unit 13 succeeds or fails in detecting the light (step S6).

On the other hand, when it is determined in step S3 that the data read from the register 35*a* is "1", reverse the direction of the current passing through the coil 17*a*, and the data stored in the register 35*a* is changed from "1" to "0", thereby rotating the rotor 17*c* 180 degrees (half rotation) and rotating the seconds wheel 20 one step (step S4).

The register 35*a* may store the data "1" in various cases. For example, in the case where the seconds hand 2, which is rotated one second per step, is rotated to a position of one second, when the user operates the switches SW to give instructions to detect hand positions, the rotor 17*c* may be set in the state shown in FIG. 17B and the hand position detection should be started from the position of one second. In such a case, the rotor 17*c*, as it is, cannot be rotated with respect to the stator 17*b*. Therefore, it is required to generate a magnetic field of the opposite polarity the stator 17*b*. Thus, the data stored in the register 35*a* is changed from "1" to "0" to reverse the direction of the current, thereby rotating the rotor 17*c* 180 degrees (half rotation) and rotating the seconds wheel 20 one step (step S4).

When the circular aperture 21*a*, the first and second arcuate apertures 21*b* and 21*c* are out of the detection position P of the detection unit 13, the photo detection element 32 detects no light from the light emission element 31 in step S6. Thus, it is determined that the detection unit 13 fails in light detection, and the seconds wheel 20 is rotated two steps at a time (step S7) until one of the circular aperture 21*a*, first and second arcuate apertures 21*b* and 21*c* in the seconds wheel 20 comes to the detection position P.

When one of the circular aperture 21*a*, first and second arcuate apertures 21*b* and 21*c* in the seconds wheel 20 covers the detection position P, the photo detection element 32 receives the light from the light emission element 31 and it is determined that the detection unit 13 succeeds in light detection. Then, the seconds wheel 20 is rotated two steps (step S8), and the light emission element 31 emits light (step S9). It is determined whether or not the light from the light emission element 31 is received by the photo detection element 32, namely, whether the detection unit 13 succeeds or fails in light detection (step S10).

When one of the circular aperture 21*a*, first and second arcuate apertures 21*b* and 21*c* in the seconds wheel 20 covers the detection position P and the detection unit 13 succeeds in light detection, the flow returns to step S8. The seconds wheel 20 is rotated two steps at a time until one of the first to third light blocking areas 21*d*-21*f* in the seconds wheel 20 comes to the detection position P to block light from the light emission element 31 to the photo detection element 32 and the detection unit 13 fails in light detection.

When one of the first to third light blocking areas 21*d*-21*f* in the seconds wheel 20 covers the detection position P and the detection unit 13 fails in detecting light, the non-detection flag is set to "1" and the number of times of detection failure is incremented by one (step S11). Then, it is determined whether or not the detection unit 13 fails in detecting light successively four times (step S12).

As described above, when the detection unit 13 detects light after four times of detection failure as shown in FIGS. 10J-10M and FIG. 10A, it can be determined that the seconds wheel 20 is positioned at the reference position. For example, in the case where the light blocking area 21*d* of the seconds wheel 20 covers the detection position P in the states of FIGS. 10B-10D and the detection unit 13 fails in light detection successively three times; when the seconds wheel 20 rotates further two steps; the first arcuate aperture 21*b* in the seconds wheel 20 comes to the detection position P and the detection unit 13 succeeds in detecting light. Then, the flow returns to step S8 to repeat the processing of steps S8 to S12.

In the state shown in FIG. 10G, the third light blocking area 21*f* of the seconds wheel 20 covers the detection position P; therefore, the detection unit 13 detects no light. When the seconds wheel 20 rotates further two steps, the second arcuate aperture 21*c* in the seconds wheel 20 comes to the detection position P, and the detection unit 13 detects light. Thus, the flow returns to step S8 to repeat the above processing. When the seconds wheel 20 rotates from the state of FIG. 10J to that of FIG. 10M, the light blocking area 21*e* of the seconds wheel 20 covers the detection position P, and the detection unit 13 fails in detecting light successively four times.

Thereafter, the seconds wheel 20 is rotated further two steps (step S13), and the light emission element 31 emits light (step S14). It is determined whether or not the light from the light emission element 31 is received by the photo detection element 32, namely, whether or not the detection unit 13 succeeds in light detection (step S15). If yes, it is determined that the circular aperture 21*a* in the seconds wheel 20 is located at the detection position P and it is confirmed that the seconds wheel 20 is positioned at the reference position (00-second position) (step S16). Thereafter, operation of the wristwatch 1 is returned to its normal hand rotating operation, and the process is terminated.

It is assumed that the second and fourth light-passing apertures 28 and 30 and relevant one of the third light-passing apertures 29 are aligned together and stopped at the detection position P. Thus, the detection unit 13 necessarily can detect light in step S15. However, if any of the apertures 28, 29 and 30 is offset or away from the detection position P, the detection unit 13 detects no light and a center/hour hand position detecting process (see FIG. 20) to be described is executed.

Figure 20:
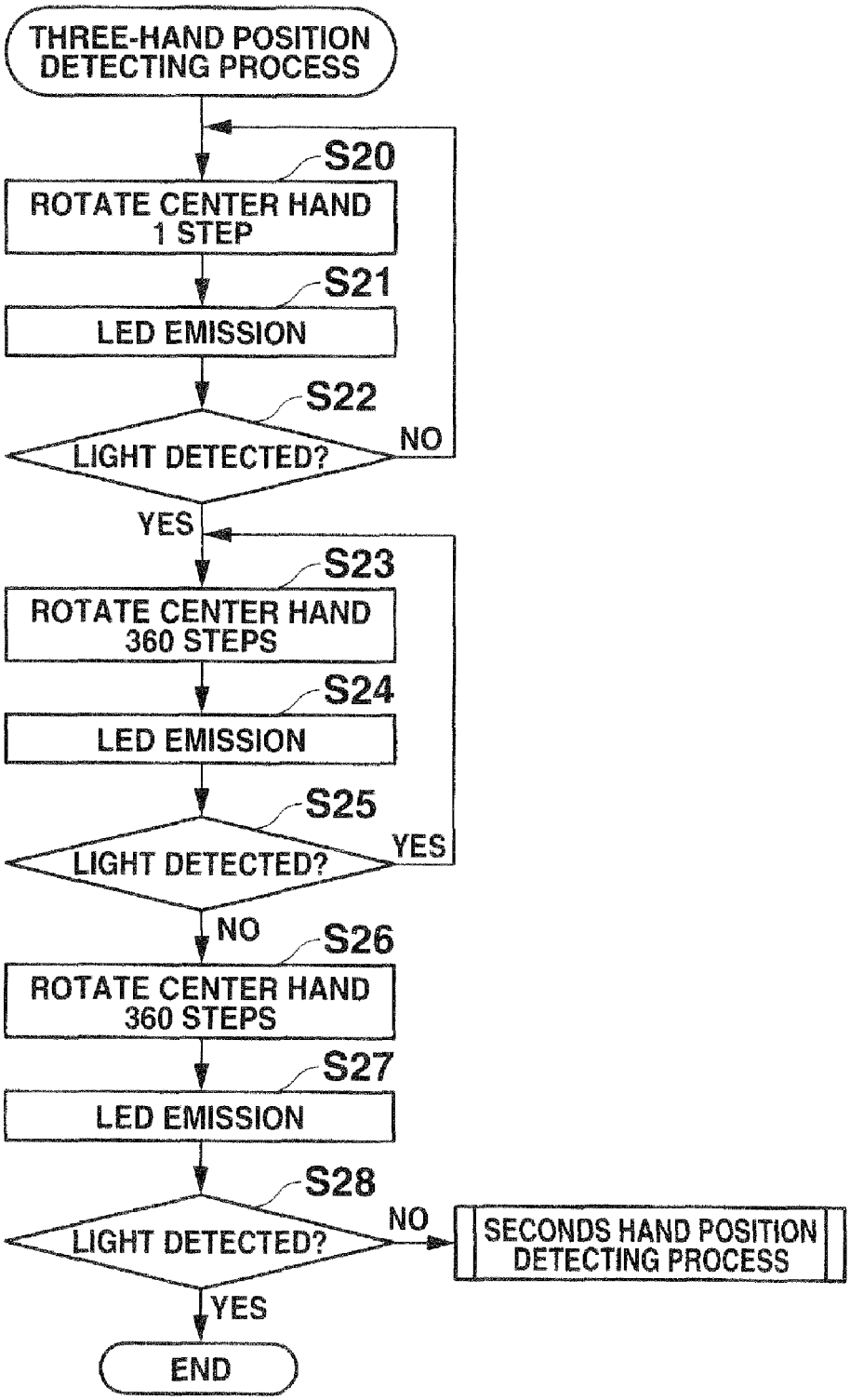
FIG. 20 is a flowchart of a basic center/hour hand position detecting process to move the center and hour hands to the reference position.

Referring to FIG. 20, description will be made on a basic center/hour hand position detecting process for detecting the reference position of the center and hour hands 3 and 4 of the hand type wristwatch 1.

The center and hour hand position detecting process detects the reference position (0-o'clock 00-minute position) of the center and hour wheels 25 and 27 where the second and fourth light-passing apertures 28 and 30 in the center and intermediate wheels 25 and 23 and the reference aperture of the third light-passing apertures 29 in the hour wheel 27 are aligned together at the detection position P, as shown in FIG. 11A. It is assumed that one of the first light-passing apertures in the seconds wheel 20 is also aligned with and stopped at the detection position P.

When the center/hour hand position detecting process is started, the center wheel 25 is rotated clockwise one step or one degree (step S20), the light emission element 31 emits light (step S21), and it is determined whether or not the light from the light emission element 31 is received by the photo detection element 32, namely, whether or not the detection unit 13 succeeds in light detection (step S22). If no, processing of steps S20-S22 is repeated until the seconds wheel 25 rotates 360 degrees (one rotation; one hour). As it is assumed that one of the first light-passing apertures 21 in the seconds wheel 20 is positioned at the detection point P, when the center wheel 25 rotates 360 degrees, the detection unit 13 necessarily detects light, as shown in FIG. 11N, excepting the 11-o'clock position.

When the detection unit 13 succeeds in detecting light in step S22, it is determined that the center wheel 25 is set at the reference position (00-minute position). Then, the center wheel 25 is rotated 360 degrees and the hour wheel 27 is rotated 30 degrees (step S23). The light emission element 31 of the detection unit 13 emits light (step S24). It is determined whether or not the light from the light emission element 31 is received by the photo detection element 32 and it is determined whether or not one of the third light-passing apertures 29 in the hour wheel 27 comes to the detection position P to allow the detection unit 13 detecting the light (step S25).

The hour wheel 27 includes the third light-passing apertures 29, which includes eleven circular apertures which are spaced at angular intervals of 30 degrees, and the fourth light blocking area 29*a* at the 11-o'clock position. When the center wheel 25 rotates 360 degrees and the hour wheel 27 rotates 30 degrees, the third light-passing apertures 29, in turn, come to the detection position P except the fourth light blocking area 29*a* as shown in FIGS. 11N-11O to allow the detection unit 13 detecting light. When the detection unit 13 detects light in step S25, the flow returns to step S23. The processing of steps S23-S25 is repeated, as the third light-passing apertures 29 successively come to the detection point P, until the fourth light blocking area 29*a* of the hour wheel 27 covers the detection position P.

As shown in FIG. 11P, when the fourth light blocking area 29*a* of the hour wheel 27 covers the detection position P and the detection unit 13 fails in detecting light, it is determined that the hour wheel 27 is set at the 11-o'clock position. The center wheel 25 is rotated further 360 degrees and the hour wheel 27 is rotated further 30 degrees (step S26). The light emission element 31 emits light (step S27), and it is determined whether or not the light from the light emission element 31 is detected by the photo detection element 32, namely, whether the detection unit 13 succeeds or fails in detecting light (step S28).

Naturally in step S28, the reference aperture of the third light-passing apertures 29 in the hour wheel 27 is set at the detection position P as shown in FIG. 11A, and the detection unit 13 detects light. Thus, it is confirmed that the hour wheel 27 is set at the reference position (0-o'clock position), and this process is terminated. It is assumed that one of the first light-passing apertures 21 in the seconds wheel 20 is set at the detection position P in step S28, and the detection unit 13 should succeed in detecting light. However, if the detection unit 13 fails in detecting light, the above-described seconds hand position detecting process is executed.

Figure 21:
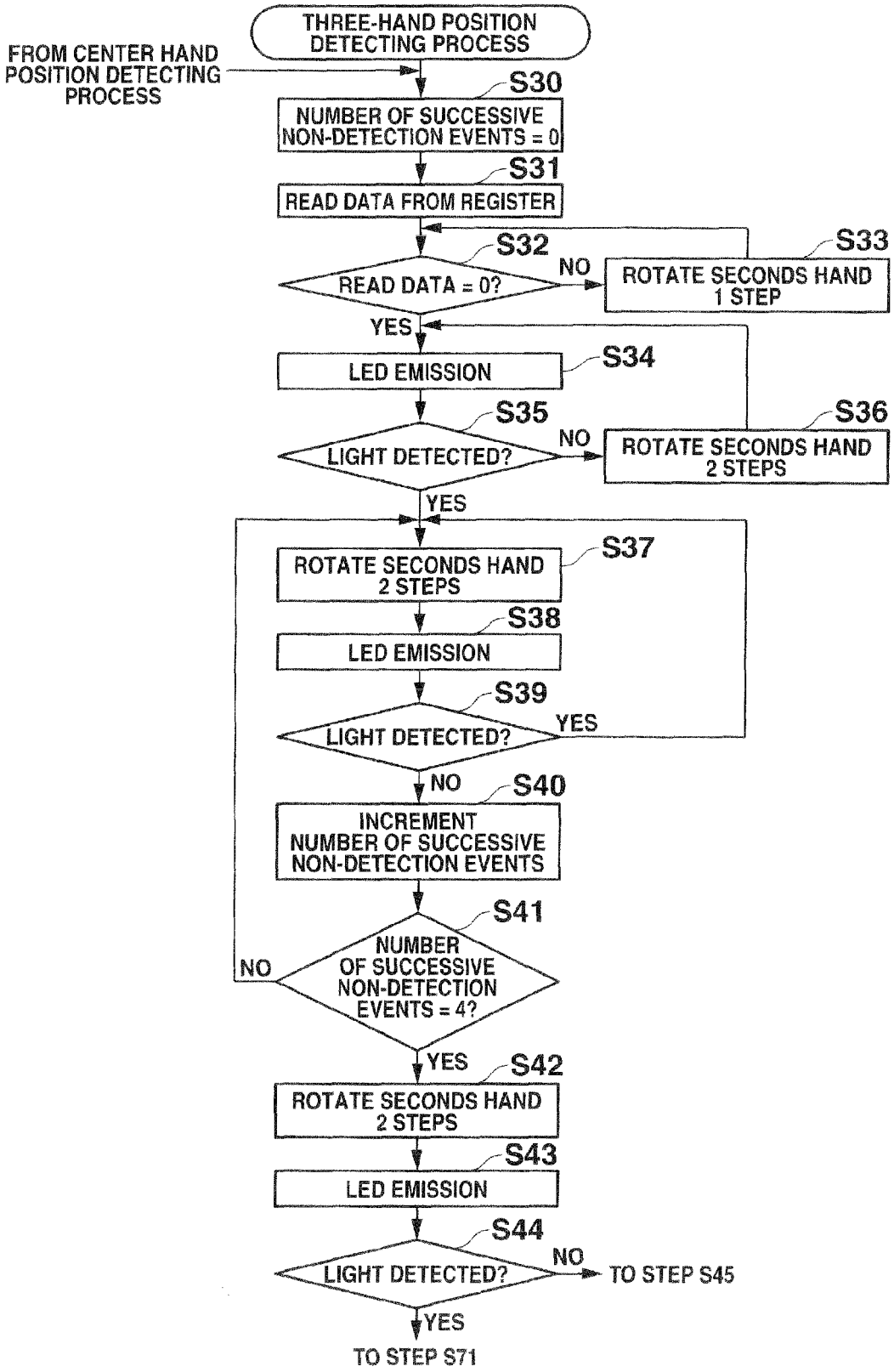
FIG. 21 illustrates a flowchart of a seconds hand position detecting process included in a basic three-hand position detecting process to move the seconds, center and hour hands to the reference position.
Figure 22:
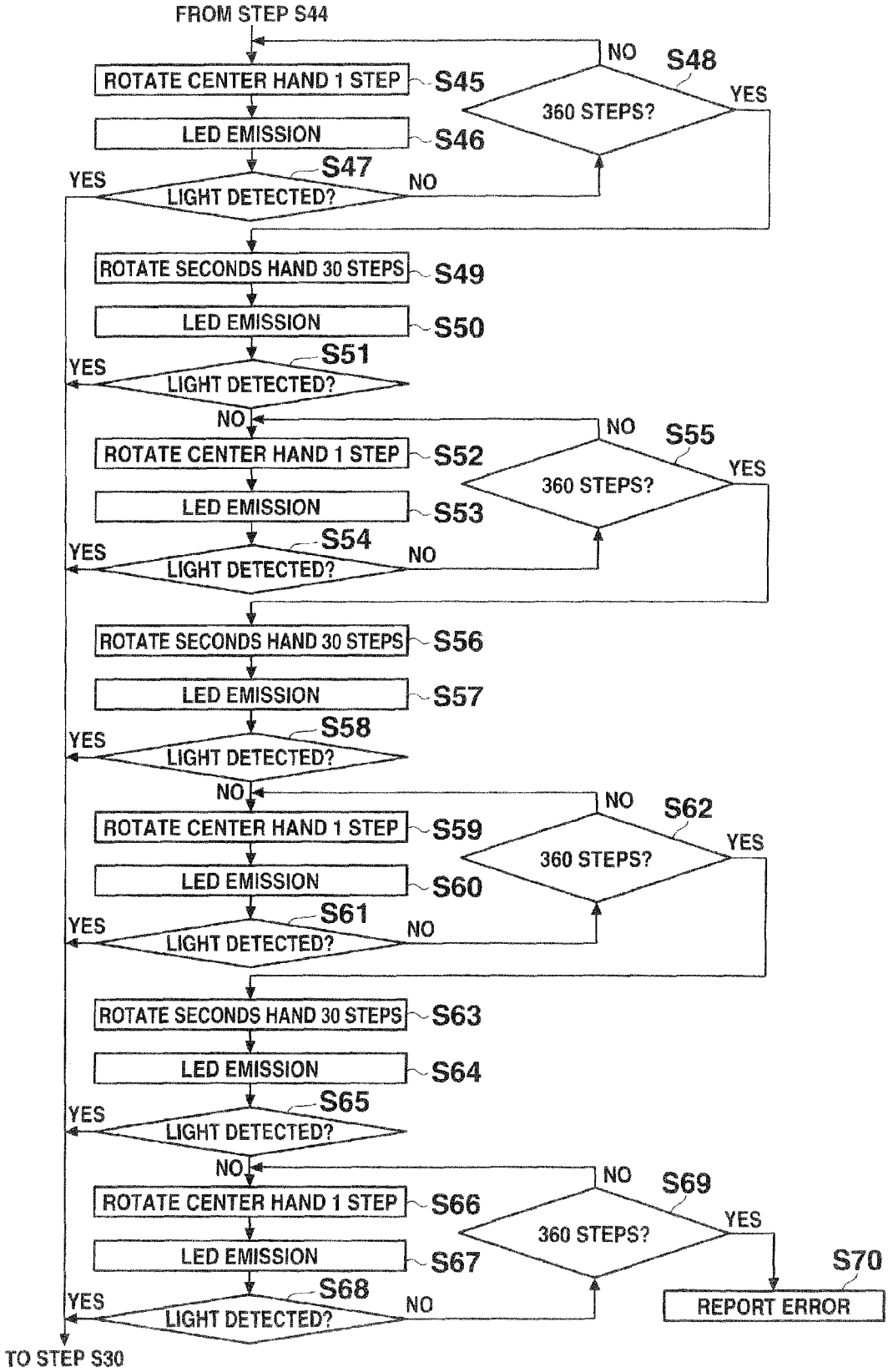
FIG. 22 illustrates a flowchart of a center hand position detecting process included in the basic three-hand position detecting process.
Figure 23:
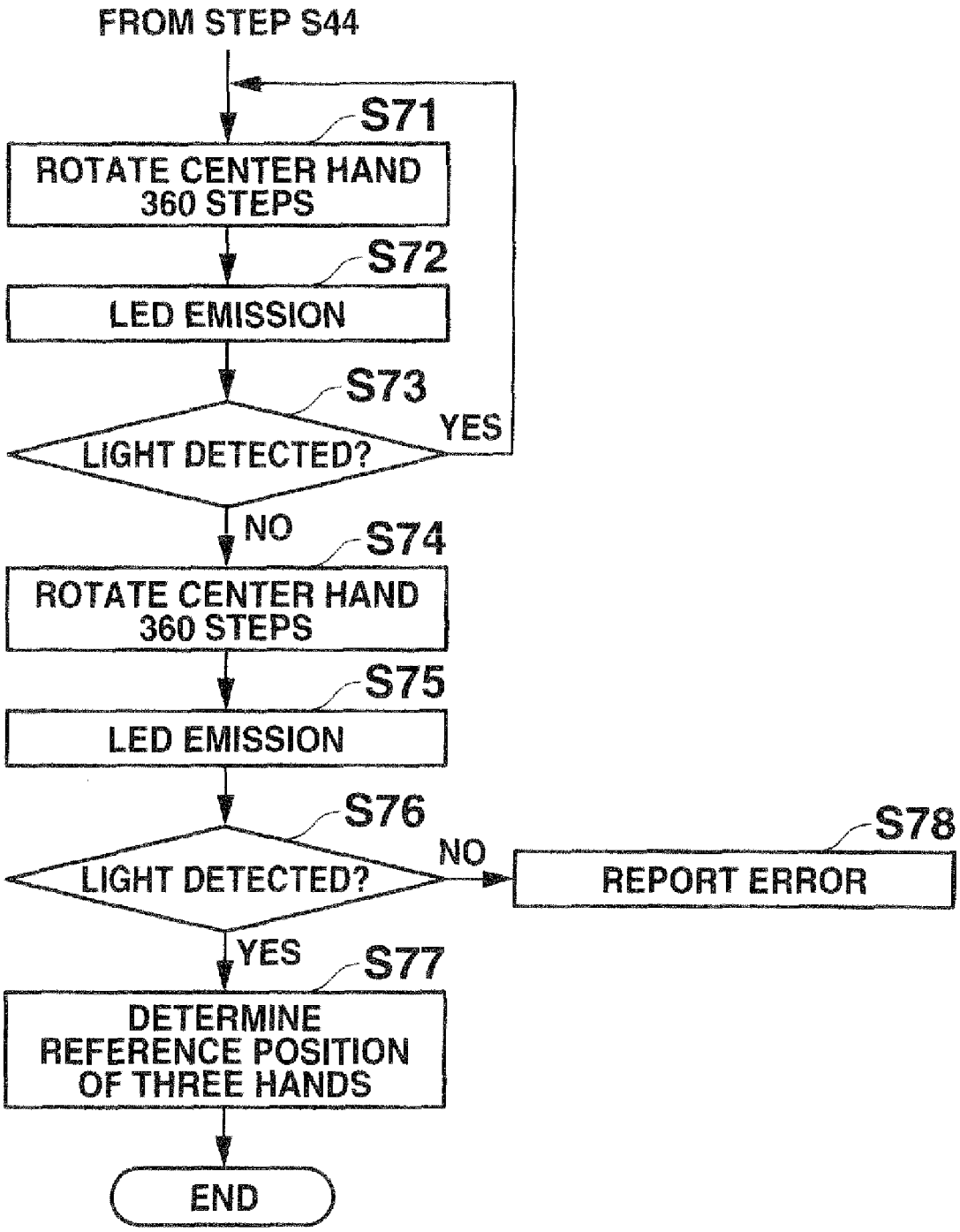
FIG. 23 illustrates a flowchart of a center hand position confirming process included in the basic three-hand position detecting process.

Referring to FIGS. 21-23, description will be made on a basic three-hand position detecting process for detecting the reference position of the seconds, center and hour hands 2, 3 and 4 of the hand type wristwatch 1.

The three-hand position detecting process is executed when the positions of the seconds, center and hour hands 2, 3 and 4 are unknown. The three-hand position detecting process is a combination of the above-described seconds hand position detecting process and the center/hour hand position detecting process. FIG. 21 shows steps S30-S44 of the seconds hand position detecting process. FIG. 22 shows steps S45-S70 of the center hand position detecting process. FIG. 23 shows steps S71-S78 of the hour hand position detecting process.

At the start of the three-hand position detecting process, because none of the positions of the seconds, center and hour hands 2, 3 and 4 is known, the seconds hand position detecting process of FIG. 21 is performed. That is, the number of times of detection failure in the detection unit 13 counted previously is cleared and the non-detection flag is set to "0" (step S30). Then data stored previously in the register 35*a* ("0" shown in FIG. 17A or "1" shown in FIG. 17B) is read (step S31).

Then, it is determined whether the data read from the register 35*a*, i.e., the data indicative of the previous drive current supply state to the coil 17*a* is "0", which indicates the polarity of the stator 17*b* and corresponds to the data stored in the ROM 36, or "1", which indicates the opposite polarity (step S32).

When the read data is "0", that is, when the positive (+) current has been supplied to the terminal A of the coil 17*a* and the negative current (−) has been supplied to the terminal B as shown in FIG. 17A, the polarity of the stator 17*b* has accorded with the previously determined polarity. Therefore, the left part of the stator 17*b* is N-polarized and the right part of the stator 17*b* is S-polarized.

Thus, when it is determined in step S32 that the data read from the register 35*a* is "0", the light emission element 31 emits light (step S34). It is determined whether or not the light from the light emission element 31 is received by the photo detection element 32, namely, whether the detection unit 13 succeeds or fails in detecting the light (step S35).

On the other hand, when the read data is not "0" that is indicative of the drive current supply state corresponding to the previously determined polarity but when the read data is "1" that is indicative of the opposite polarity, the current supplied to the coil 17*a* is reversed and data stored in the register 35*a* is changed from "1" to "0", thereby rotating the rotor 17*c* 180 degrees (half rotation) and rotating the seconds wheel 20 one step (step S33).

Then, when the photo detection element 32 receives no light from the light emission element 31 and it is determined in step S35 that the detection unit 13 fails in light detection, the seconds wheel 20 is rotated two steps (step S36) until the photo detection element 32 receives light from the light emission element 31. At this time, none of the rotational positions of the seconds, center and hour wheels 20, 25 and 27 is known. When the photo detection element 32 receives light from the photo emission element 31 and the detection unit 13 succeeds in light detection, the seconds wheel 20 is rotated further two steps (step S37). The light emission element 31 emits light (step S38), and it is determined whether the detection unit 13 succeeds or fails in light detection (step S39).

When the detection unit 13 succeeds in detecting light in step S39, the flow returns to step S37. The processing of steps S37-S39 is repeated until one of the first to third light blocking areas 21*d*-21*f* in the seconds wheel 20 covers the detection position P. That is, when the detection unit 13 succeeds in light detection in step S39, one of the light-passing apertures 21*a*, the second light-passing aperture 28, one of the third light-passing apertures 29 and the fourth light-passing aperture 30 are happens to be aligned together at the detection position P.

It is supposed that the center wheel 25 is set at the reference position (00-minute position); however, the rotational positions of the seconds and hour wheels 20 and 27 are unknown. First, the position of the seconds wheel 20 is detected. Therefore, the processing of steps S37-S39 is repeated until one of the first to third light blocking areas 21*d*-21*f* in the seconds wheel 20 covers the detection position P and disables the detection unit 13 from detecting light.

When one of the first to third light blocking areas 21*d*-21*f* in the seconds wheel 20 comes to the detection position P and the detection unit 13 fails in detecting light in step S39, counting the number of times of detection failure is started and the non-detection flag bit is set to "1" (step S40). Then, it is determined whether or not the detection unit 13 fails in detecting light successively four times (step 41).

The processing of steps S37-S41 is repeated until the second light blocking area 21*e* in the seconds wheel 20 covers the detection position P and the number of times of detection failure in the detection unit 13 arrives at four times. When the detection unit 13 fails in detecting light successively four times, the seconds wheel 20 is rotated two steps (step S42), and the light emission element 31 is caused to emit light (step S43). Then, it is determined whether or not the light from the light emission element 31 is received by the photo detection element 32, that is, whether the detection unit 13 succeeds or fails in light detection (step S44).

When the detection unit 13 succeeds in light detection in step S44, it is determined that the center wheel 25 is located at the reference position (00-minute position) and the second light-passing aperture 28, one of the third light-passing apertures 29, and the circular aperture 21*a* are aligned together at the detection position P. Therefore, it is determined that the seconds wheel 20 and the center wheel 25 are set at the reference position (00-second 00-minute position), and then the flow goes to step S71 in the hour hand position detecting process to be described later.

When the detection unit 13 detects no light in step S44, the number of times of detection failure becomes five even though the circular aperture 21*a* in the seconds wheel 20 is positioned at the detection position P as shown in FIG. 14B. Thus, it is determined that one or more of the second to fourth light-passing apertures 28, 29 and 30 in the center, hour and intermediate wheels 25, 27 and 23 are offset from the detection position P, and the flow goes to step S45 in FIG. 22 to perform the center hand position detecting process.

As shown in FIG. 22, in the center hand position detecting process, the center wheel 25 is rotated one step (one degree) in step S45 and the light emission element 31 is caused to emit light (step S46). Then, it is determined whether or not the light from the light emission element 31 is received by the photo detection element 32, that is, whether or not the detection unit 13 succeeds in light detection (step S47). If not, the center wheel 25 is rotated one step at a time, and it is determined whether or not the seconds wheel 25 rotates 360 degrees in total (step S48). If not, processing of steps S45-S47 is repeated until the center wheel 25 is rotated 360 degrees.

When the detection unit 13 succeeds in detecting light in step S47, it is understood that one of the first light-passing apertures 21, the second and fourth light-passing apertures 28 and 30, and one of the third light-passing apertures 29 are aligned together at the detection position P. It is also understood that, before step S45, the apertures in the center and hour wheels 25 and 27 have been offset from the detection position P. Thus, it is determined that the center wheel 25 is now set at the reference position (00-minute position), and the flow returns to step S30 in FIG. 21 to confirm whether the seconds wheel 20 is positioned at the reference position.

However, even though the center wheel 25 rotates 360 degrees, when the detection unit 13 detects no light in step S47, it is considered that the first light-passing apertures 21 are out of the detection position P, as shown in FIG. 14D. The seconds wheel 20 is rotated 30 steps (180 degrees) (step S49), and the light emission element 31 emits light (step S50). Then, it is determined whether or not the light from the light emission element 31 is received by the photo detection element 32, i.e., whether or not the detection unit 13 succeeds in light detection (step S51).

When the detection unit 13 succeeds in detecting light in step S51, it is understood that one of the first light-passing apertures 21, the second and fourth light-passing apertures 28 and 30, and one of the third light-passing apertures 29 are aligned together at the detection position P, and that, before step S49, the first light-passing apertures 21 in the seconds wheel 20 have been away from the detection position P. It is determined that the center wheel 25 is set at the reference position (00-minute position), and then, the flow passes to step S30 in FIG. 21 to confirm whether or not the seconds wheel 20 is set at the reference position.

After the seconds wheel 20 is rotated 30 steps (180 degrees) in step S49, when the detection unit 13 detects no light in step S51, it is determined, as shown in FIG. 14E, that the second light-passing aperture 28 in the center wheel 25 is offset from the detection position P even though one of the first light-passing apertures 21 in the seconds wheel 20 is set at the detection position P. Then, the center wheel 25 is rotated one step (step S52).

The light emission element 31 is caused to emit light (step S53), and it is determined whether or not the light from the light emission element 31 is detected by the photo detection element 32, and hence whether or not the detection unit 13 succeeds in detecting light (step S54). If not, it is determined whether or not the center wheel 25 is rotated 360 degrees (step S55). If not, the processing of steps S52-S55 is repeated until the center wheel 25 rotates 360 degrees (one rotation).

When the detection unit 13 detects light in step S54, it is recognized that one of the first light-passing apertures 21 in the seconds wheel 20, the second and fourth light-passing apertures 28 and 30 in the center and intermediate wheels 25 and 23, and one of the third light-passing apertures 29 in the hour wheel 27 are aligned together at the detection position P. Also it is seen that, before step S52, the second light-passing aperture 28 in the center wheel 25 has been offset from the detection position P. It is determined that the center wheel 25 is now set at the reference position (00-minute position). Then, the flow goes to step S30 in FIG. 21 to confirm whether or not the seconds wheel 20 is set at the reference position.

After the center wheel 25 rotates 360 degrees (step S55), when the detection unit 13 detects no light in step S54, it is determined that the third light-passing apertures 29 in the hour wheel 27 are away from the detection position P and that the light blocking area 29*a* in the hour wheel 27 covers the detection position P even though one of the first light-passing apertures 21, and the second and fourth light-passing apertures 28 and 30 are aligned together at the detection position P, as shown in FIG. 11P.

It cannot be known whether any of the first light-passing apertures 21 in the second wheel 20 is located at the detection position P or not. Thus, the seconds wheel 20 is rotated 30 steps (180 degrees) (step S56), and the light emission element 31 is caused to emit light (step S57). It is determined whether or not the light from the light emission element 31 is received by the photo detection element 32, that is, whether or not the detection unit 13 succeeds in detecting light (step S58).

When the detection unit 13 succeeds in light detection, one of the first light-passing apertures 21, the second and fourth light-passing aperture 28 and 30, and one of the third light-passing apertures 29 are aligned together at the detection position P. The light blocking area 29*a* of the hour wheel 27 does not cover the detection position P. It can be seen that, before step S56, the first light-passing apertures 21 in the seconds wheel 20 have been offset from the detection position P. It is determined that the center wheel 25 is set at the reference position (00-minute position), and then, the flow goes to step S30 in FIG. 21 to confirm whether or not the seconds wheel 20 is set at the reference position.

When the detection unit 13 detects no light in step S58, it is determined that the fourth light blocking are 29*a* of the hour wheel 27 covers the detection position P as shown in FIG. 11P. The center wheel 25 is rotated one step (step S59), and the light emission element 31 is caused to emit light (step 60). Then, it is determined whether or not the light from the light emission element 31 is detected by the photo detection element 32, that is, whether or not the detection unit 13 succeeds in light detection (step S61). If not, it is determined whether or not the center wheel 25 is rotated 360 degrees in total (step S62). If not, the processing of steps S59-S61 is repeated until the center wheel 25 is rotated 360 degrees (one rotation).

When the detection unit 13 succeeds in detecting light in step S61, one of the first light-passing apertures 21, the second and fourth light-passing apertures 28 and 30, and one of the third light-passing apertures 29 are aligned together at the detection position P. In addition, the light blocking area 29*a* of the hour wheel 27 does not block the detection position P. It is determined that, before step S59, the second light-passing aperture 28 in the center wheel 25 has been away from the detection position P. It is determined that the center wheel 25 is now set at the reference position (00-minute position). Then, the flow returns to step S30 in FIG. 21 to confirm whether or not the seconds wheel 20 is set at the reference position.

After the center wheel 25 rotates 360 degrees (step S62), when the detection unit 13 detects no light in step S61, it is assumed that the detection position P is blocked by the fourth light blocking area 29*a* in the hour wheel 27, and that the hour wheel 27 is set at the 11-o'clock position. In order to confirm whether this assumption is correct or not, the seconds wheel 20 is rotated 30 steps (180 degrees) (step S63) and the light emission element 31 is caused to emit light (step S64). It is determined whether or not the light from the light emission element 31 is received by the photo detection element 32, that is, whether the detection unit 13 succeeds or fails in light detection (step S65).

When the detection unit 13 succeeds in detecting light, one of the first light-passing apertures 21 in the seconds wheel 20, the second and fourth light-passing apertures 28 and 30 in the center and intermediate wheels 25 and 23, and one of the third light-passing apertures 29 in the hour wheel 27 are aligned together at the detection position P. Thus, it is determined that, before step S63, the hour wheel 27 has not been set at the 11-o'clock position and the first light-passing apertures 21 in the seconds wheel 20 have been away from the detection position P. It is determined that the center wheel 25 is set at the reference position (00-minute position). Then the flow returns to step S30 in FIG. 21 to confirm whether or not the seconds wheel 20 is set at the reference position.

When the detection unit 13 detects no light in step S65, the fourth light blocking area 29*a* of the hour wheel 27 blocks the detection position P. The center wheel 25 is rotated one step (step S66), and the light emission element 31 is caused to emit light (step S67). It is determined whether or not the light from the light emission element 31 is received by the photo detection element 32, that is, whether or not the detection unit 13 succeeds in light detection (step S68).

When the detection unit 13 detects no light in step S68, it is determined whether or not the center wheel 25 rotates 360 degrees in total (step S69). If not, the processing of steps S66-S68 is repeated until the center wheel 25 rotates 360 degrees in total. Even though the processing of steps S66-S68 is repeated, when the detection unit 13 detects no light in step S69, a hand position detection error is reported by means of a stop position of the seconds hand 2 or buzzer sound (step S70). When the detection unit 13 detects light in step S68, it is determined that the hour and center wheels 27 and 25 are positioned at the reference position (0-o'clock 00-minute position).

Since it is unclear whether seconds wheel 20 is set at the reference position (00-second position) or not, the flow returns to step S30 of the seconds hand position detecting process to perform the processing of steps S30-S44. The seconds wheel 20 is rotated to the reference position (00-minute 00-second position). Then, the flow goes to step S71 in FIG. 23. Since the seconds and center wheels 20 and 25 are set at the reference position, the center wheel 25 is rotated 360 degrees and the hour wheel 27 is rotated 30 degrees in step S71. Then, the light emission element 31 is caused to emit light (step S72). It is determined whether or not the light from the light emission element 31 is received by the photo detection element 32, that is, whether the detection unit 13 succeeds or fails in light detection (step S73).

When the detection unit 13 detects light every time the hour wheel 27 rotates 30 degrees, it is determined that the third light-passing apertures 29 in the hour wheel 27 successively come to the detection position P and the hour wheel 27 is successively positioned at exact hour positions. Thus, the flow returns to step S71 and the processing of steps S71-S73 is repeated until the fourth light blocking area 29*a* at the 11-o'clock position in the hour wheel 27 covers the detection position P. When the detection unit 13 detects no light in step S73, it is determined that the fourth light blocking area 29*a* in the hour wheel 27 covers the detection position P and that the hour wheel 27 is set at the 11-o'clock position.

In order to confirm whether this determination is correct or not, the center wheel 25 is again rotated 360 degrees and the hour wheel 27 is rotated 30 degrees (step S74). Then, the light emission element 31 emits light (step S75). It is then determined whether or not the light from the light emission element 31 is received by the photo detection element 32, that is, whether or not the detection unit 13 succeeds in light detection (step S76).

When the detection unit 13 detects light, it is recognized that the seconds, center and hour wheels 20, 25 and 27 are set at the reference position (0-o'clock 00-minute 00-second position) (step S77). The seconds, center and hour hands 2, 3 and 4 are set to indicate the current time and then the normal driving operation is started. Thus, this process is terminated. It is assumed that the detection unit 13 necessarily detects light in step S76; however, if the detection unit 13 fails in light detection, a hand position detection error is reported by means of a stop position of the seconds hand 2 or buzzer sound (step S78).

Figure 24:
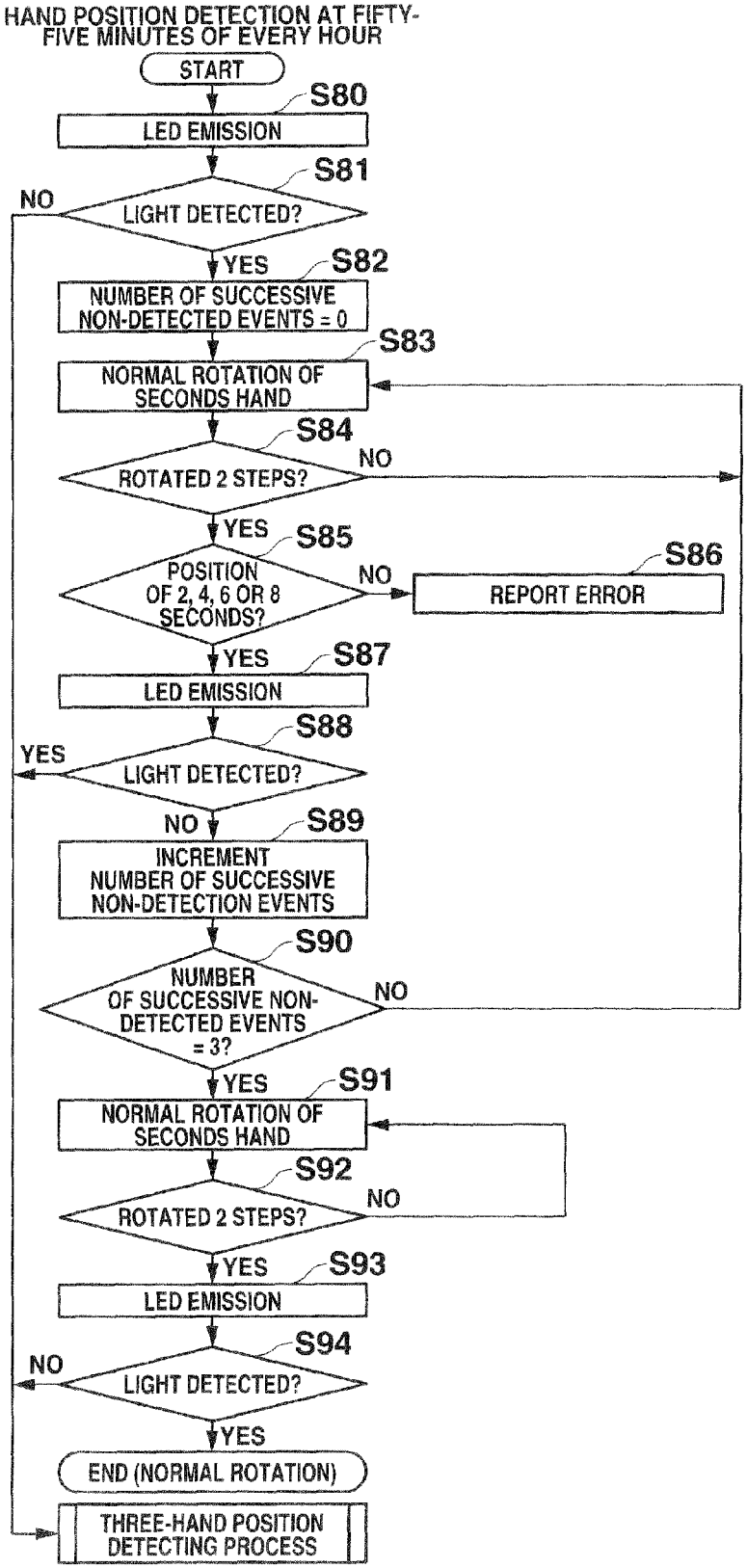
FIG. 24 is a flowchart of a hand position confirming process for confirming the positions of the seconds, center and hour hands every five minute before the hour in the normal hand rotating operation.

Then, referring to FIG. 24, description will be made on the hand position confirming process to confirm whether or not the seconds, center and hour hands 2, 3 and 4 are set correctly. The hand position confirming process is executed at every five minutes before the hour, that is, every 55 minutes past the hour in the normal hand rotating operation.

In the hand position confirming process, the detection unit 13 makes light detection at every 55 minutes after the hour, excluding ten fifty-five a.m. and ten fifty-five p.m.

The hand position confirming process may be executed at every hour on the hour; however, execution of the process may coincide with generation of a time/alarm signal or other various operations to be performed. Thus, it is preferable that the hand position confirming process is executed several minutes before the hour. The hour wheel 27 rotates one degree per 12 minutes; therefore, even when the execution of the process is made 10 minutes or so offset from the hour, one of the third light-passing apertures 29 is not completely moved away from the detection position P to allow the detection unit to detect light.

When the detection unit 13 detects light in the process, the hour hand 4 is regarded as being set correctly. Then, it is confirmed whether or not the seconds and center hands 2 and 3 are set correctly, and difference in the position of the center hand 3 less than 60 minutes can be confirmed. When 10 seconds elapses from the start of the process, the center wheel 25 is rotated one step and thus the intermediate wheel 23 rotates 30 degrees, thereby blocking the detection position P. It is necessary to confirm the difference in the position of the seconds hand 2 in ten seconds from the start of the process.

The hand position confirming process starts every 55 minutes past the hour excluding 10 o'clock and 22 o'clock. The light emission element 31 is caused to emit light (step S80). Then, it is determined whether or not the light from the light emission element 31 is received by the photo detection element 32, that is, whether or not the detection unit 13 succeeds in light detection (step S81). If not, it is determined that at least one of the seconds, center and hour hands 2, 3 and 4 is fast or slow and then the flow goes to the above-described three-hand position detecting process.

When the detection unit 13 succeeds in detecting light in step S81, it is determined that one of the first light-passing apertures 21 in the seconds wheel 20 is positioned at the detection position P. The number of times of detection failure counted previously is cleared and the non-detection flag is set to "0" (step S82). Then, the seconds wheel 20 is normally rotated one step (six degrees) and the seconds hand 2 is normally rotated around the dial (step S83). It is determined whether or not the seconds wheel 20 is rotated two steps (12 degrees) in total (step S84). Even when the seconds wheel 20 rotates only one step or six degrees, the circular aperture 21*a* in the seconds wheel 20 is not completely moved away from the detection position P; therefore, the detection 13 makes light detection each time the seconds wheel 20 rotates two steps.

When it is determined that the seconds wheel 20 is not rotated two steps in step S84, the seconds hand 2 is normally rotated by one step (six degrees). Every time the seconds wheel 20 is rotated two steps, it is determined whether or not the seconds hand 2 is set at any of positions of 2, 4, 6 and 8 seconds (step S85). Since the first stepping motor 17 may not operate correctly due to external factors such as external magnetic field, the seconds hand 2 may not indicate any of the positions of 2, 4, 6 and 8 seconds in step S85. In such a case, a hand position detection error is reported by means of a stop position of the seconds hand 2 and/or buzzer sound (step S86).

When it is determined in step S85 that the seconds hand 2 indicates one of the positions of 2, 4, 6 and 8 seconds without being influenced by the external factors such as the external magnetic field, the light emission element 31 of the detection unit 13 emits light (step S87). It is determined whether or not the light from the light emission element 31 is received by the photo detection element 32, that is, whether or not detection unit 13 succeeds in light detection (step S88). When the detection unit 13 detects light, one of the first light-passing apertures, i.e., the circular aperture 21*a*, first and second arcuate apertures 21*b* and 21*c* in the seconds wheel 20 is located at the detection position P. Hence it is determined that, before step S83, the seconds wheel 20 has not been set exactly. The flow goes to the three-hand position detecting process.

When the detection unit 13 detects no light in step S88, it is determined that one of the first to third light blocking areas 21*d*-21*f* of the seconds wheel 20 covers the detection position P as shown in FIG. 15B. The non-detection flag is set to "1" and counting the number of times of detection failure is started (step S89). Then, it is determined whether or not the detection unit 13 fails in detecting light successively three times (step S90). If not, the flow returns to step S83. The seconds hand 2 is rotated normally and the processing of steps S83-S90 is repeated.

When it is determined in step S90 that three times of detection failure are successively generated six seconds after 55 minutes past the hour as shown by a change from FIG. 15B to FIG. 15D, one of the first and second light blocking areas 21*d* and 21*e* covers the detection position P. The seconds wheel 20 is normally rotated one step (six degrees) and the seconds hand 2 normally sweeps around the dial (step S91). It is then determined whether or not the seconds wheel 20 is rotated two steps in total (step S92). If not, the seconds hand 2 is normally rotated until the seconds wheel 20 rotates two steps in total.

When the seconds wheel 20 rotates two steps, the light emission element 31 is caused to emit light (step S93). It is determined whether or not the light from the light emission element 31 is received by the photo detection element 32, that is, whether or not the detection unit 13 succeeds in light detection at eight seconds and 55 minutes after the hour (step S94).

When the detection unit 13 detects no light, it is determined that the second light blocking area 21*e* covers the detection position P and that the seconds wheel 20 is not set at the correct rotational position. Thus, the flow goes to the three-hand position detecting process. When the detection unit 13 detects light in step S94, the second arcuate aperture 21*b* in the seconds wheel 20 covers the detection position P as shown in FIG. 15E. Thus, it is determined that the seconds wheel 20 has been set at its correct rotational position. Then, the operation is switched over to the normal rotating operation. Then, this process is terminated.

As described above, according to the hand position detecting device in the hand type wristwatch 1, the direction of the drive current supplied to the coil 17*a* of the first stepping motor 17 is changed alternately per pulse, and the direction of the magnetic field generated in the stator 17*b* is also alternately changed. The rotor 17*c* rotates 180 degrees per step to drive rotation of the seconds hand 2. At a position of an even-numbered second, i.e., at every other second, the detection unit 13 detects the first light-passing apertures 21 in the seconds wheel. At the time of the detection, a hand position detection controlling section (CPU 35; steps S5-S16 and S34-S44) reads current supply state identification data stored in the register 35*a* which is a data memory. The detection unit 13 detects the position of the seconds wheel 20 in accordance with the read current supply state identification data under the control of the hand position detection controlling section. Therefore, the rotational position of the seconds hand 2 is detected with high accuracy and simple structure without erroneous detection. In addition, power consumption can be reduced.

That is, the current supply state identification data ("0" or "1") indicates the state of the drive current previously supplied to the terminal A, that is a winding start, and the terminal B, that is a winding end, of the coil 17*a*. The current supply sate identification data is stored in the register 35*a* which is the data memory. At the time of detecting the rotational position of the seconds hand 2, the hand position detection controlling section (CPU 35; steps S5-S16 and S34-S44) reads the identification data from the register 35*a*. When the read identification data is "0" which is indicative of a drive current supply state corresponding to the previously determined polarity of the stator 17*b*, the hand position detection controlling section controls the detection unit 13 to detect the rotational position of the seconds wheel 20. Therefore, when detecting the rotational position of the seconds hand 2, even though the seconds hands 2 is stopped at a position which is shifted by one second from a proper position, the detection unit 13 is driven at every two steps to detect the rotational position of the seconds hand 2 without an error. Thus, the position of the seconds wheel 20 can be detected with simple structure and high accuracy. In addition, the power consumption can be reduced.

When the data stored in the register 35*a* is not "0" but "1", the hand position detection controlling section (CPU 35; steps S5-S16 and S34-S44) does not cause the detection unit 13 to detect the position of the seconds hand 2. However, the hand position detection controlling section drives rotation of the first stepping motor 17 by one step to rotate the seconds hand 2 one step via the seconds wheel 20, and the identification data is changed to "0" that indicates the drive current supply state to the coil 17*a* corresponding to the previously determined polarity of the stator 17*b*. Therefore, in the case where the position of the seconds hands 2 is shifted by one step due to an external factor such as switch operation made by a user, a shock or a magnetic field, when a pulse to drive the seconds hand 2 is output, the seconds hand 2 is not rotated at this point. However, the subsequent pulse rotates the seconds hand 2. Accordingly, the detection unit 13 detects the position of the seconds wheel 20 necessarily at every two steps and the position of the seconds wheel 20 can be detected correctly.

According to the hand position detecting device, the first light-passing apertures 21 in the seconds wheel 20 includes the circular aperture 21*a*, which is provided at the reference point (00-second point) in the seconds wheel 20, the first arcuate aperture 21*b*, which ranges from an 8-second point to a 28-second point in the seconds wheel 20, and the second arcuate aperture 21*c*, which ranges from a 32-second point to a 50-second point in the seconds wheel 20. The seconds wheel 20 also includes the first to third light blocking areas 21*d*-21*f* between the apertures 21*a*-21*c*. Therefore, the detection unit 13 can accurately detect the rotational position of the seconds wheel 20 at every two steps or every even-numbered second.

Second Embodiment

Next, referring to FIG. 25, the second embodiment of the hand position detecting device applied to the hand type wrist watch will be described. The same portions as those of the first embodiment will be indicated in the same reference numerals.

Figure 25:
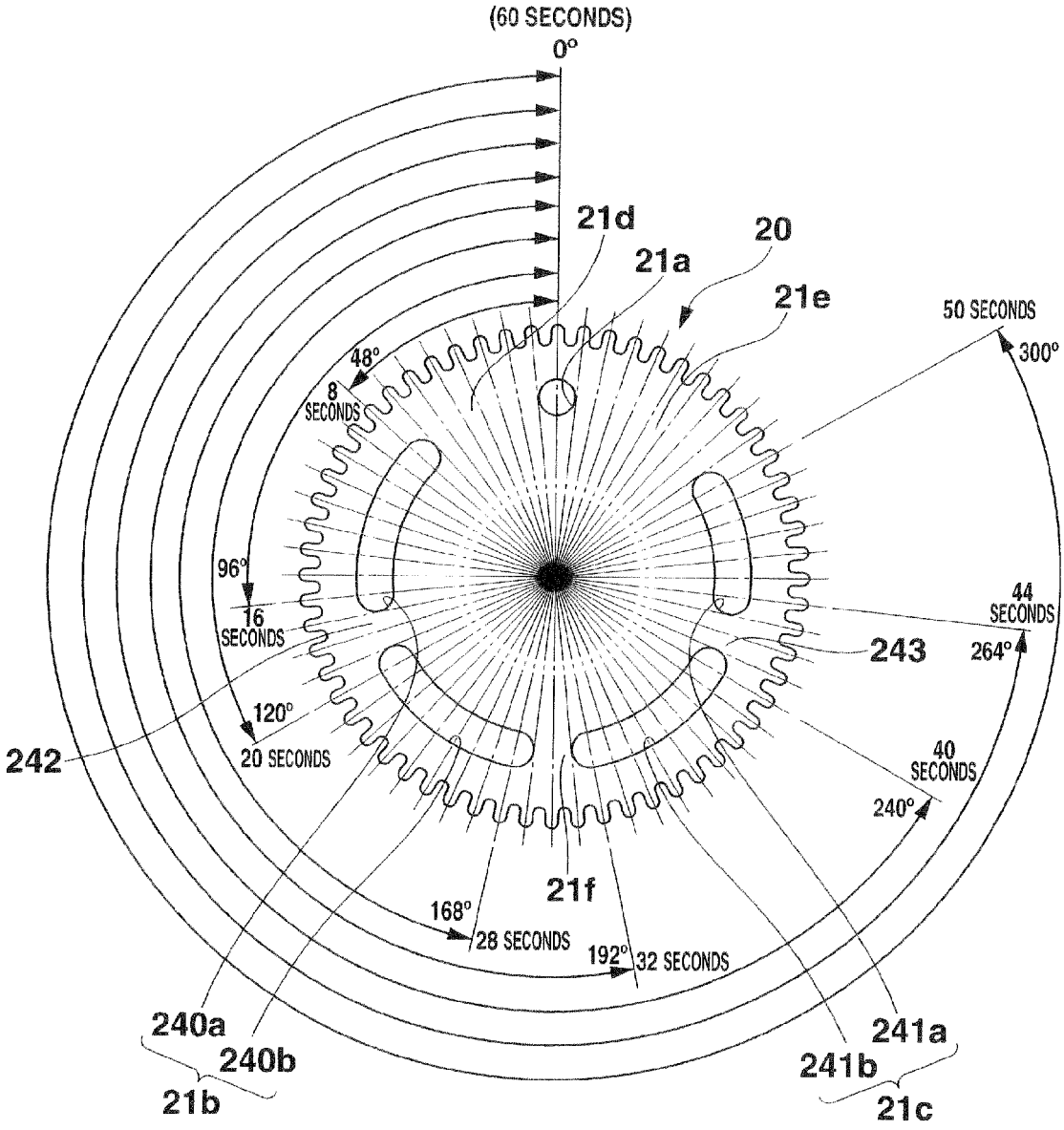
FIG. 25 is an enlarged plan view showing the seconds wheel according to a second embodiment of the hand type wristwatch.

As shown in FIG. 25, the hand position detecting device according to the second embodiment has such a configuration that the first arcuate aperture 21*b* is divided into two arcuate apertures 240*a* and 240*b*, and the second arcuate aperture 21*c* is divided into two arcuate apertures 241*a* and 241*b*. The rest of configuration is similar to the first embodiment.

The arcuate aperture 240*a* which is next to the circular aperture 21*a* is formed between 48 and 96 degrees (8-second point to 16-second point) from the center of the circular aperture 21*a* in the counterclockwise direction. The arcuate aperture 240*a* has a width corresponding to substantially 60 degrees that is five times longer than the diameter of the circular aperture 21*a*. The arcuate aperture 240*b* is formed between 120 and 168 degrees (20-second point and 28-second point) from the center of the circular aperture 21*a* in the counterclockwise direction. The arcuate aperture 240*b* has a width corresponding to substantially 60 degrees that is five times longer than the diameter of the circular aperture 21*a*. A fifth light blocking area 242 is formed between the arcuate apertures 40*a* and 40*b*. The fifth light blocking area 242 is diametrically opposed to a part of the arcuate aperture 241*a*.

The arcuate aperture 241*a* which is next to the circular aperture 21*a* is formed between 60 and 96 degrees (50-second point to 44-second point) from the center of the circular aperture 21*a* in the clockwise direction. The arcuate aperture 241*a* has a width corresponding to substantially 48 degrees that is four times longer than the diameter of the circular aperture 21*a*. The arcuate aperture 41*b* is formed between 120 degrees and 168 degrees (40-second point to 32-second point) from the center of the circular aperture 21*a* in the clockwise direction. The arcuate aperture 241*b* has a width corresponding to substantially 60 degrees that is five times longer than the diameter of the circular aperture 21*a*. A sixth light blocking area 243 is formed between the arcuate apertures 241*a* and 241*b*. The sixth light blocking area 243 is diametrically opposed to a part of the arcuate aperture 241*a*.

The arcuate aperture 240*a* is spaced from the circular aperture 21*a* by the first light blocking area 21*d*. The arcuate aperture 241*a* is also spaced from the circular aperture 21*a* by the second light blocking area 21*e*. The third light blocking area 21*f* is formed between the arcuate apertures 240*b* and 241*b* and diametrically opposed to the circular aperture 21*a*.

The first light blocking area 21*d* is formed between 0 and 48 degrees from the center of the circular aperture 21*a*. The first light blocking area 21*d* has a width corresponding to substantially 36 degrees that is three times longer than the diameter of the circular aperture 21*a*. The first light blocking area 21*d* is diametrically opposed to the arcuate aperture 241*b*. The second light blocking area 21*e* is formed between 0 degree and 60 degrees from the center of the circular aperture 21*a*. The second light blocking area 21*e* has a width corresponding to substantially 48 degrees that is four times longer than the diameter of the circular aperture 21*a*. The second light blocking area 21*e* is diametrically opposed to the arcuate aperture 240*b*. The third, fifth and sixth light blocking areas 21*f*, 242 and 243 have the almost same size as the circular aperture 21*a*.

Thus configured seconds wheel 20 includes the circular aperture 21*a* and four arcuate apertures 240*a*, 240*b*, 241*a* and 241*b* at points of even-numbed seconds (points of even-numbered steps). Therefore, similarly to the first embodiment, the detection unit 13 can detect the position of the seconds wheel at very two steps. In addition, in the case where one of the first to third, fifth and sixth light blocking areas 21*d*-21*f*, 242 and 243 is positioned at the detection position P of the detection unit 13, when the seconds wheel 20 is rotated 30 steps (180 degrees), one of the circular aperture 21*a* and the arcuate apertures 240*a*, 240*b*, 241*a* and 241*b* is necessarily located at the detection position P. Thus, similarly to the first embodiment, hand position detection can be simplified.

That is, according to the hand position detecting device which uses the seconds wheel 20 thus configured, the direction of the drive current supplied to the coil 17*a* of the first stepping motor 17 is changed alternately per pulse, and the direction of the magnetic field generated in the stator 17*b* is also alternately changed. The rotor 17*c* rotates 180 degrees per step to drive rotation of the seconds hand 2. At a position of an even-numbered second, i.e., at every other second, the detection unit 13 detects the first light-passing apertures 21 in the seconds wheel 20. At the time of the detection, the hand position detection controlling section (CPU 35; steps S5-S16 and S34-S44) reads current supply state identification data stored in the register 35*a* which is a data memory. The detection unit 13 detects the position of the seconds wheel 20 in accordance with the read current supply state identification data under the control of the hand position detection controlling section. Therefore, the rotational position of the seconds hand 2 is detected with high accuracy and simple structure without erroneous detection. In addition, power consumption can be reduced.

The current supply state identification data ("0" or "1") indicates the state of the drive current previously supplied to the terminal A, that is a winding start, and the terminal B, that is a winding end, of the coil 17*a*. The current supply state identification data is stored in the register 35*a* which is the data memory. At the time of detecting the rotational position of the seconds hand 2, the hand position detection controlling section (CPU 35; steps S5-16 and S34-S44) reads the identification data from the register 35*a*. When the read identification data is "0" which is indicative of a drive current supply state corresponding to the previously determined polarity of the stator 17*b*, the hand position detection controlling section controls the detection unit 13 to detect the rotational position of the seconds wheel 20. Therefore, similarly to the first embodiment, when detecting the rotational position of the seconds hand 2, even though the seconds hand 2 is stopped at a position which is shifted by one second from a proper position, the detection unit 13 is driven at every two steps to detect the rotational position of the seconds hand 2 without an error. Thus, the seconds wheel 20 can be detected with simple structure and high accuracy. In addition, the power consumption can be reduced.

When the data stored in the register 35*a* is not "0" but "1", the hand position detection controlling section (CPU 35; steps S5-S16 and S34-S44) does not cause the detection unit 13 to detect the position of the seconds hand 2 at this time. The hand position detection controlling section drives rotation of the first stepping motor 17 by one step to rotate the seconds hand 2 one step via the seconds wheel 20, and the identification data is changed to "0" that indicates the drive current supply state to the coil 17*a* corresponding to the previously determined polarity of the stator 17*b*. Therefore, in the case where the position of the seconds hands 2 is shifted by one step due to an external factor such as switch operation made by a user, a shock or a magnetic field, when a pulse to drive the seconds hand 2 is output, the seconds hand 2 is not rotated at this point. However, the subsequent pulse rotates the seconds hand 2. Accordingly, the detection unit 13 detects the position of the seconds wheel 20 necessarily at every two steps and the position of the seconds wheel 20 can be detected correctly.

According to the hand position detecting device, the first light-passing apertures 21 in the seconds wheel 20 include the circular aperture 21*a*, which is provided at the reference point (00-second point), the first arcuate aperture 40*a*, which ranges from an 8-second point to a 16-second point, the second arcuate aperture 40*b*, which ranges from a 20-second point to a 28-second point, the arcuate aperture 241*a*, which ranges from a 44-second point to a 50-second point, and the arcuate aperture 241*b*, which ranges from a 32-second point to a 40-second point. The seconds wheel 20 also includes the first to third, fifth and sixth light blocking areas 21*d*-21*f*, 242 and 243 between the apertures 21*a*, 240*a*, 240*b*, 241*a* and 241*b*. Therefore, similarly to the first embodiment, the detection unit 13 can accurately detect the rotational position of the seconds wheel 20 at every two steps or every even-numbered second.

First Modification

In the second embodiment, it is described that the detection unit 13 detects the position of the seconds wheel 20 at every two steps. However, the invention is not limited to the embodiments. For example, as described in the first modification shown in FIGS. 26 and 27, the reference position (00-second position) of the seconds hand 2 may be detected as follows, that is, first, the seconds wheel 20 is rotated two steps at a time; and after the detection unit 13 succeeds in light detection, the seconds wheel 20 is rotated eight steps at a time.

Figure 26:
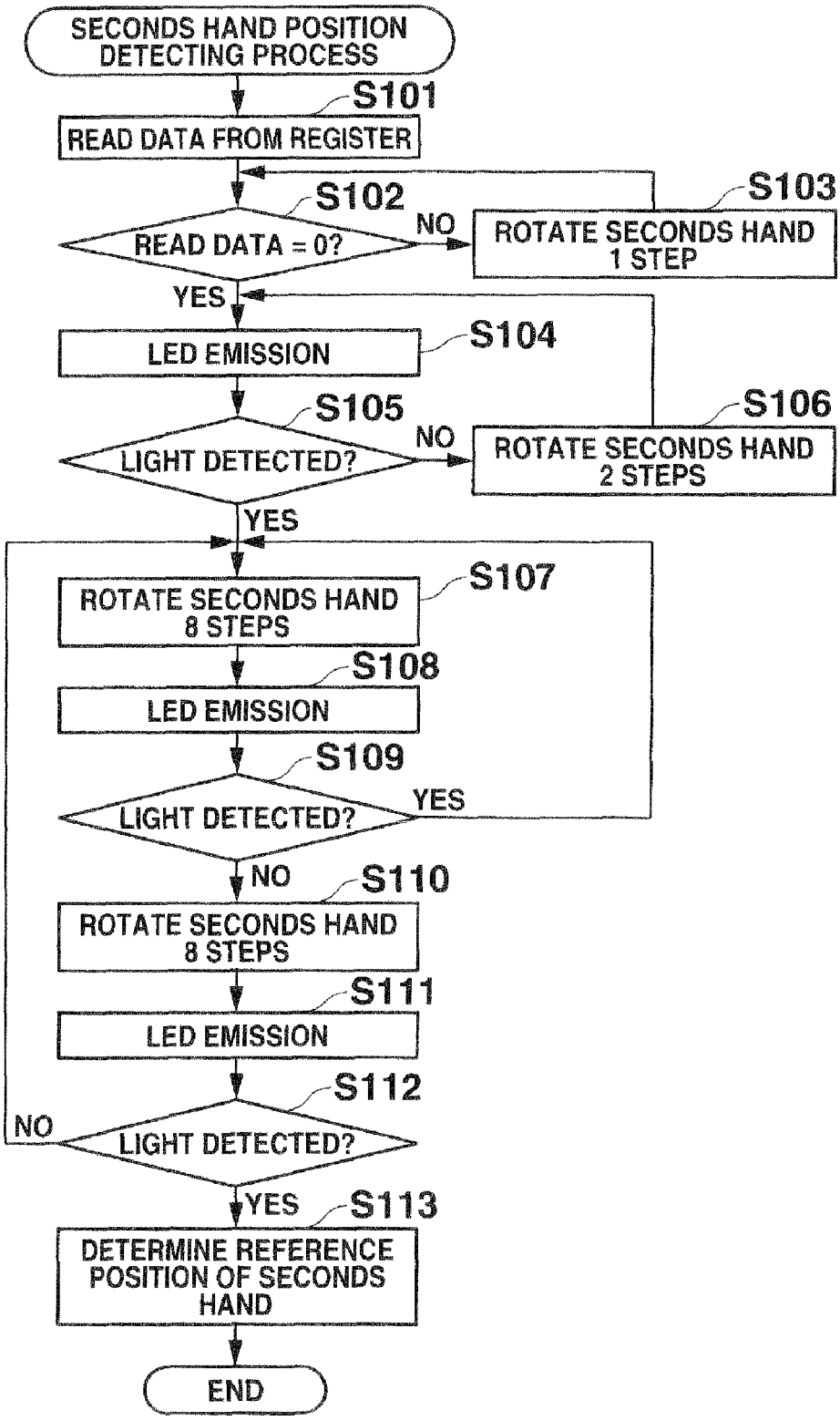
FIG. 26 illustrates a flowchart of a seconds hand position detecting process for the seconds wheel of FIG. 25 according to a first modification.

That is, in the first modification, when the hand position detecting process shown in FIG. 26 is started, the data previously stored in the register 35*a* ("0" shown in FIG. 17A or "1" shown in FIG. 17B) is read (step S101). It is determined whether the data read from the register 35*a*, i.e., the data indicative of the previous drive current supply state to the coil 17*a* is "0", which indicates the polarity of the stator 17*b* and corresponds to the data stored in the ROM 36, or "1", which indicates the opposite polarity (step S102).

When the read data is "0", that is, when the positive (+) current has been supplied to the terminal A of the coil 17*a* and the negative current (−) has been supplied to the terminal B as shown in FIG. 17A, the polarity of the stator 17*b* has accorded with the previously determined polarity. Therefore, the left part of the stator 17*b* is N-polarized and the right part of the stator 17*b* is S-polarized.

Thus, when it is determined in step S102 that the data read from the register 35*a* is "0", the light emission element 31 emits light (step S104). It is determined whether or not the light from the light emission element 31 is received by the photo detection element 32, namely, whether the detection unit 13 succeeds or fails in light detection (step S105).

On the other hand, when the read data is not "0" that is indicative of the drive current supply state corresponding to the previously determined polarity but "1" that is indicative of the opposite polarity, the current supplied to the coil 17*a* is reversed and data stored in the register 35*a* is changed from "1" to "0", thereby rotating the rotor 17*c* 180 degrees (half rotation) and rotating the seconds wheel 20 one step (step S103).

When the first light-passing apertures 21 in the seconds wheel 20 (i.e., circular aperture 21*a*, arcuate apertures 240*a*, 240*b*, 241*a*, and 241*b*) are away from the detection position P of the detection unit 13, the photo detection element 32 receives no light from the light emission element 31 and it is determined in step S105 that the detection unit 13 fails in light detection. The seconds wheel 20 is rotated two steps at a time (step S106) until one of the first circular apertures 21 comes to the detection position P.

When one of the fist light-passing apertures 21 comes to the detection position P and the photo detection element 32 receives light from the photo emission element 31, it is determined that the detection unit 13 succeeds in light detection. The seconds wheel 20 is rotated eight steps (step S107). The light emission element 31 emits light (step S108), and it is determined whether or not the light from the light emission element 31 is received by the photo detection element 32, namely, whether the detection unit 13 succeeds or fails in light detection (step S109).

When one of the first light-passing apertures 21 is positioned at the detection position P and the detection unit 13 succeeds in light detection, the seconds wheel 20 is rotated by eight steps at a time until one of the first to third, fifth and sixth light blocking areas 21*d*-21*f*, 242 and 243 covers the detection position P and the detection unit 13 fails in light detection.

When one of the first to third, fifth and sixth light blocking areas 21*d*-21*f*, 242 and 243 covers the detection position P and the detection unit 13 fails in light detection, the seconds wheel 20 is rotated eight steps (step S110). The light emission element 31 emits light (step S111) and it is determined whether or not the light from the light emission element 31 is received by the photo detection element 32, namely, whether the detection unit 13 succeeds or fails in light detection (step S112).

If not, the flow returns to step S107, and the processing of steps S107-S112 is repeated. Then, when the detection unit 13 succeeds in light detection in step S112, it is determined that the circular aperture 21*a* in the seconds wheel 20 is located at the detection position P and the seconds wheel 20 is set at the reference position (00-second position) (step S113). Thereafter, the normal hand rotating operation is started and this process is terminated.

In the first modification, as described above, so as to detect the reference position (00-second position) of the seconds hand 2, the seconds wheel 20 is rotated two steps at a time, and after the detection unit 13 succeeds in light detection, the seconds wheel 20 is rotated eight steps at a time. Accordingly, in comparison with the first and second embodiments, the number of times of detection made by the detection unit 13 can be significantly decreased, and power consumption can be reduced. For example, as shown in FIG. 27, when the detection unit 13 first succeeds in light detection at a position of 44 seconds, the total number of times of detection is only three times. In comparison, in the case where the detection is made at every two steps, the total number of times of detection is eight times. Thus, the number of times of detection made by the detection unit 13 can be largely decreased.

Second Modification

Figure 28:
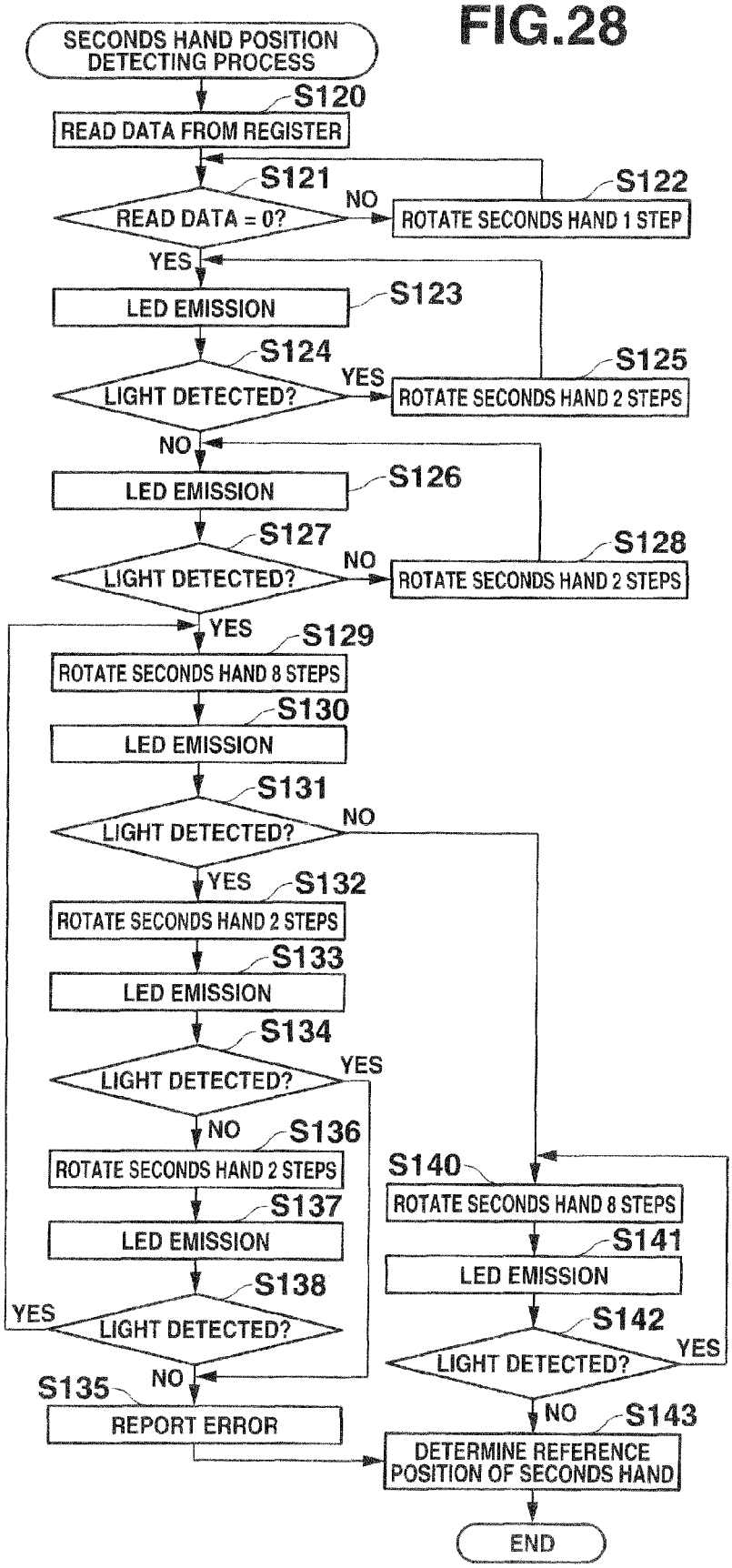
FIG. 28 illustrates a flowchart of a seconds hand position detecting process for the seconds wheel of FIG. 25 according to a second modification.

For example, as shown in FIGS. 28 and 29, a timing at which the detection unit 13 detects the reference position (00-second position) of the seconds wheel 20 may be set based on a combination of the two-step rotation and eight-step rotation of the seconds wheel 20. That is, in the second modification, as shown in FIG. 28, when the seconds hand position detecting process is started, data previously stored in the register 35*a* ("0" shown in FIG. 17A or "1" shown in FIG. 17B) is read (step S120).

It is determined whether the data read from the register 35*a*, i.e., the data indicative of the previous drive current supply state to the coil 17*a* is "0", which indicates the polarity of the stator 17*b* and corresponds to the data stored in the ROM 36, or "1", which indicates the opposite polarity (step S121).

When the read data is "0", that is, when the positive (+) current has been supplied to the terminal A of the coil 17*a* and the negative current (−) has been supplied to the terminal B as shown in FIG. 17A, the polarity of the stator 17*b* has accorded with the previously determined polarity. Therefore, the left part of the stator 17*b* is N-polarized and the right part of the stator 17*b* is S-polarized.

Thus, when it is determined in step S121 that the data read from the register 35*a* in step S120 is "0", the light emission element 31 emits light (step S123). It is determined whether or not the light from the light emission element 31 is received by the photo detection element 32, namely, whether the detection unit 13 succeeds or fails in light detection (step S124).

On the other hand, when the read data is not "0" that is indicative of the drive current supply state corresponding to the previously determined polarity but "1" that is indicative of the opposite polarity, the current supplied to the coil 17*a* is reversed and data stored in the register 35*a* is changed from "1" to "0", thereby rotating the rotor 17*c* 180 degrees (half rotation) and rotating the seconds wheel 20 one step (step S122).

When one of the fist light-passing apertures 21 (i.e., circular aperture 21*a*, arcuate apertures 240*a*, 240*b*, 241*a*, and 241*b*) comes to the detection position P and the photo detection element 32 receives light from the photo emission element 31 in step S124, the seconds wheel 20 is rotated two steps at a time (step S125) until the first circular apertures 21 are located away from the detection position P and the detection unit 13 fails in light detection.

When the detection unit 13 fails in light detection, the light emission element 31 emits light (step S126) and it is determined whether the detection unit 13 succeeds or fails in light detection (step S127). Here, the detection unit 14 fails in light detection first; therefore, the seconds wheel 20 is rotated two steps at a time (step S128) until one of the first light-passing apertures 21 (i.e., circular aperture 21*a*, arcuate apertures 240*a*, 240*b*, 241*a*, and 241*b*) comes to the detection position P allowing the photo detection element 32 to detect light from the light emission element 31 and the detection unit 13 succeeds in light detection.

When the detection unit 13 succeeds in light detection in step S127, the seconds wheel 20 is rotated eight steps (step S129). The light emission element 31 is caused to emit light (step S130), and it is determined whether the detection unit succeeds or fails in light detection (step S131). The detection unit 13 is supposed to succeeds in light detection excepting a position of 52 seconds shown in FIG. 29; thus, when the detection unit 13 fails in light detection, it is determined that the current position is the 52-second position and the flow goes to step S140 to be described later.

When the detection unit 13 succeeds in light detection in step S131, the seconds wheel 20 is rotated two steps (step S132). The light emission element 31 emits light (step S133) and it is determined whether the detection unit 13 succeeds or fails in light detection (step S134). Here, it is supposed that the first light passing apertures 21 in the seconds wheel 20 are away from the detection position P and the detection unit 13 fails in light detection; however, if the detection unit 13 succeeds in light detection, a detection error is reported (step S135) and the flow is terminated.

When the detection unit 13 detects no light in step S134, the seconds wheel 20 is rotated two steps (step S136). The light emission element 31 emits light (step S137), and it is determined whether or not the light from the light emission element 31 is received by the photo detection element 32; namely, whether the detection unit 13 succeeds or fails in light detection (step S138). Here, it is assumed that the detection unit 13 necessarily succeeds in light detection; however, if the detection unit 13 fails in light detection, a detection error is reported (step S135), and the flow is terminated.

When the detection unit 13 succeeds in light detection in step S138, it is determined that one of the arcuate apertures 240*a*, 240*b*, 241*a* and 241*b* is positioned at the detection position P. The flow returns to step S129, and the processing of steps S129-S138 is repeated. When the detection unit 13 detects no light in step S131, the current position is determined to be the 52-second position shown in FIG. 29, and the seconds wheel 20 is rotated eight steps (step S140). The light emission element 31 emits light (step S141) and it is determined whether the detection unit 13 succeeds or fails in light detection (step S142).

When the detection unit 13 succeeds in detecting light, the circular aperture 21*a* is positioned at the detection position P. Therefore, it is recognized that the seconds wheel 20 is set at the reference position (00-second position) (step S143), and this process is terminated. When the detection unit 13 detects no light in step S142, a detection error is reported (step S135) and the flow is terminated.

As described above, in the second modification, the detection unit 13 makes light detection at a timing which is set based on the combination of the two-step rotation and eight-step rotation of the seconds wheel 20. In the case where the seconds wheel 20 is rotated eight steps from a time point at which the detection unit 13 succeeds in light detection, when the detection unit 13 detects no light, the seconds wheel 20 is again rotated eight steps. Then, when the detection unit 13 succeeds in light detection, this position of the seconds wheel 20 is determined to be the reference position (00-second position). The number of times of light detection can be largely decreased in comparison with the first and second embodiments. Thus, the power consumption can be reduced significantly.

Third Modification

Figure 30:
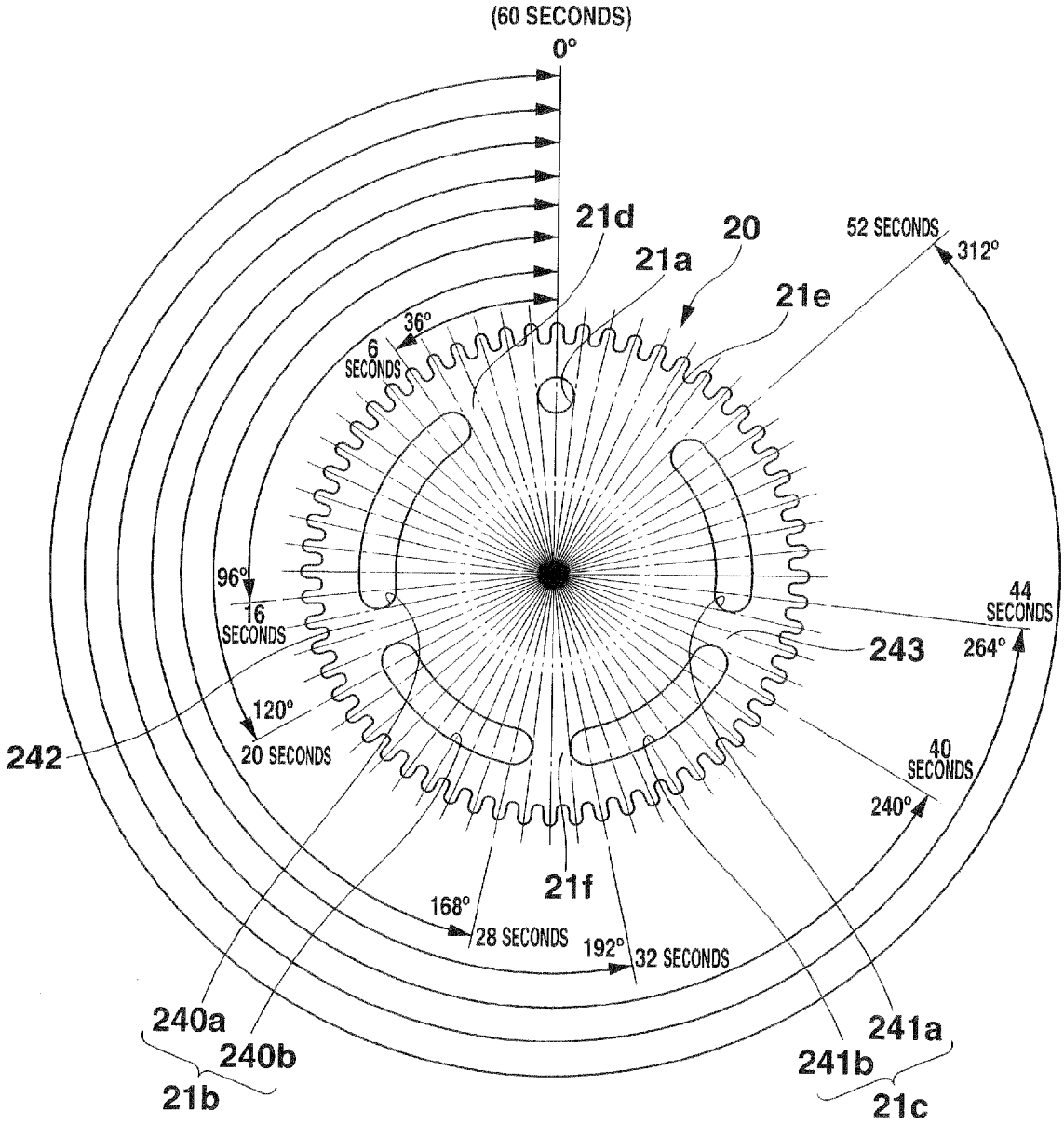
FIG. 30 is enlarged plan view showing a seconds wheel according to the third modification.

In the above described first and second embodiments and modifications thereof, the first light blocking area 21*d* is formed between the circular aperture 21*a* and the first arcuate aperture 21*b* (or arcuate aperture 40*a*) and has the width (substantially 36 degrees) that is three times longer than the diameter of the circular aperture 21*a*, and the second light blocking area 21*e* is formed between the circular aperture 21*a* and the second arcuate aperture 21*c* (or arcuate aperture 41*a*) and has the width (substantially 48 degrees) that is four times longer than the diameter of the circular aperture 21*a*. However, the invention is not so limited. The apertures may be configured as shown in FIG. 30.

According to the third modification, the first light blocking area 21*d* is formed between 0 and 36 degrees from the center of the circular aperture 21*a* in the counterclockwise direction. The first light flocking area 21*d* ranges to a 6-second point (substantially 36 degrees) and has a width corresponding to 24 degrees that is two times longer than the diameter of the circular aperture 21*a*. The second light blocking area 21*e* is formed between 0 and 48 degrees from the center of the circular aperture 21*a* in the clockwise direction. The second light blocking area 21*e* ranges to a 52-second point (substantially 48 degrees) and has a width corresponding to 36 degrees that is three times longer than the diameter of the circular aperture 21*a*.

Similarly to the first modification, the first arcuate aperture 21*b* is divided into two arcuate apertures 240*a* and 240*b*. The fifth light blocking area 242 is formed between the arcuate apertures 240*a* and 240*b*. The arcuate aperture 240*a* which is next to the circular aperture 21*a* is formed between 36 and 96 degrees (6-second point and 16-second point) from the center of the circular aperture 21*a* in the counterclockwise direction. The arcuate aperture 240*a* has a width that is expended toward the circular aperture 21*a* by the diameter of the circular aperture 21*a* in comparison with the first modification.

Similarly to the first modification, the second arcuate aperture 21*c* is divided into two arcuate apertures 241*a* and 241*b*. The sixth light blocking area 243 is formed between the arcuate apertures 241*a* and 241*b*. The arcuate aperture 241*a* which is next to the circular aperture 21*a* is formed between 264 and 312 degrees (44-second point and 52-second point) from the center of the circular aperture 21*a* in the counterclockwise direction. The arcuate aperture 241*a* has a width that is expended toward the first circular aperture by the diameter of the circular aperture 21*a* in comparison with the first modification.

The first light blocking area 21*d* is formed between the circular aperture 21*a* and the arcuate aperture 240*a* and diametrically opposed to the arcuate aperture 241*b*. The second light blocking area 21*e* is formed between the circular aperture 21*a* and the arcuate aperture 241*a* and diametrically opposed to the arcuate aperture 240*b*. The third, fifth and sixth light blocking areas 21*f*, 242 and 243 are diametrically opposed to the circular aperture 21*a* and the arcuate apertures 241*a* and 240*a*, respectively.

In the third modification, the direction of the drive current supplied to the coil 17*a* of the first stepping motor 17 is changed alternately per pulse, and the direction of the magnetic field generated in the stator 17*b* is also alternately changed. The rotor 17*c* rotates 180 degrees per step to drive rotation of the seconds hand 2. At a position of an even-numbered second, i.e., at every other second, the detection unit 13 detects the first light-passing apertures 21 in the seconds wheel 20. At the time of the detection, the hand position detection controlling section (CPU 35; steps S5-S16 and S34-S44) reads current supply state identification data stored in the register 35*a* which is a data memory. The detection unit 13 detects the position of the seconds wheel 20 in accordance with the current supply state identification data under the control of the hand position detection controlling section. Therefore, the rotational position of the seconds hand 2 is detected with high accuracy and simple structure without erroneous detection similarly to the first and second embodiments and modifications thereof. In addition, power consumption can be reduced.

In the above first and second embodiments and modifications thereof, the circular aperture 21*a*, and the first and second arcuate apertures 21*b* and 21*c* or the arcuate apertures 240*a*, 240*b*, 241*a* and 241*b* are provided in the seconds wheel 20. The first to third light blocking areas 21*d*-21*f* or the first to third, fifth and sixth light blocking areas 21*d*-21*f*, 242 and 243 are provided between the apertures. However, the invention is not so limited. The seconds wheel 20 may be made of transparent synthetic resin such as acrylic resin and the first to third light blocking areas 21*d*-21*f* or the first to third, fifth and sixth light blocking areas 21*d*-21*f*, 242 and 243 may be printed on the surface of the wheel 20.

In addition, the seconds wheel 20 need not necessarily include the first to third light blocking areas 21*d*-21*f*, or the first to third, fifth and sixth light blocking areas 21*d*-21*f*, 242 and 243. The seconds wheel 20 may be configured to include the circular aperture 21*a* and light blocking areas next to the circular aperture 21*a* in clockwise and counterclockwise directions. As configured thus, when the detection unit 13 succeeds in light detection two steps after light detection is blocked by the light blocking area, it can be determined that the current position of the seconds wheel is the reference position (00-second position). Therefore, the reference position of the seconds hand 2 can be immediately detected and the positions of the center and hour hands 3 and 4 can be readily detected.

In addition, in the above first and second embodiments and modifications thereof, current supply state identification data which is indicative of the state of the drive current previously supplied to the terminal A, that is a winding start, and the terminal B, that is a winding end, of the coil 17*a* is stored in the register 35*a*, which is the data memory. The hand position detection controlling section (CPU 35) reads the drive current supply state identification data stored in the register 35*a*. The hand position detection controlling section drives the detection unit 13 to detect the position of the seconds wheel 20 in accordance with the identification data. However, the invention is not so limited. The state of the drive current previously supplied to the coil 17*a* of the first stepping motor 17 may be recognized by a drive current recognition section (CPU 35), and based on the recognition result made by the drive current recognition section, the hand position detection controlling section may drive the detection unit 13 and control the detection for the position of the seconds wheel 20.

In the case where a detection element to detect a polarity of the rotor 17*c* and a detection circuit to detect the drive current supply state to the coil 17*a* are provided as the section to determine the drive current supply state to the coil 17*a* of the first stepping motor 17, the drive current recognition section can recognize the drive current supply state, and the hand position detection controlling section can drive the detection unit 13 to detect the position of the seconds wheel 20.

In addition, in the above first and second embodiments and modifications thereof, the hand position detection device is applied to the hand type wristwatch 1. However, the hand position detection device may be employed by various types of hand type timepiece such as a travel watch, alarm watch, standing clock, and wall clock.

While the description above refers to particular embodiments and modifications of the present invention, it will be understood that many modifications may be made without departing from the spirit thereof. The accompanying claims are intended to cover such modifications as would fall within the true scope and spirit of the present invention. The presently disclosed embodiments and modifications are therefore to be considered in all respects as illustrative and not restrictive, the scope of the invention being indicated by the appended claims, rather than the foregoing description, and all changes that come within the meaning and range of equivalency of the claims are therefore intended to be embraced therein. For example, the present invention can be practiced as a computer readable recording medium in which a program for allowing the computer to function as predetermined means, allowing the computer to realize a predetermined function, or allowing the computer to conduct predetermined means.

What is claimed is:

1. A hand position detecting device comprising:

a hand wheel including at least a first light transmitting portion provided at a reference point and second and third light transmitting portions spaced from the first light transmitting portion by non-transmitting portions;

a stepping motor including a coil, a stator and a rotor, the stepping motor being configured to (i) alternately switch a direction of a magnetic field generated in the stator when a drive current, a direction of which is alternately changed per pulse, is supplied to the coil, and (ii) rotate the rotor 180 degrees in one step to drive the hand wheel;

a photo detector configured to emit light at every even-numbered second during rotation of the stepping motor and detect light passing through the first, second and third light transmitting portions;

a data memory configured to store identification data indicative of a supply state of the drive current having been supplied to a winding start terminal and a winding end terminal of the coil; and a hand position detection controlling section configured to read the identification data from the data memory and control the photo detector to detect a position of the hand wheel based on the identification data;

wherein the second light transmitting portion includes a first arcuate aperture which ranges from a point of 8 seconds to a point of 16 seconds of the hand wheel and a second arcuate aperture which ranges from a point of 20 seconds to a point of 28 seconds of the hand wheel, and the third light transmitting portion includes a third arcuate aperture which ranges from a point of 32 seconds to a point of 40 seconds of the hand wheel and a fourth arcuate aperture which ranges from a point of 44 seconds and a point of 50 seconds of the hand wheel.

2. The hand position detecting device according to claim 1, wherein the first, second and third light transmitting portions are provided at points on the hands wheel corresponding to even-numbered seconds in the rotation of the stepping motor.

3. The hand position detecting device according to claim 1, wherein the hand position detection controlling unit detects one of the first, second and third light transmitting portions by the photo detector, and then controls the photo detector to detect the position of the hand wheel at every eight steps of rotation of the hand wheel.

4. The hand position detecting device according to claim 1, wherein the hand position detection controlling unit controls the photo detector to detect the position of the hand wheel at a timing set based on a combination of 2 and 8 steps of rotation of the hand wheel.

5. A hand position detecting device comprising:

a hand wheel including at least a first light transmitting portion provided at a reference point and second and third light transmitting portions spaced from the first light transmitting portion by non-transmitting portions;

a stepping motor including a coil, a stator and a rotor, the stepping motor being configured to (i) alternately switch a direction of a magnetic field generated in the stator when a drive current, a direction of which is alternately changed per pulse, is supplied to the coil, and (ii) rotate the rotor 180 degrees in one step to drive the hand wheel;

a photo detector configured to emit light at every even-numbered second during rotation of the stepping motor and detect light passing through the first, second and third light transmitting portions;

a data memory configured to store identification data indicative of a supply state of the drive current having been supplied to a winding start terminal and a winding end terminal of the coil; and a hand position detection controlling section configured to read the identification data from the data memory and control the photo detector to detect a position of the hand wheel based on the identification data;

wherein the non-transmitting portions blocks points of 2, 4, 6, 18, 30, 42, 52, 54, 56 and 58 seconds of the hand wheel.

6. The hand position detecting device according to claim 5, wherein the hand position detection controlling unit controls the photo detector to detect the position of the hand wheel at every two steps of rotation of the hand wheel.

7. The hand position detecting device according to claim 5, wherein the first, second and third light transmitting portions are provided at points on the hands wheel corresponding to even-numbered seconds in the rotation of the stepping motor.

* * * * *